US010320126B2

(12) United States Patent
Ju et al.

(10) Patent No.: US 10,320,126 B2
(45) Date of Patent: Jun. 11, 2019

(54) ELECTRICAL CONNECTOR AND ELECTRICAL CONNECTOR ASSEMBLY

(71) Applicant: LOTES CO., LTD, Keelung (TW)

(72) Inventors: Ted Ju, Keelung (TW); Wu Feng, Keelung (TW); Ya Jun Zeng, Keelung (TW); Nan Fang He, Keelung (TW); Jun Fan, Keelung (TW); Jin Ke Hu, Keelung (TW); Guo Sheng Zhou, Keelung (TW); Chin Chi Lin, Keelung (TW)

(73) Assignee: LOTES CO., LTD., Keelung (TW)

( * ) Notice: Subject to any disclaimer, the term of this patent is extended or adjusted under 35 U.S.C. 154(b) by 62 days.

(21) Appl. No.: 15/678,540

(22) Filed: Aug. 16, 2017

(65) Prior Publication Data

US 2018/0019551 A1 Jan. 18, 2018

Related U.S. Application Data

(63) Continuation of application No. 14/626,709, filed on Feb. 19, 2015, now Pat. No. 9,917,405.
(Continued)

(51) Int. Cl.
*H01R 13/6585* (2011.01)
*H01R 24/60* (2011.01)
(Continued)

(52) U.S. Cl.
CPC ..... *H01R 13/6585* (2013.01); *H01R 12/724* (2013.01); *H01R 13/6581* (2013.01);
(Continued)

(58) Field of Classification Search
CPC ..... H01R 13/6585
(Continued)

(56) References Cited

U.S. PATENT DOCUMENTS 8,851,927 B2 * 10/2014 Hsu ..... H01R 12/724 439/607.11
8,956,187 B2 * 2/2015 He ..... H01R 13/504 439/607.35
(Continued)

FOREIGN PATENT DOCUMENTS

CN 203859322 U 10/2014
CN 204030143 U 12/2014

OTHER PUBLICATIONS

U.S. Appl. No. 62/002,934, U.S. Provisional Application, filed May 26, 2014 and Filing Receipt.

*Primary Examiner* — Neil Abrams
(74) *Attorney, Agent, or Firm* — Locke Lord LLP; Tim Tingkang Xia, Esq.

(57) ABSTRACT

An electrical connector includes an insulation body. Multiple terminals are fixed on the insulation body in an upper row and a lower row. Each terminal has a soldering portion. The soldering portions are arranged in two rows in a front-rear direction. A middle shielding sheet is fixed on the insulation body, and has a planar plate portion. A baffle extends downward from a rear end of the plate portion and is located between the soldering portions in the two rows. The plate portion extends horizontally in a lateral direction to form a connecting portion, which is in front of the rear end of the plate portion. A rear edge of the connecting portion bends downward to form a leg. In the front-rear direction, a distance between the rear end of the plate portion and the rear edge of the connecting portion is greater than a width of the connecting portion.

20 Claims, 54 Drawing Sheets

Related U.S. Application Data

(60) Provisional application No. 62/024,728, filed on Jul. 15, 2014, provisional application No. 61/942,830, filed on Feb. 21, 2014.

(51) Int. Cl.

| | |
|---|---|
| ***H01R 13/6581*** | (2011.01) |
| ***H01R 13/6591*** | (2011.01) |
| ***H01R 12/72*** | (2011.01) |
| ***H01R 13/6583*** | (2011.01) |
| ***H01R 13/6594*** | (2011.01) |
| *H01R 107/00* | (2006.01) |

(52) U.S. Cl.
CPC ..... *H01R 13/6583* (2013.01); *H01R 13/6591* (2013.01); *H01R 13/6594* (2013.01); *H01R 24/60* (2013.01); *H01R 2107/00* (2013.01)

(58) Field of Classification Search
USPC ..... 439/607.11, 607.4
See application file for complete search history.

(56) References Cited

U.S. PATENT DOCUMENTS

| | | | | |
|---|---|---|---|---|
| 9,214,766 | B1 * | 12/2015 | Yu | H01R 13/6585 |
| 9,379,494 | B1 * | 6/2016 | Hu | H01R 13/6594 |
| 9,472,910 | B2 * | 10/2016 | Little | H01R 24/60 |
| 9,478,923 | B2 * | 10/2016 | Kao | H01R 24/60 |
| 9,484,677 | B2 * | 11/2016 | Guo | H01R 13/6585 |
| 9,577,387 | B2 * | 2/2017 | Hu | H01R 13/6597 |
| 9,673,569 | B2 * | 6/2017 | Zhang | H01R 13/6585 |
| 9,692,166 | B2 * | 6/2017 | Kao | H01R 24/60 |
| 9,722,360 | B2 * | 8/2017 | Yao | H01R 13/652 |
| 9,722,369 | B1 * | 8/2017 | Hsu | H01R 24/60 |
| 9,806,464 | B1 * | 10/2017 | Wang | H01R 13/6471 |
| 9,882,316 | B2 * | 1/2018 | Chen | H01R 13/405 |
| 9,917,405 | B2 * | 3/2018 | Ju | H01R 13/6585 |
| 9,935,401 | B2 * | 4/2018 | Tsai | H01R 13/652 |
| 9,948,041 | B2 * | 4/2018 | Chen | H01R 24/62 |
| 9,972,945 | B1 * | 5/2018 | Huang | H01R 13/6585 |
| 9,972,952 | B2 * | 5/2018 | Guo | H01R 24/60 |
| 10,008,793 | B2 * | 6/2018 | Ju | H01R 24/78 |
| 10,084,245 | B2 * | 9/2018 | Chang | H01R 13/6586 |
| 10,096,936 | B2 * | 10/2018 | Ju | H01R 13/6275 |
| 10,096,947 | B2 * | 10/2018 | Cheng | H01R 13/6581 |
| 10,096,961 | B2 * | 10/2018 | Zhao | H01R 13/6581 |
| 10,103,492 | B2 * | 10/2018 | Ju | H01R 13/04 |
| 10,103,499 | B2 * | 10/2018 | Tsai | H01R 13/502 |
| 10,116,098 | B2 * | 10/2018 | Zhao | H01R 24/60 |
| 10,116,100 | B2 * | 10/2018 | Feng | H01R 13/6596 |
| 10,122,124 | B2 * | 11/2018 | Daughtry, Jr. | H01R 13/405 |
| 10,128,596 | B2 * | 11/2018 | Tsai | H01R 12/716 |
| 10,164,379 | B2 * | 12/2018 | Duan | H01R 13/6585 |
| 10,170,867 | B2 * | 1/2019 | Ju | H01R 13/6585 |
| 10,177,502 | B2 * | 1/2019 | Zhao | H01R 13/6471 |
| 10,199,775 | B2 * | 2/2019 | Zhao | H01R 13/6585 |
| 10,199,776 | B2 * | 2/2019 | Cheng | H01R 24/62 |
| 10,218,134 | B2 * | 2/2019 | Tsai | H01R 24/60 |
| 2015/0333451 | A1 | 11/2015 | Kao et al. | |
| 2016/0233630 | A1 | 8/2016 | Cheng et al. | |
| 2018/0019551 | A1 * | 1/2018 | Ju | H01R 13/6585 |

* cited by examiner

200

100

100

100

ELECTRICAL CONNECTOR AND ELECTRICAL CONNECTOR ASSEMBLY

CROSS-REFERENCE TO RELATED APPLICATION

This application is a continuation application of U.S. application Ser. No. 14/626,709, filed Feb. 19, 2015, which itself claims priority to and the benefit of, pursuant to 35 U.S.C. § 119(e), U.S. provisional patent application Ser. No. 61/942,830, filed Feb. 21, 2014, and U.S. provisional patent application Ser. No. 62/024,728, filed Jul. 15, 2014. The entire contents of the above identified applications are incorporated herein by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector and an electrical connector assembly, and more particularly to an electrical connector with high-frequency performance and an electrical connector assembly.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With fast development of electronic elements, design specifications of the universal serial bus (USB) organization are also always being updated and upgraded. From USB 2.0 at beginning to USB 3.0 and USB 3.1 at present, or even the USB TYPE C specification, the transmission speed is higher and higher. To satisfy higher high-frequency requirements, a large quantity of efforts and capitals has been required in cooperatively developing those types of products, so that mass production can be implemented, and efficiency can be improved.

Therefore, it is necessary to design an improved electrical connector and an electrical connector assembly, so as to overcome the foregoing problem.

SUMMARY OF THE INVENTION

In view of the above problems in the related art, the present invention is directed to an electrical connector in firm snap-fit to ensure stable high-frequency performance and an electrical connector assembly thereof.

To achieve the foregoing objective, the present invention uses the following technical means:

An electrical connector is used for mating with a mating connector. The mating connector has at least two metal elastic sheets. The electrical connector includes: an insulation body, where the insulation body has a base portion and a tongue located at a front end of the base portion; multiple terminals fixedly disposed in the base portion in a manner of an upper row and a lower row, where each of the terminals has a contact portion exposed from either an upper surface or a lower surface of the tongue, and the mating connector and the contact portion are contacted; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue, where two of the metal elastic sheets buckle the snap-fit portions to stop the metal elastic sheet from being disengaged; and an outer metal casing, where the outer metal casing wraps peripheries of the base portion and the tongue.

In one embodiment, the electrical connector further has an inner metal casing. The inner metal casing has at least one covering portion disposed on an upper surface of the tongue, and at least one extending portion extending from the covering portion toward the base portion. The extending portion has at least one contact arm, and the contact arm urges an inner wall of the outer metal casing. The extending portion is provided with two positioning portions, the base portion is provided with two positioning slots corresponding to the two positioning portions, and the two positioning slots accommodate and fix the two positioning portions.

In one embodiment, the upper row of multiple terminals are respectively two grounding terminals, two power supply terminals and two signal terminals, the lower row of multiple terminals are respectively two grounding terminals, two power supply terminals and two signal terminals, and the upper row of multiple terminals and the lower row of multiple terminals are disposed symmetrically on the upper surface and the lower surface of the tongue.

In one embodiment, the middle shielding sheet has a plate portion fixedly disposed in the tongue. Two protruding portions extend respectively from two sides of the plate portion out of the two sides of the tongue, two of the snap-fit portions are grooves disposed at the two protruding portions, and the two grooves are located out of the two sides of the tongue.

In one embodiment, the outer metal casing has a wrapping casing and a shielding casing. The wrapping casing wraps the peripheries of the base portion and the tongue. The shielding casing is disposed out of the wrapping casing. Each of two sides of the wrapping casing has a first soldering pin. Each of two sides of the shielding casing has a second soldering pin. The first soldering pin and the second soldering pin are staggered front and back. The first soldering pin is close to a lateral side of the base portion, and the second soldering pin is close to a lateral side of the tongue.

In one embodiment, the wrapping casing has a first rear wall, and the shielding casing has a second rear wall. The first rear wall has a first middle portion and first sheltering portions located at two sides of the first middle portion. The second rear wall has a second middle portion and a second sheltering portion connected to a lower part of the second middle portion. The first middle portion and the second middle portion are approximately superposed front and back, the second rear wall forms a notch at a place corresponding to the first sheltering portion, and the second sheltering portion exceeds the first middle portion downward.

Another technology means is as follows:

An electrical connector assembly includes an electrical connector and a mating connector. The electrical connector includes: an insulation body, where the insulation body has a base portion and a tongue located at a front end of the base portion, multiple terminals are fixedly disposed in the base portion in a manner of an upper row and a lower row, and each of the terminals has a contact portion exposed from either of an upper surface and a lower surface of the tongue; a middle shielding sheet, fixedly disposed at the base portion and the tongue, where the middle shielding sheet is located between the upper row of terminals and the lower row of terminals; at least two snap-fit portions disposed at two sides of the middle shielding sheet and exposed from two sides of the tongue; and an outer metal casing, where the outer metal casing wraps peripheries of the base portion and the tongue, and two of the metal elastic sheets buckle the snap-fit portions to stop the metal elastic sheet from being disengaged. The mating connector has two metal elastic sheets corresponding to two of the snap-fit portions. When the mating connector and the electrical connector are mated, the two metal elastic sheets are respectively cooperatively fixed to two of the snap-fit portions, and the mating connector and the contact portion are contacted.

In one embodiment, the mating connector has an insertion portion, the insertion portion has a mating space, each of two sides of the insertion portion has a hollowing portion in communication with the mating space, the two metal elastic sheets are at least partially located at the two sides of the insertion portion, and pass through the hollowing portion to enter the mating space, and the tongue and the snap-fit portions are located in the mating space.

In one embodiment, the mating connector has a metal cover. The metal cover is formed by means of one-piece drawing or stretching. The metal cover has a front segment and a rear segment connected to each other. The front segment has a top surface and a bottom surface provided opposite to each other, and two side surfaces connected to the top surface and the bottom surface. A place at where the top surface or the bottom surface is connected to the rear segment is provided with a step. The two side surfaces and the rear segment are in a form of direct extension.

Preferably, another aspect of the present invention relates to an electrical connector, which includes: an insulation body; a plurality of terminals, fixedly disposed on the insulation body in an upper row and a lower row, wherein each of the terminals has a soldering portion, and the soldering portions are arranged in two rows in a front-rear direction; and a middle shielding sheet, fixedly disposed on the insulation body, wherein the middle shielding sheet has a planar plate portion located between the terminals in the upper row and the lower row, a baffle extends downward from a rear end of the plate portion and is located between the soldering portions in the two rows, the plate portion extends horizontally in a lateral direction to form a connecting portion, the connecting portion is in front of the rear end of the plate portion, and a leg extends and bends downward from a rear edge of the connecting portion bends downward; wherein a distance between the rear end of the plate portion and the rear edge of the connecting portion in the front-rear direction is greater than a width of the connecting portion in the front-rear direction.

In one embodiment, a side edge of the leg is flush with a side edge of the connecting portion.

In one embodiment, a distance between the baffle and the soldering portions in a back row is smaller than a distance between the baffle and the soldering portions in a front row.

In one embodiment, the leg is located in front of the baffle.

In one embodiment, a gap between the leg and the plate portion is smaller than the width of the connecting portion in the front-rear direction.

In one embodiment, the leg has: a first section accommodated in the insulation body and parallel to the baffle, wherein the first section is in front of the baffle, and the first section and the baffle are arranged in a staggered way in the front-rear direction; and a second section connected to the first section and exposed to the insulation body.

In one embodiment, a length of the first section is greater than a width of the baffle in a vertical direction.

In one embodiment, a side edge of the baffle is flush with a side edge of the plate portion.

In one embodiment, two connecting portions are symmetrically arranged and formed by extending from two opposite side edges of the plate portion, respectively; at least two first through holes arranged in a row and a second through hole located in front of the first through holes are formed by passing through an upper surface and a lower surface of the plate portion; the connecting portions are located closer to the first through holes than a front end of the plate portion in the front-rear direction; and the plate portion has a center line in the front-rear direction, and the center line passes through the second through hole.

In one embodiment, two slots are respectively provided at the two opposite side edges of the plate portion in front of the connecting portions, and the two slots and the first through holes are arranged in a row.

In one embodiment, a front edge of each of the slots is located behind a front edge of the second through hole.

In one embodiment, a width of each of the slots in the front-rear direction is greater than the distance between the rear end of the plate portion and the rear edge of the connecting portion in the front-rear direction.

In one embodiment, an upper shielding sheet covers an upper surface of the insulation body, a lower shielding sheet covers a lower surface of the insulation body, each of the upper shielding sheet and the lower shielding sheet is provided with a side plate accommodated in each of the slots.

In one embodiment, the plate portion is provided with two third through holes penetrating therethrough in front of the second through hole, the two third through holes are located on two sides of the center line and are symmetrical to the center line, and a distance between the first through holes and the second through hole is different from a distance between the second through hole and the third through holes.

In one embodiment, a recess is concavely formed backward on a front end of the plate portion, the recess is located right in front of the third through holes, and a distance between the recess and the third through holes is smaller than a distance between the third through holes and the connecting portions in a row.

In one embodiment, the first through holes, the second through hole and the third through holes are all located between backward extending lines of a left edge and a right edge of the recess.

In one embodiment, the plate portion is provided with two round holes symmetrically formed at two opposite sides of the recess, respectively, and an extending line of a side edge of the plate portion connecting the baffle passes through one of the two round holes.

In one embodiment, two slots are respectively at the two opposite side edges of the plate portion in front of the connecting portions, and a forward extending line of a side edge of each of the slots passes through a corresponding one of the round holes.

In one embodiment, the two opposite side edges of the plate portion respectively extend to form two protruding portions exposed from the insulation body, the two protruding portions and the two round holes are arranged in a same row, and a backward extending line of an outer side edge of each of the two protruding portions passes through a corresponding one of the connecting portions.

In one embodiment, a connecting line of rear ends of the two protruding portions passes through the third through holes.

The present invention has the following beneficial effects.

When the mating connector is inserted into the electrical connector after the electrical connector is completely assembled, two of the snap-fit portions are disposed at two sides of the tongue and cooperatively fixed to the mating connector, thereby being in firm snap-fit to ensure stable high-frequency performance. The connecting portions and the baffle are fixed to the base portion, and due to the limitation of the size of the electrical connector, a length of the base portion in the front-rear direction is limited. As a result, under the condition that the distance between a front edge of the connecting portion and the baffle is unchanged, the distance between the rear end of the plate portion and the rear edge of the connecting portion is greater than the width of the connecting portion in the front-rear direction, which results in a reduction of the width of the extending portion and an increase of the distance between the extending portion and the baffle, thereby increasing the distance between the pins and the baffle, and satisfying the requirement for the electrical connector to achieve high-frequency signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
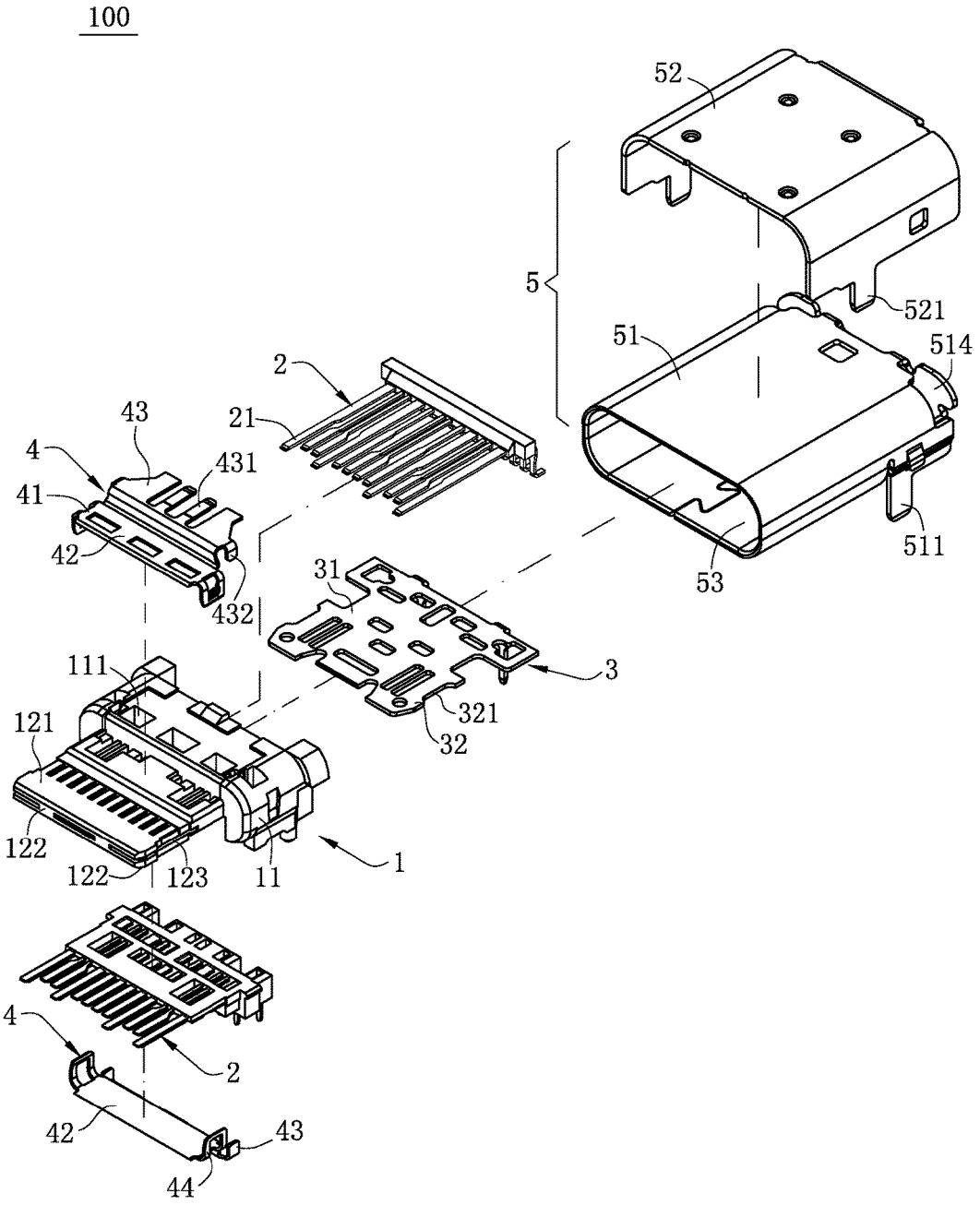
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" and/or "multiple" means two or more.

As used herein, the terms "comprising", "including", "carrying", "having", "containing", "involving", and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

Furthermore, relative terms, such as "lower" or "bottom" and "upper" or "top", may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

For convenience of better understanding objectives, structures, features and efficacies of the present invention, the present invention is further described with reference to accompanying drawings and specific implementation manners.

As shown in FIG. 1, FIG. 16, FIG. 7, and FIG. 12, an electrical connector 100 of the present invention is an electrical connector socket supporting high-speed data transmission, and a mating connector 200 is an electrical connection plug supporting high-speed data transmission.

Figure 16:
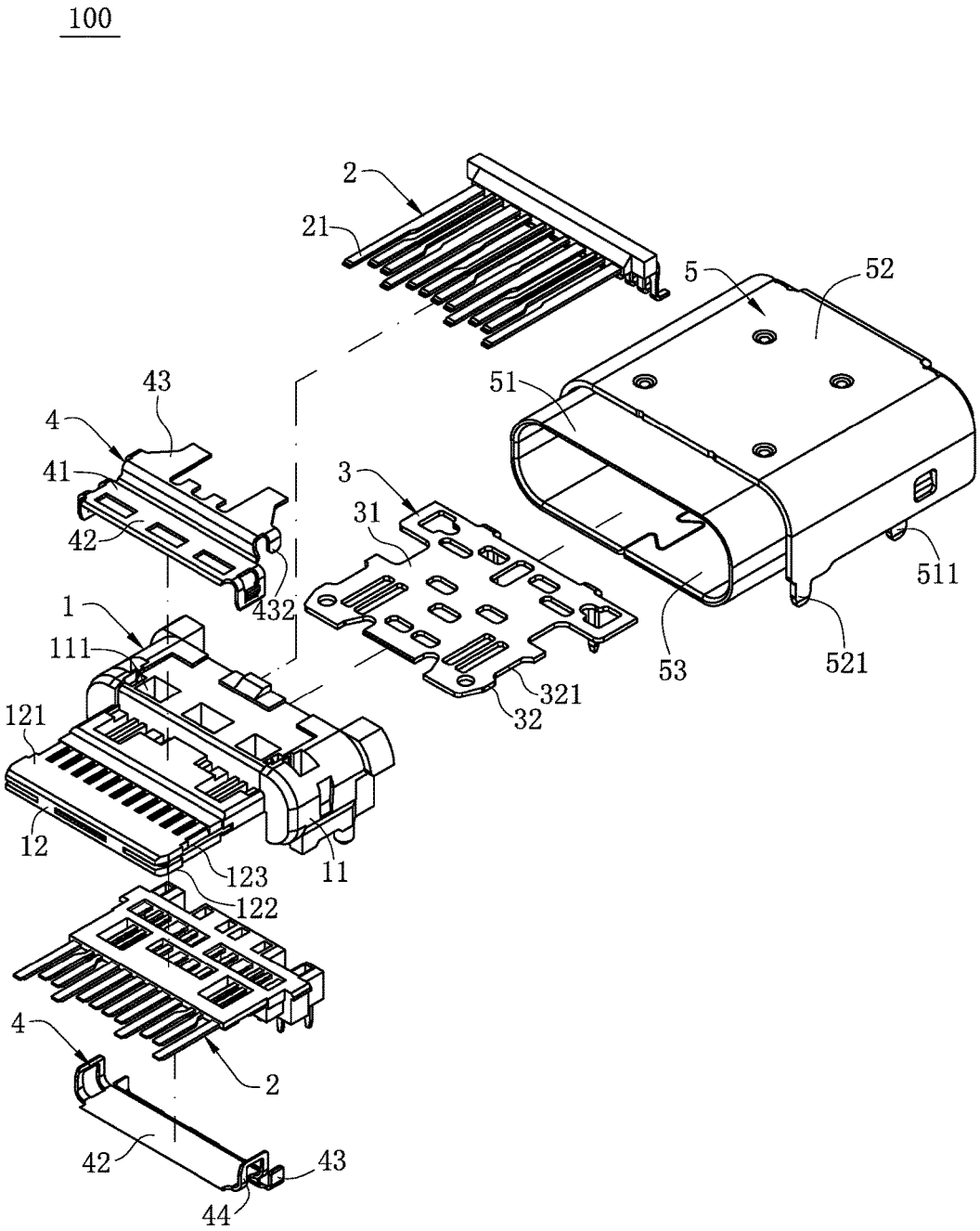
FIG. 16 is a three-dimensional exploded view of an electrical connector according to a third embodiment of the present invention.
Figure 17:
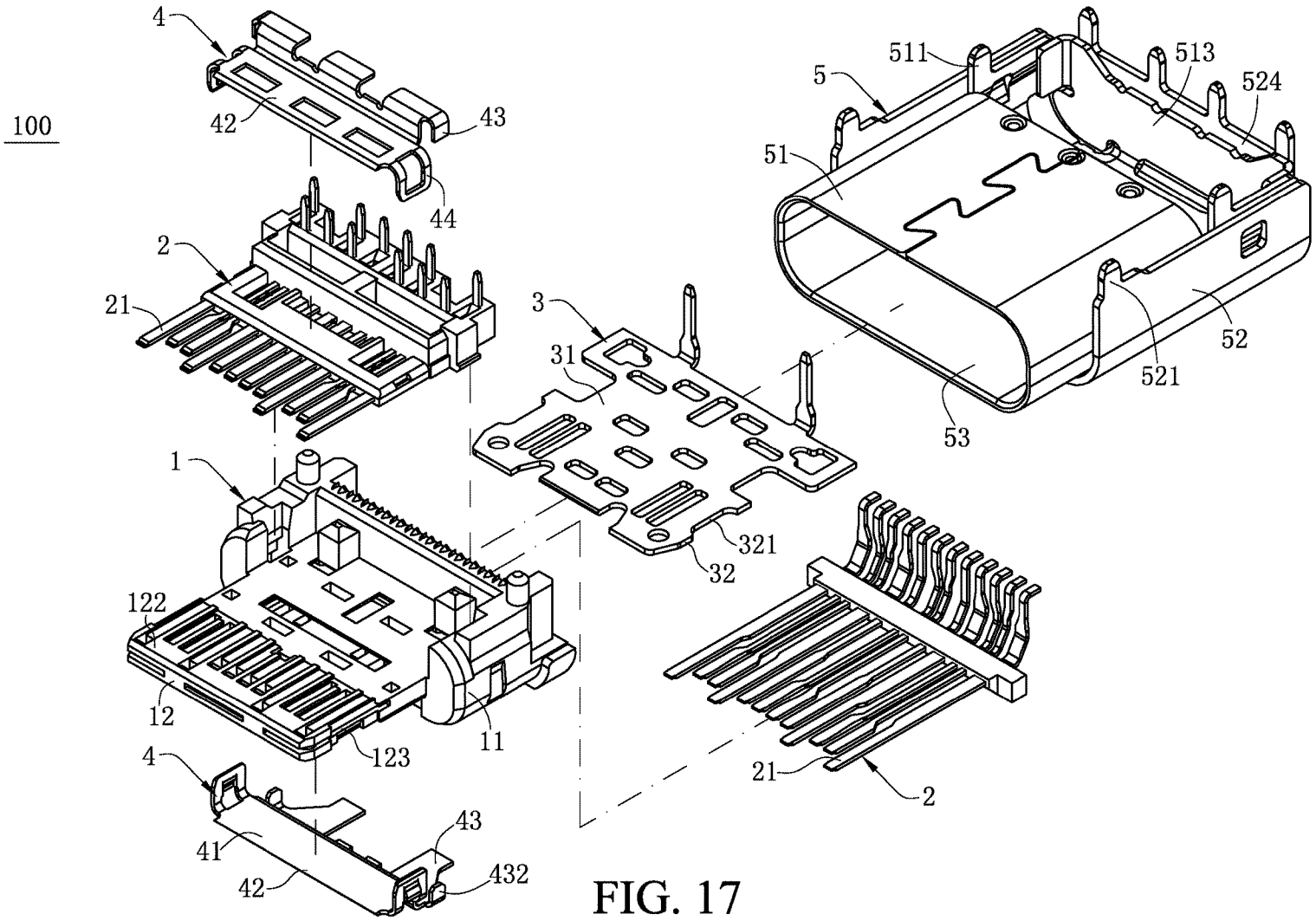
FIG. 17 is a three-dimensional exploded view of the electrical connector viewed from another viewing angle according to the third embodiment of the present invention.

As shown in FIG. 1 and FIG. 16, the electrical connector 100 includes an insulation body 1; multiple terminals 2 fixedly disposed at the insulation body 1; a middle shielding sheet 3 fixedly disposed at the insulation body 1; an inner metal casing 4, covering and fixed onto the insulation body 1; and an outer metal casing 5, framing the insulation body 1 and the inner metal casing 4 to form an insertion space 53.

As shown in FIG. 7 to FIG. 11, the mating connector 200 has a main body 6 and an insertion portion 7 formed by extending forward from the main body 6. The insertion portion 7 has each of two sides of the insertion portion 7 has a hollowing portion 74 in communication with the mating space 73. Two metal elastic sheets 8 are fixed to two sides of the main body 6, and partially extend forward and are located at the two sides of the insertion portion 7. The two metal elastic sheets 8 pass through the hollowing portion 74 to enter the mating space 73, and are conveniently for stable snap-fitting with the electrical connector 100. An upper grounding sheet 81 and a lower grounding sheet 82 are respectively disposed at a top 71 and a bottom 72 of the insertion portion 7. The upper grounding sheet 81 and the lower grounding sheet 82 at least partially pass through the insertion portion 7 to enter the mating space 73, so as to be cooperatively fixed to the electrical connector 100, and a grounding objective may further be achieved. A middle grounding sheet 83 is located in the main body 6 and the insertion portion 7.

As shown in FIG. 12 to FIG. 15, the mating connector 200 further has a metal cover 9 surrounding the main body 6 and the insertion portion 7. The metal cover 9 is formed by means of one-piece drawing or stretching. The metal cover 9 has a front segment 91 and a rear segment 92 connected to each other. The front segment 91 has a top surface 911 and a bottom surface 912 disposed opposite to each other, and two side surfaces 913 connected to the top surface 911 and the bottom surface 912. A place at which the top surface 911 or the bottom surface 912 is connected to the rear segment 92 is provided with a step 93. The two side surfaces 913 and the rear segment 92 are in a form of direct extension, that is, the top surface 911 and the bottom surface 912 of the front segment 91 are backward reamed, so that the place at which the top surface 911 or the bottom surface 912 is connected to the rear segment 92 is provided with the step 93, while the two side surfaces 913 of the front segment 91 are not backward reamed, and therefore a place at which each of the two side surfaces 913 is connected to the rear segment 92 is not provided with any step 93, so as to facilitate molding and save the space in the width direction. The upper grounding sheet 81, the lower grounding sheet 82 and the middle grounding sheet 83 all contact the metal cover 9, grounding paths become more, and the grounding effect is stable.

Figure 2:
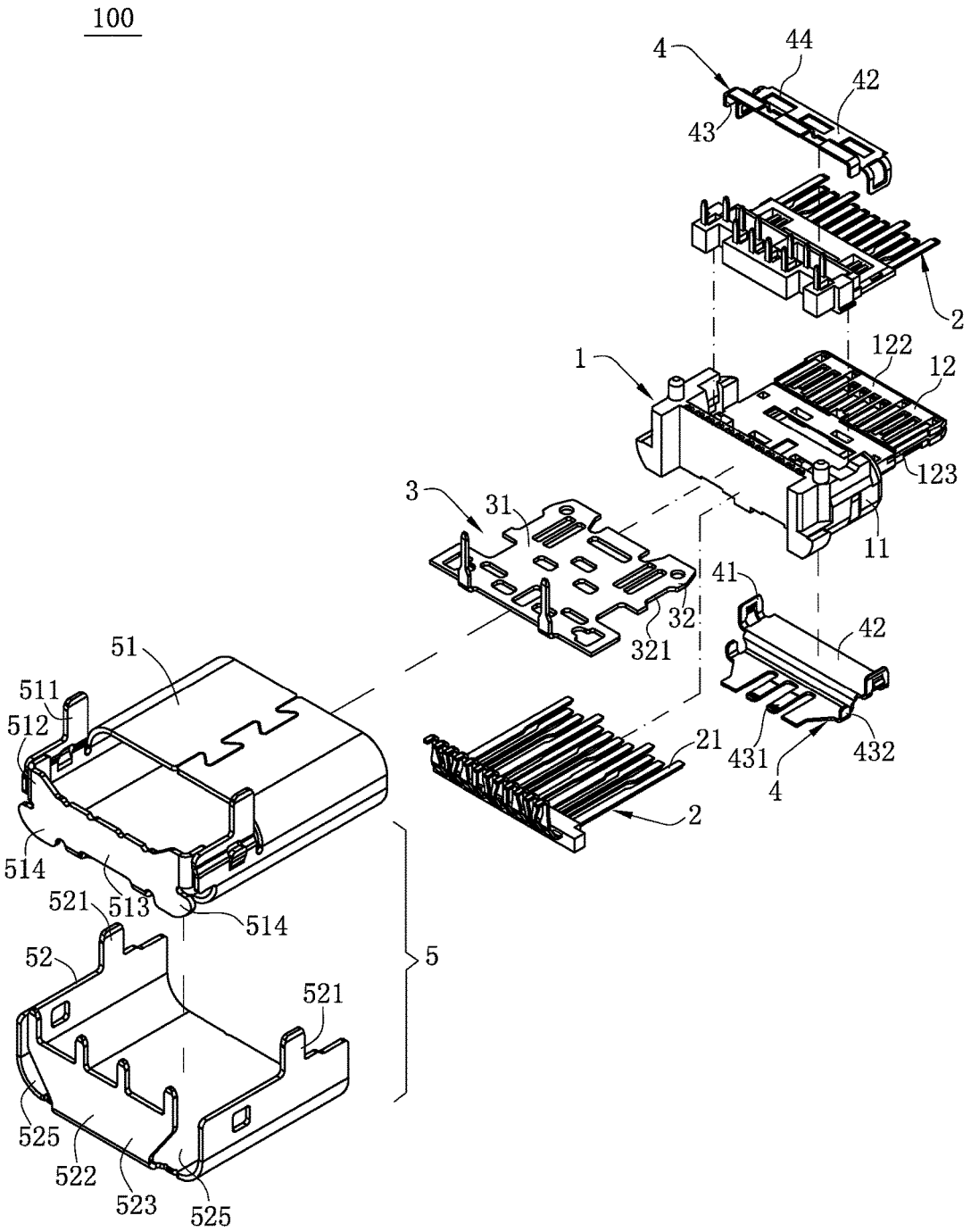
FIG. 2 is a three-dimensional exploded view of the electrical connector viewed from another viewing angle according to one embodiment of the present invention.
Figure 3:
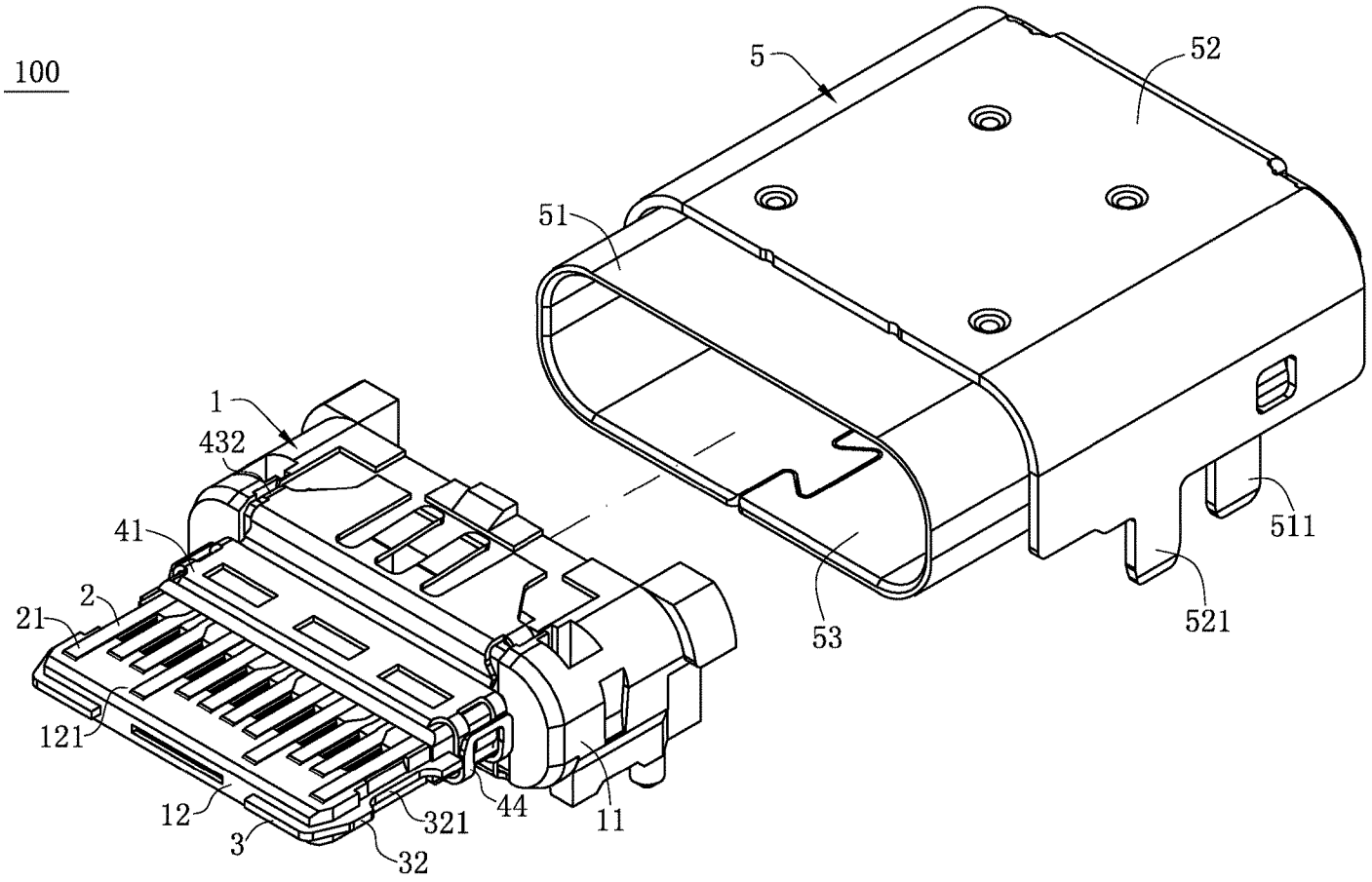
FIG. 3 is a partial three-dimensional exploded view of the electrical connector according to one embodiment of the present invention.
Figure 4:
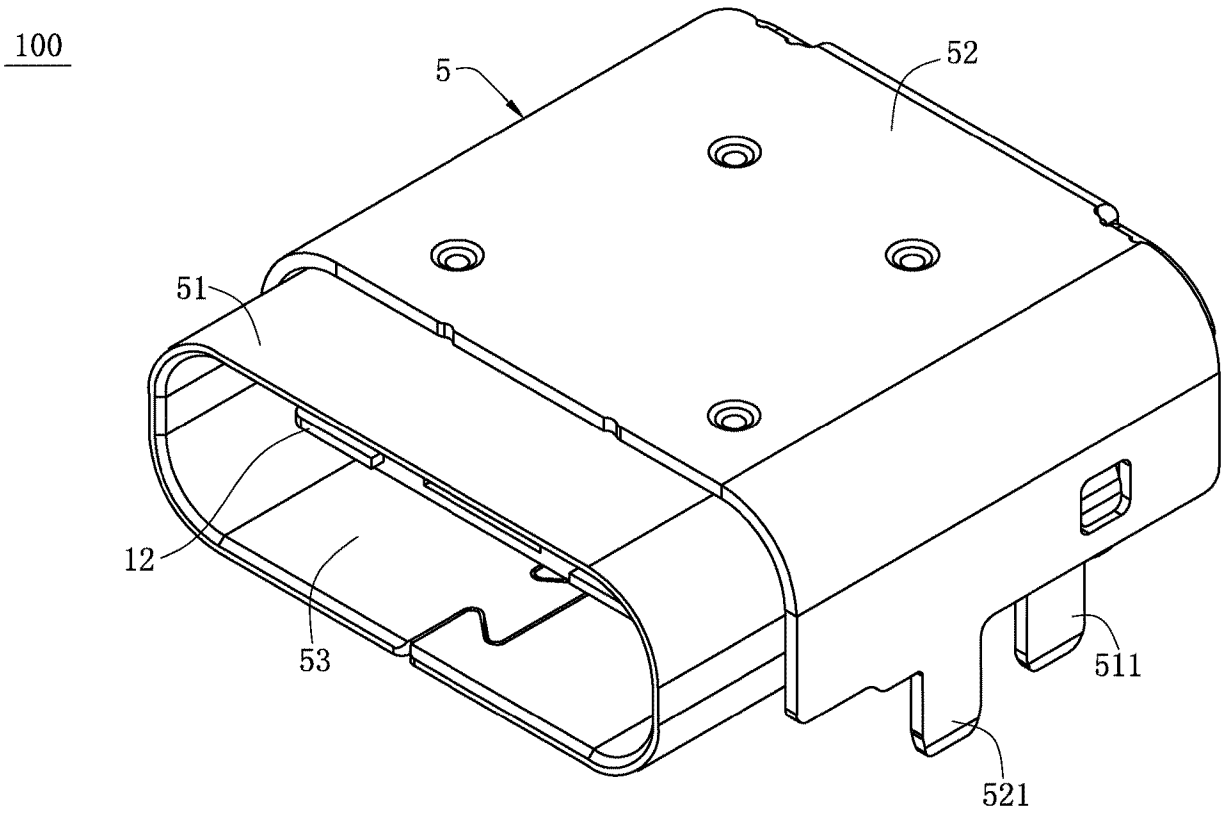
FIG. 4 is a three-dimensional assembly drawing of the electrical connector according to one embodiment of the present invention.

As shown in FIG. 1 to FIG. 3, the insulation body 1 has a base portion 11 and a tongue 12 located at a front end of the base portion 11. The base portion 11 is provided with two positioning slots 111. The tongue 12 has an upper surface 121 and a lower surface 122 disposed opposite to each other. Each of two sides of the tongue 12 is provided with a snap-fit slot 123, and the two snap-fit slots 123 are formed into two snap-fit portions (not labeled). When the mating connector 200 and the electrical connector 100 are mated, the two metal elastic sheets 8 are respectively cooperatively fixed to the two snap-fit portions, and the tongue 12 and the snap-fit slots 123 are all located in the mating space 73.

As shown in FIG. 1 to FIG. 3, the multiple terminals 2 are fixedly disposed in the base portion 11 in a manner of an upper row and a lower row. Each of the terminals has a contact portion 21 exposed from an upper surface 121 or a lower surface 122 of the tongue 12, so that the mating connector 200 and the contact portions 21 are contacted. The multiple terminals 2 include multiple pairs of high-speed terminals (not labeled), two power supply terminals (not labeled), two grounding terminals (not labeled), two reserved terminals (not labeled) and the like. In other embodiments (not shown), the upper row of multiple terminals 2 are respectively two grounding terminals, two power supply terminals, two signal terminals and two reserved terminals, the lower row of multiple terminals 2 are respectively two grounding terminals, two power supply terminals, two signal terminals and two reserved terminals, the upper row of multiple terminals 2 and the lower row of multiple terminals 2 are disposed symmetrically on the upper surface 121 and the lower surface 122 of the tongue 12, where the signal terminals are non-high-speed terminals. Certainly, in some embodiments, the reserved terminals (not shown) may further be removed. That is, the terminal type may be adjusted when necessary, and the functionality is enhanced. The high-speed terminals of the multiple terminals 2 are differential signal terminals. Parts of the differential signal terminals, located in the base portion 11 and the tongue 12, are close to each other, and the differential signal terminals are away from the grounding terminals at an adjacent side.

The number of the multiple terminals 2 may reach to 24. The upper row of terminals 2 are 12 in number, and are respectively a grounding terminal, a pair of high-speed terminals, a power supply terminal, a reserved terminal, two USB 2.0 terminals, a reserved terminal, a power supply terminal, a pair of high-speed terminals and a grounding terminal. Correspondingly, the lower row of terminals 2 are 12 in number, and are distributed corresponding to the upper row of terminals 2, so that the mating connector 200 may be inserted into the electrical connector 100 in dual orientation.

The terminals 2 are large in number, and the electrical connector 100 is very small in volume, and therefore the multiple terminals 2 are arranged very densely in the insulation body 1. In this way, the assembly difficulty increases, and the electrical connector 100 is in the USB C TYPE, which has very high requirements on volume and high-frequency, and therefore the terminals 2 in the electrical connector 100 cannot be mounted to the insulation body 1 in an assembly manner. Therefore, the insulation body 1 has three parts independent from each other. The upper row of terminals 2 are integrally formed in a first part of the insulation body 1 by means of injection molding, the lower row of terminals 2 are integrally formed in a second part of the insulation body 1 by means of injection molding, and then the two are mounted in a third part of the insulation body 1. Certainly, in other embodiments, it may also be that, the insulation body 1 has two parts independent from each other, the upper row of terminals 2 are integrally formed in a first part of the insulation body 1 by means of injection molding, the lower row of terminals 2 are integrally formed in a second part of the insulation body 1 by means of injection molding, then the two are mounted and fixed together, and a third part does not need to be used. Alternatively, when requirements on high-frequency and functions of the electrical connector 100 are low, the terminals 2 are correspondingly reduced in number, and it may be appropriately considered that some of the terminals 2 are mounted, and other terminals are integrally formed by means of injection molding.

Multiple locations of the insulation body 1, corresponding to the terminals 2, are each provided with an adjustment hole (not labeled). The adjustment hole enables the terminals 2 to be exposed out of the insulation body 1, and is used for adjusting impedance of the terminals 2, so that the electrical connector 100 may meet the high-frequency requirements in the industry.

As shown in FIG. 1, the middle shielding sheet 3 is fixedly disposed at the base portion 11 and the tongue 12, and the middle shielding sheet 3 is located between the upper row of terminals 2 and the lower row of terminals 2, so as to ensure the shielding effect, and ensure high-frequency performance. The middle shielding sheet 3 has a plate portion 31 fixedly disposed in the tongue 12. Two protruding portions 32 respectively extend out of the two sides of the tongue 12 from two sides of the plate portion 31. The two snap-fit portions are grooves 321 disposed at the two protruding portions 32. The two grooves 321 are located out of the two sides of the tongue 12, and locations of the grooves 321 are corresponding to locations of the snap-fit slots 123. When the mating connector 200 is inserted into the electrical connector 100 (not shown), the insertion portion 7 enters the insertion space 53, and the metal elastic sheet 8 are snap-fit in the snap-fit slots 123 and the grooves 321. Certainly, in other embodiments, the tongue 12 is not provided with the snap-fit slots 123, and only the protruding portions 32 are provided with the grooves 321 cooperatively fixed to the metal elastic sheet 8, or, only the tongue 12 is provided with the snap-fit slots 123 cooperatively fixed to the metal elastic sheets 8.

Two sides of the middle shielding sheet 3 respectively extend out of the tongue 12 laterally, the front end of the middle shielding sheet 3 extends forward out of the front end of the tongue 12, and when the mating connector 200 and the electrical connector 100 are butted, the front end of the tongue 12 may be prevented from abrasion. A baffle plate (not labeled) extends from the back end of the middle shielding sheet 3, and the baffle plate is located between a welding portion (not labeled) of the upper row of terminals 2 and a welding portion (not labeled) of the lower row of terminals 2, and used for shielding signal interference between the two rows of terminals 2.

As shown in FIG. 1, the inner metal casing 4 is formed by buckling an upper shielding sheet 41 and a lower shielding sheet 44 to each other, and is assembled simply and easily. Each of the upper shielding sheet 41 and the lower shielding sheet 44 has a covering portion 42 disposed respectively on the upper surface 121 or the lower surface 122 of the tongue 12, an extending portion 43 extends backward from each of the covering portions 42. The extending portions 43 are stuck to and are covering the base portion 11. The extending portion 43 close to the upper surface 121 has two contact arms 431, and the contact arms 431 urge an inner wall of the outer metal casing 5, so as to increase shielding performance and be grounded. Certainly, in other embodiments, the extending portion 43 may extend backward only from the covering portion 42 stuck and covering to the upper surface 121, and the extending portion 43 has one or more contact arms 431, as long as the one or more contact arms 431 can contact the inner wall of the outer metal casing 5. Additionally, the extending portion 43 is provided with two positioning portions 432, and the two positioning slots 111 accommodate and fix the two positioning portions 432. The upper shielding sheet 41 and the lower shielding sheet 44 are in a frame shape and integrally formed, and the covering portion 42 of each of the upper shielding sheet 41 and the lower shielding sheet 44 is provided with at least one blind hole (not labeled), which helps the mating connector 200 snap-fit and fix with the blind hole. Certainly, the blind hole may also run through in the direction of the tongue 12 to form a through-hole (not labeled), or even, a through-hole corresponding to the upper surface 121 and the lower surface 122 of the tongue 12 is also further depressed, which further helps the mating connector 200 snap-fit and fix with the blind hole, which is not easily disengaged.

Figure 18:
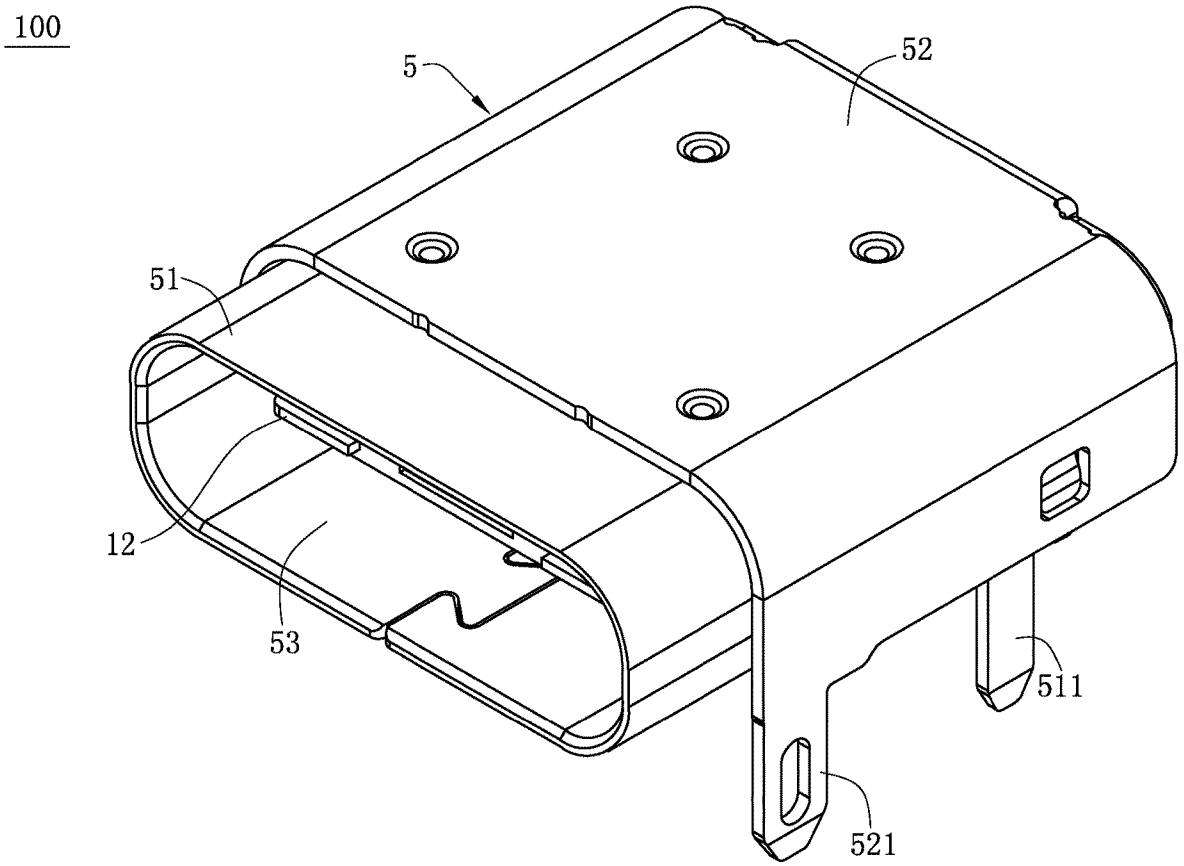
FIG. 18 is a three-dimensional assembly view of an electrical connector according to a fourth embodiment of the present invention.
Figure 19:
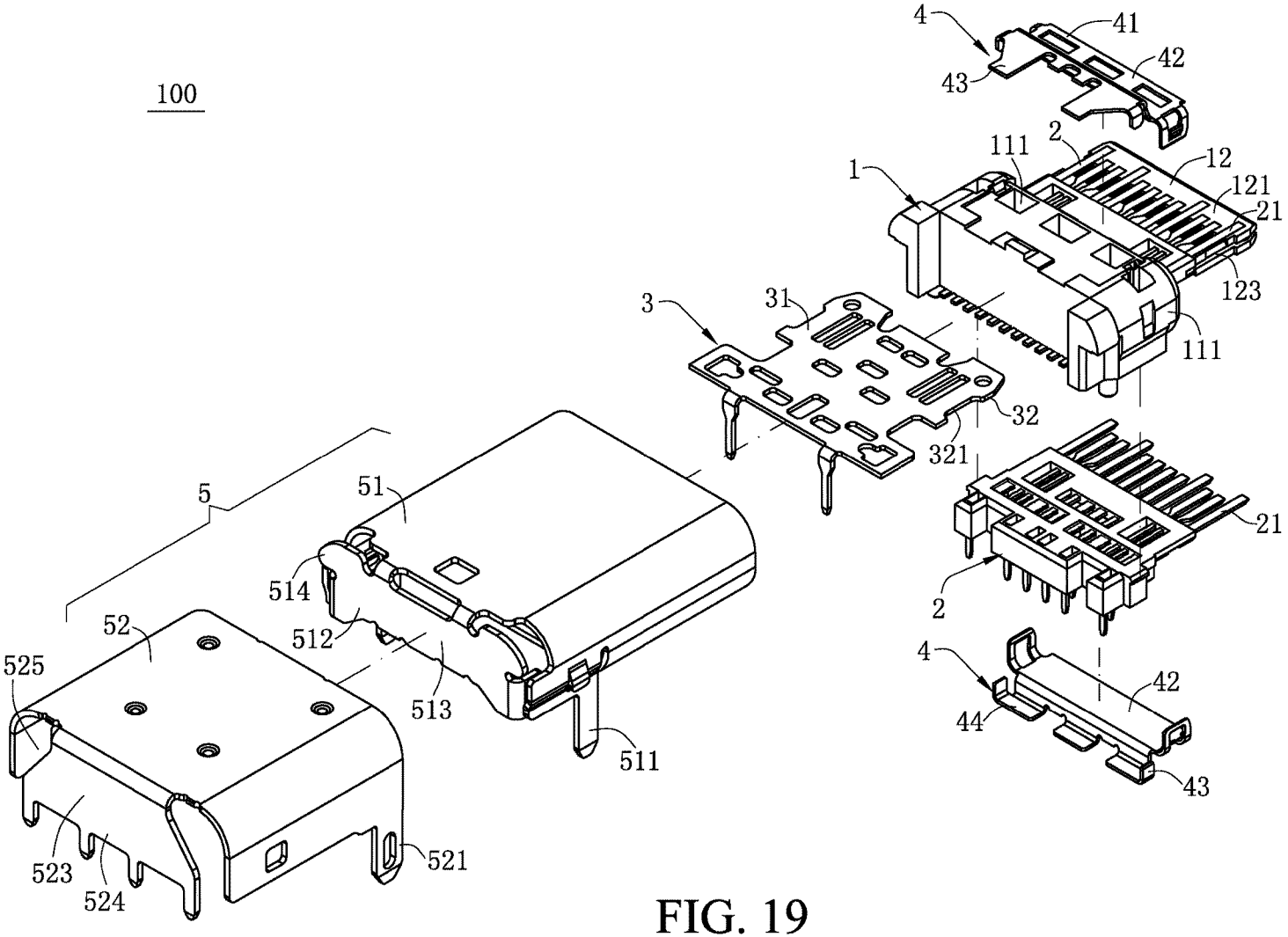
FIG. 19 is a three-dimensional exploded view of the electrical connector according to the fourth embodiment of the present invention.
Figure 20:
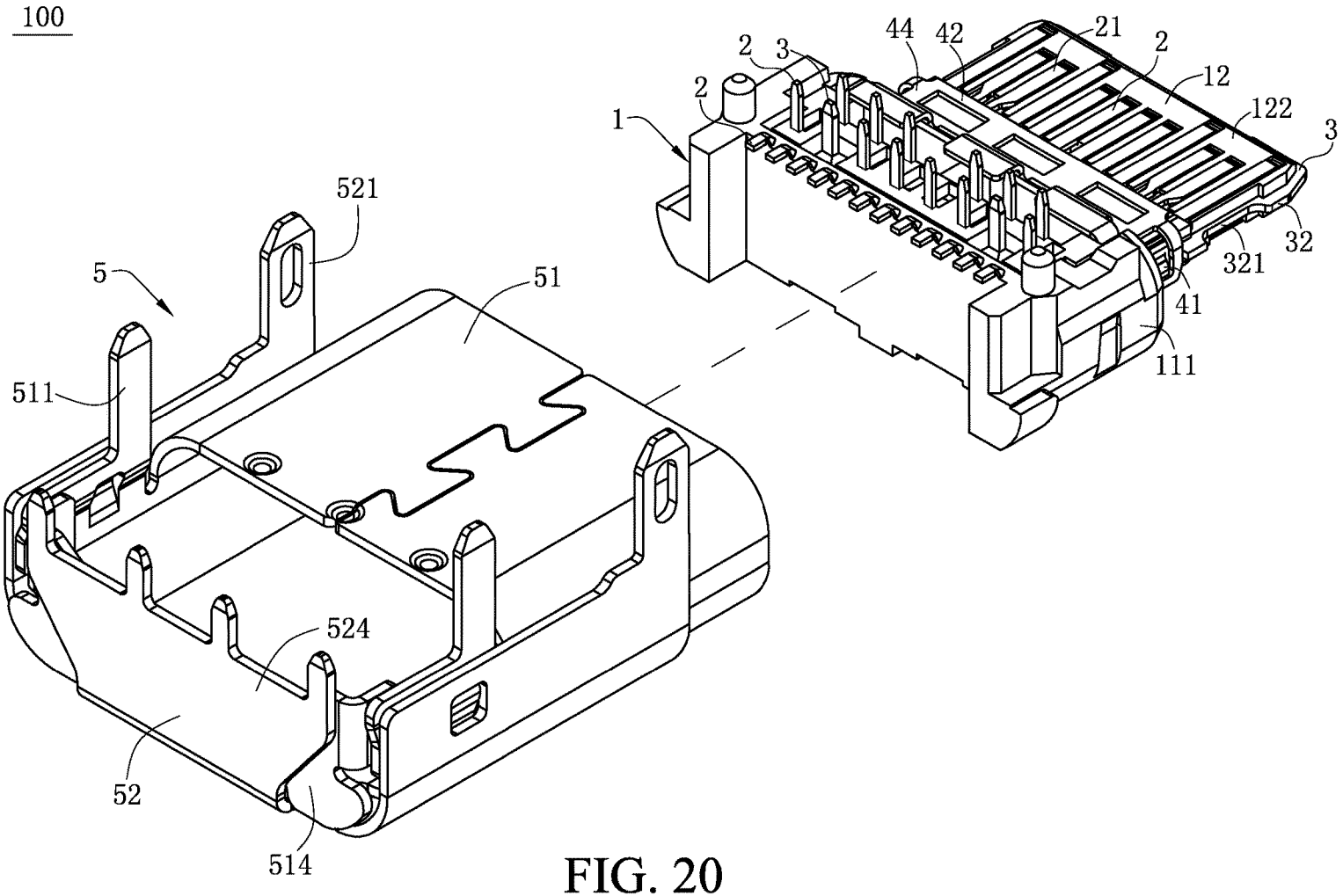
FIG. 20 is a partial three-dimensional exploded view of the electrical connector according to the fourth embodiment of the present invention.

As shown in FIG. 1 to FIG. 5, the outer metal casing 5 wraps peripheries of the base portion 11 and the tongue 12. The outer metal casing 5 has a wrapping casing 51 and a shielding casing 52. The wrapping casing 51 wraps the peripheries of the base portion 11 and the tongue 12, and the shielding casing 52 is disposed out of the wrapping casing 51. The double protection can reduce signal loss as much as possible. Each of two sides of the wrapping casing 51 has a first soldering pin 511, each of two sides of the shielding casing 52 has a second soldering pin 521. The first soldering pin 511 and the second soldering pin 521 are staggered front and back. The first soldering pin 511 is close to the lateral side of the base portion 11, and the second soldering pin 521 is close to the lateral side of the tongue 12, and therefore the electrical connector 100 is stably mounted on a circuit board 300, and not easily disengaged. Certainly, in other embodiments, it may also be that, the first soldering pins 511 and the second soldering pins 521 are all located at the front end, or are all located at the back end, the multiple terminals 2 in the electrical connector 100 are welded on the circuit board 300 at welding locations (not labeled), and from a side viewing angle, the front and back arrangement relationship among the first soldering pins 511, the second soldering pins 521 and the welding locations may be appropriately adjusted and changed, as long as the electrical connector 100 is well and stably mounted on the circuit board 300. As shown in FIG. 18, a through-hole (not labeled) runs through each of the second soldering pin 521, and when the second soldering pins 521 are welded onto the circuit board 300, the contact area of coated solder paste and the second soldering pins 521 are increased, so as to ensure that the second soldering pins 521 and the circuit board 300 are stably positioned.

Figure 5:
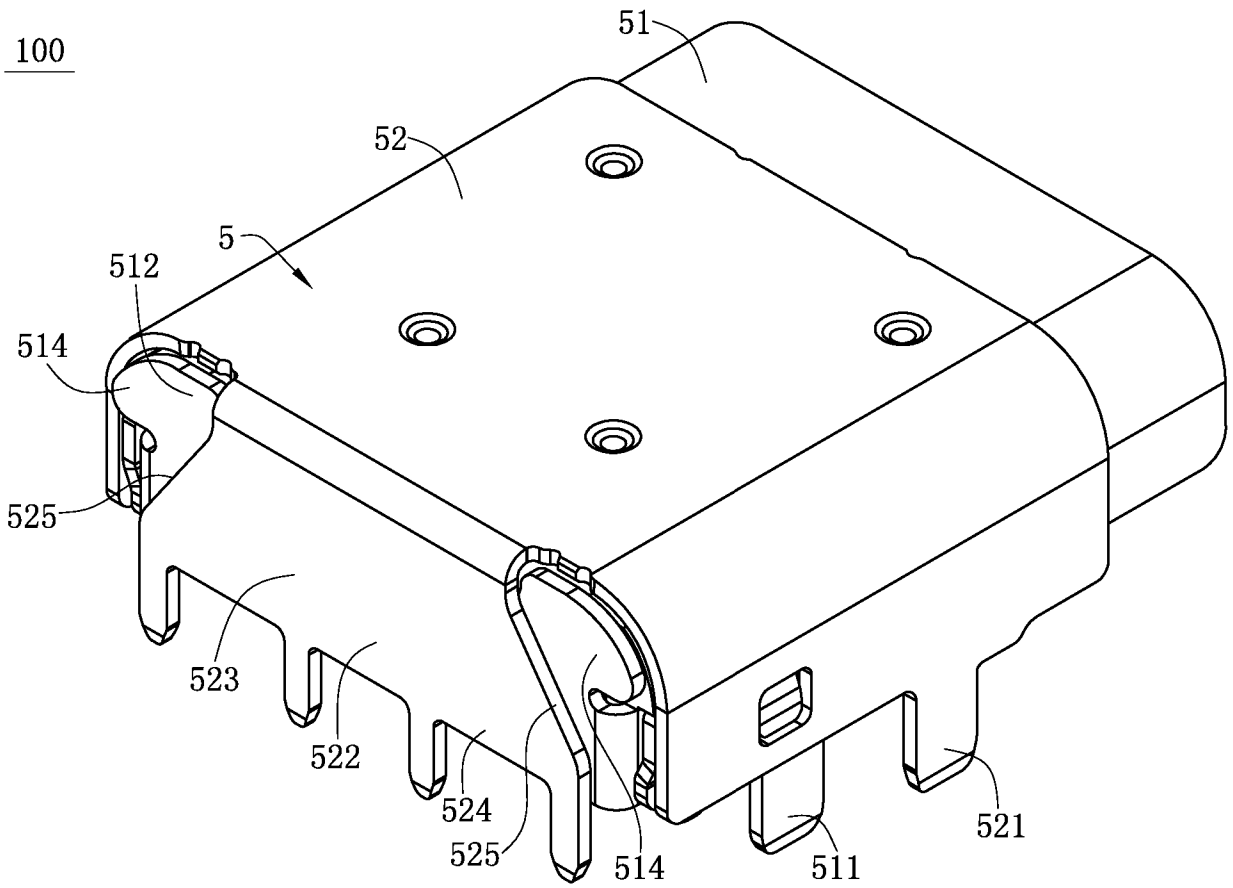
FIG. 5 is a three-dimensional exploded view of the electrical connector viewed from another viewing angle according to one embodiment of the present invention.
Figure 6:
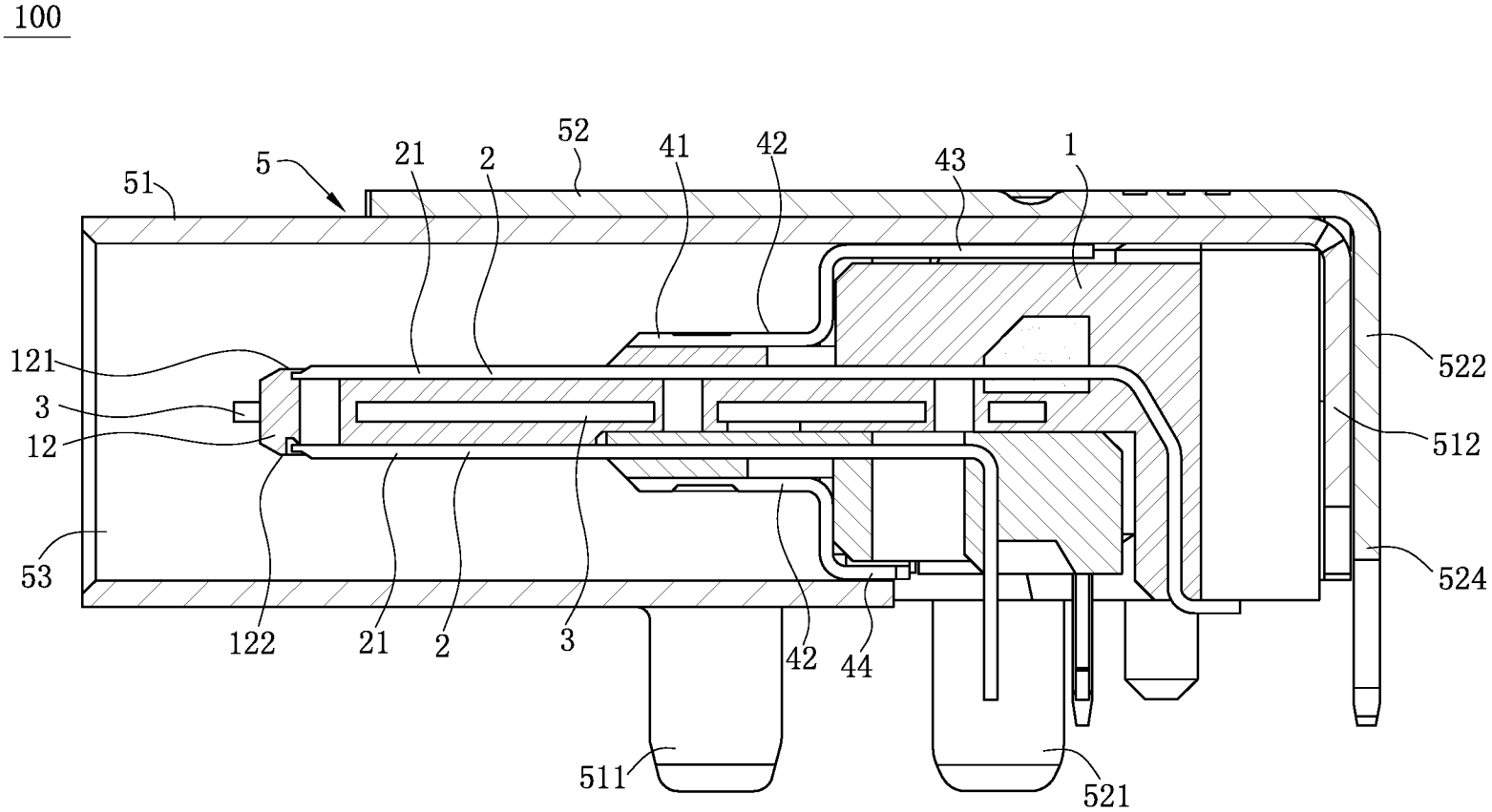
FIG. 6 is a sectional view of the electrical connector according to one embodiment of the present invention.
Figure 7:
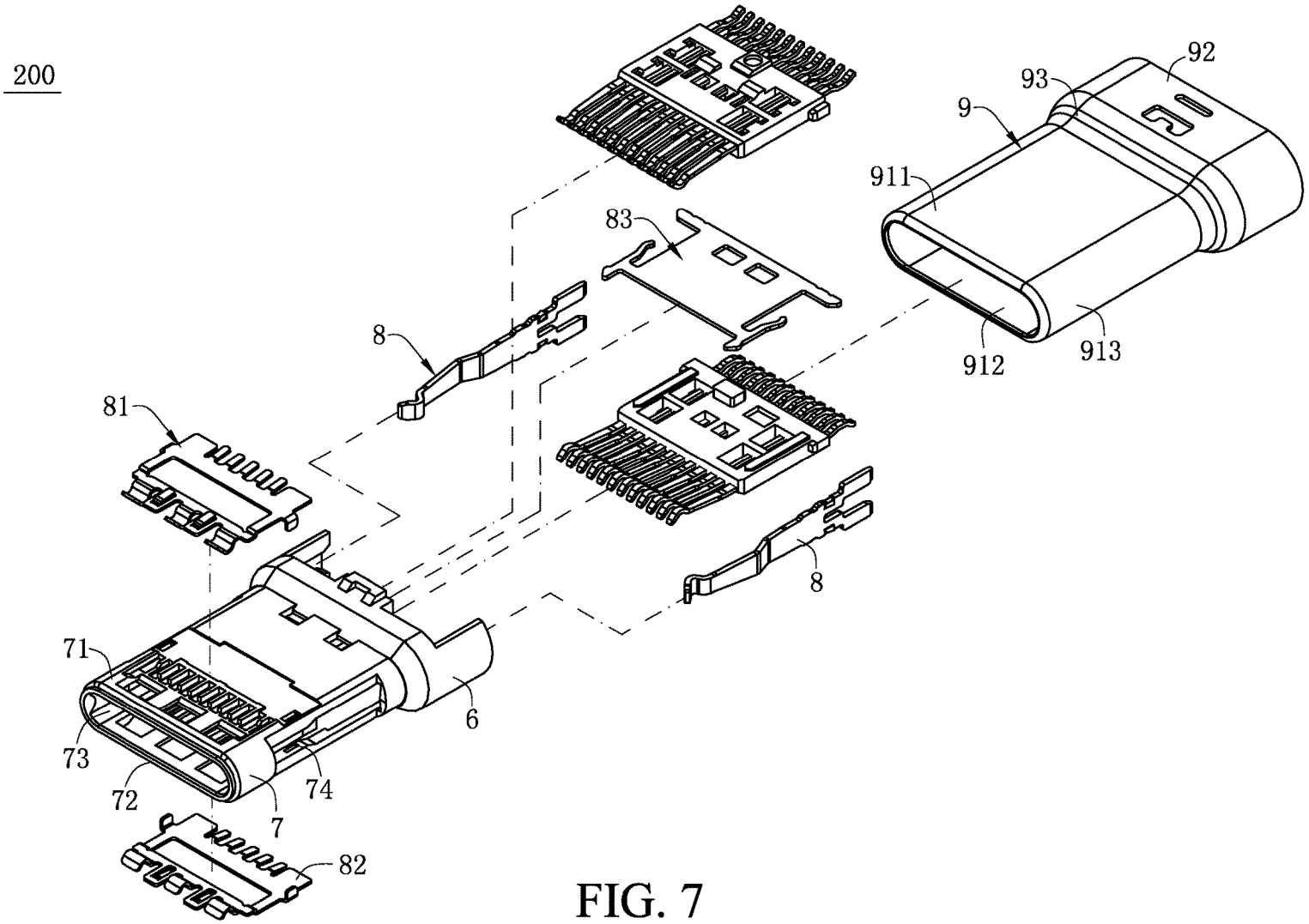
FIG. 7 is a three-dimensional exploded view of a mating connector according to one embodiment of the present invention.
Figure 8:
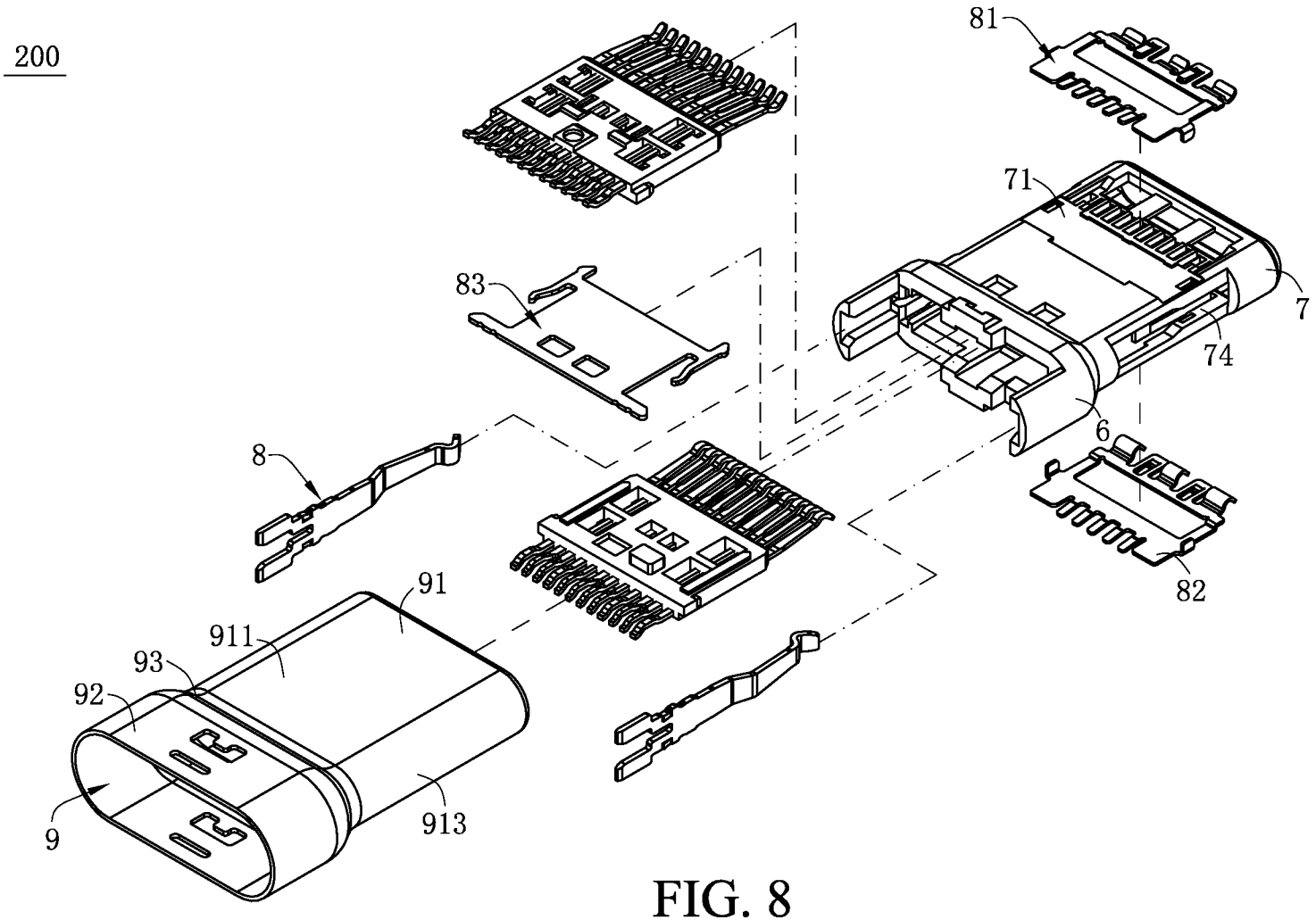
FIG. 8 is a three-dimensional exploded view of the mating connector viewed from another viewing angle according to one embodiment of the present invention.
Figure 9:
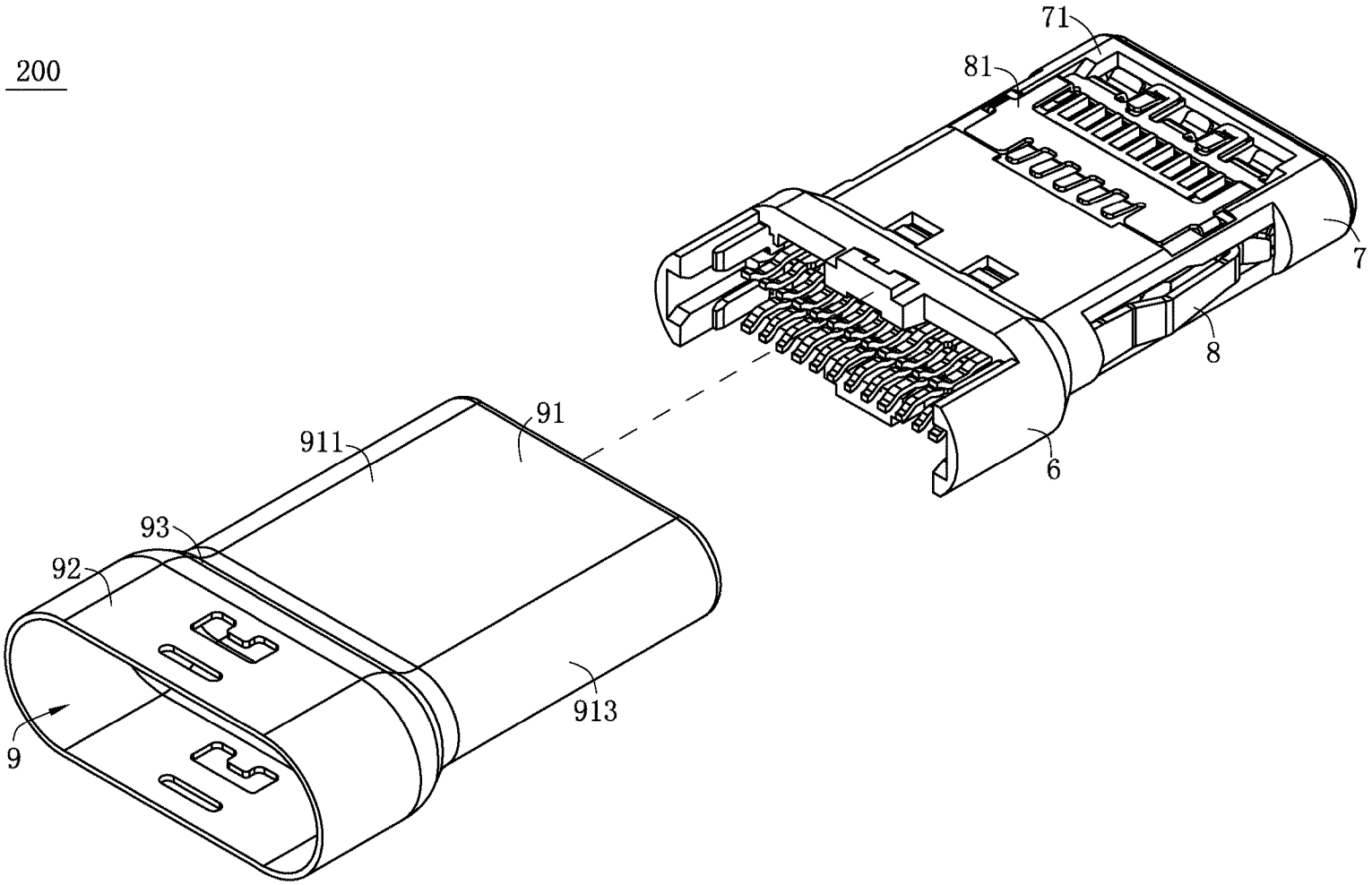
FIG. 9 is a partial three-dimensional exploded view of the mating connector according to one embodiment of the present invention.
Figure 10:
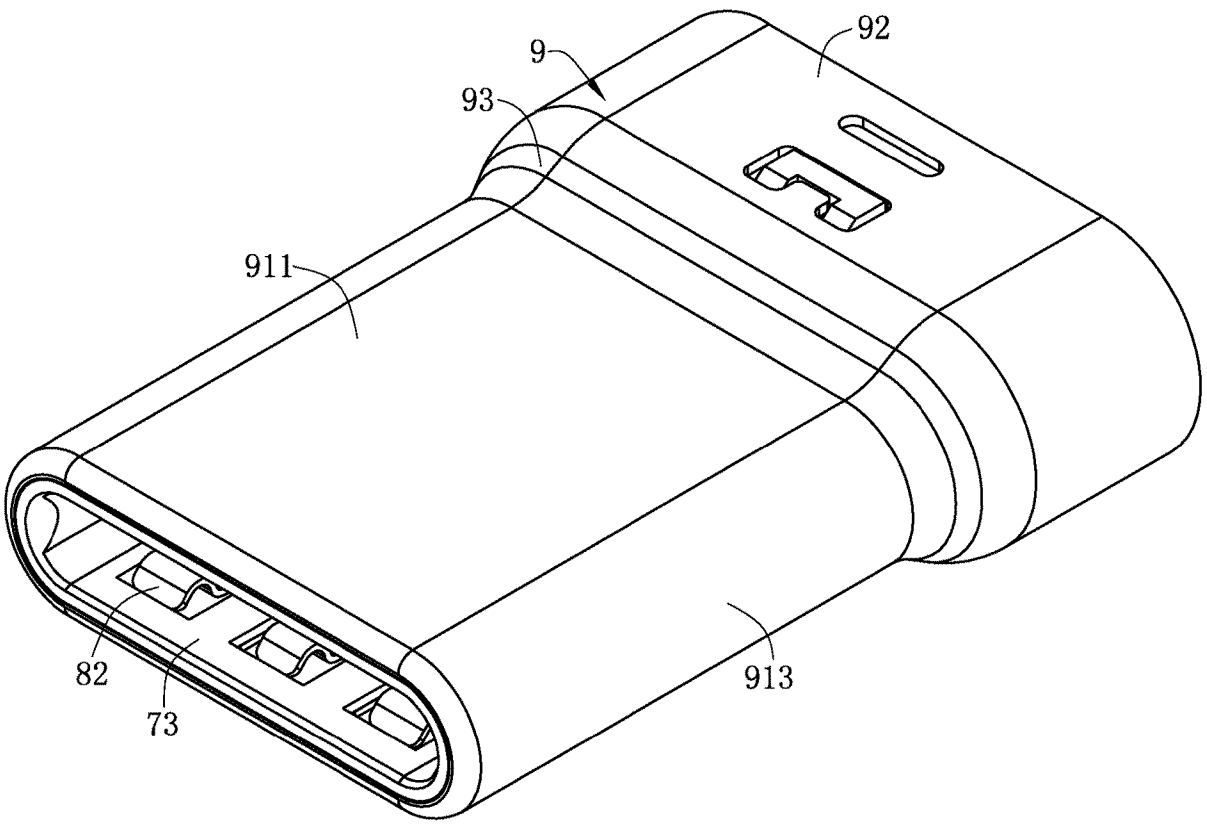
FIG. 10 is a three-dimensional assembly drawing of the mating connector according to one embodiment of the present invention.
Figure 11:
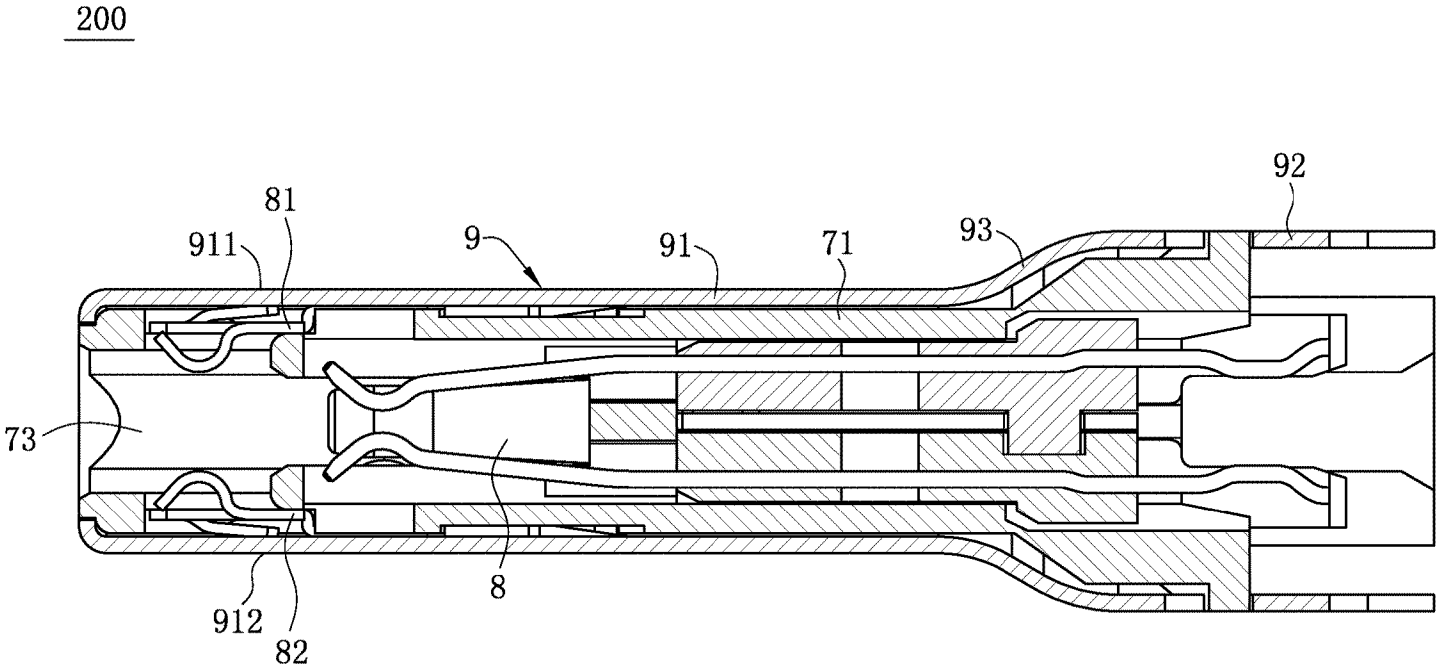
FIG. 11 is a sectional view of the mating connector according to one embodiment of the present invention.
Figure 12:
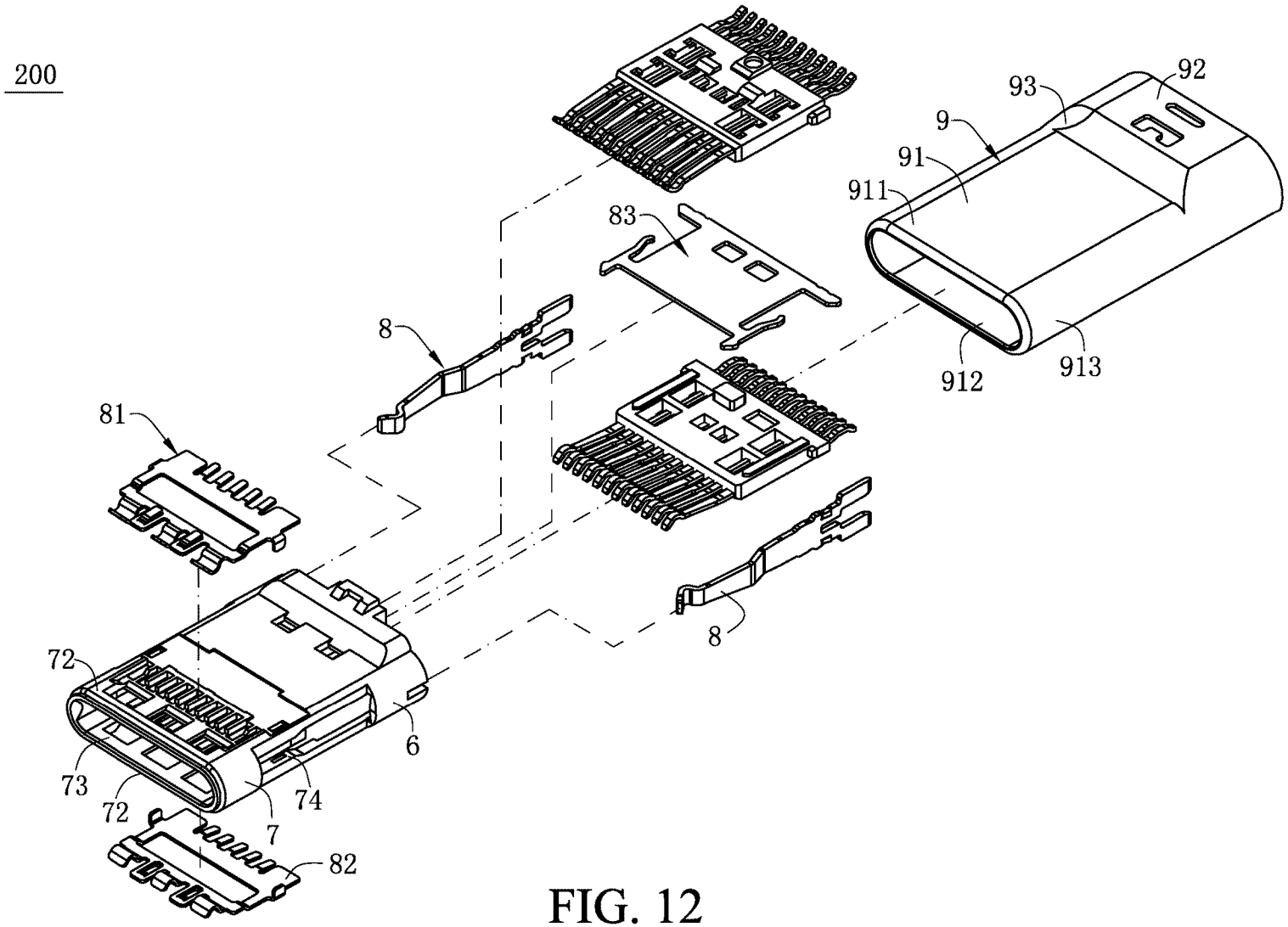
FIG. 12 is a three-dimensional exploded view of a mating connector according to a second embodiment of the present invention.
Figure 13:
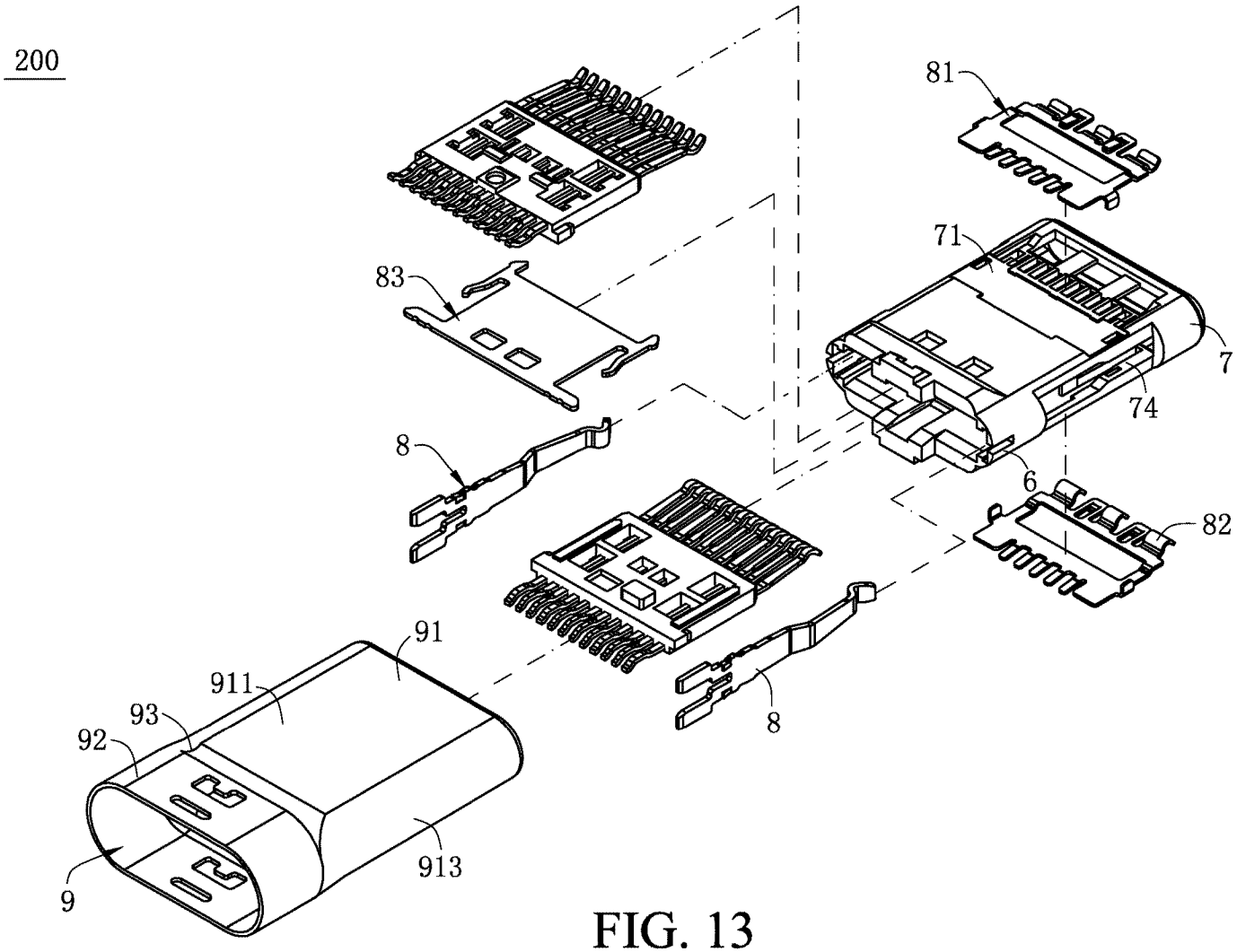
FIG. 13 is a three-dimensional exploded view of the mating connector viewed from another viewing angle according to the second embodiment of the present invention.
Figure 14:
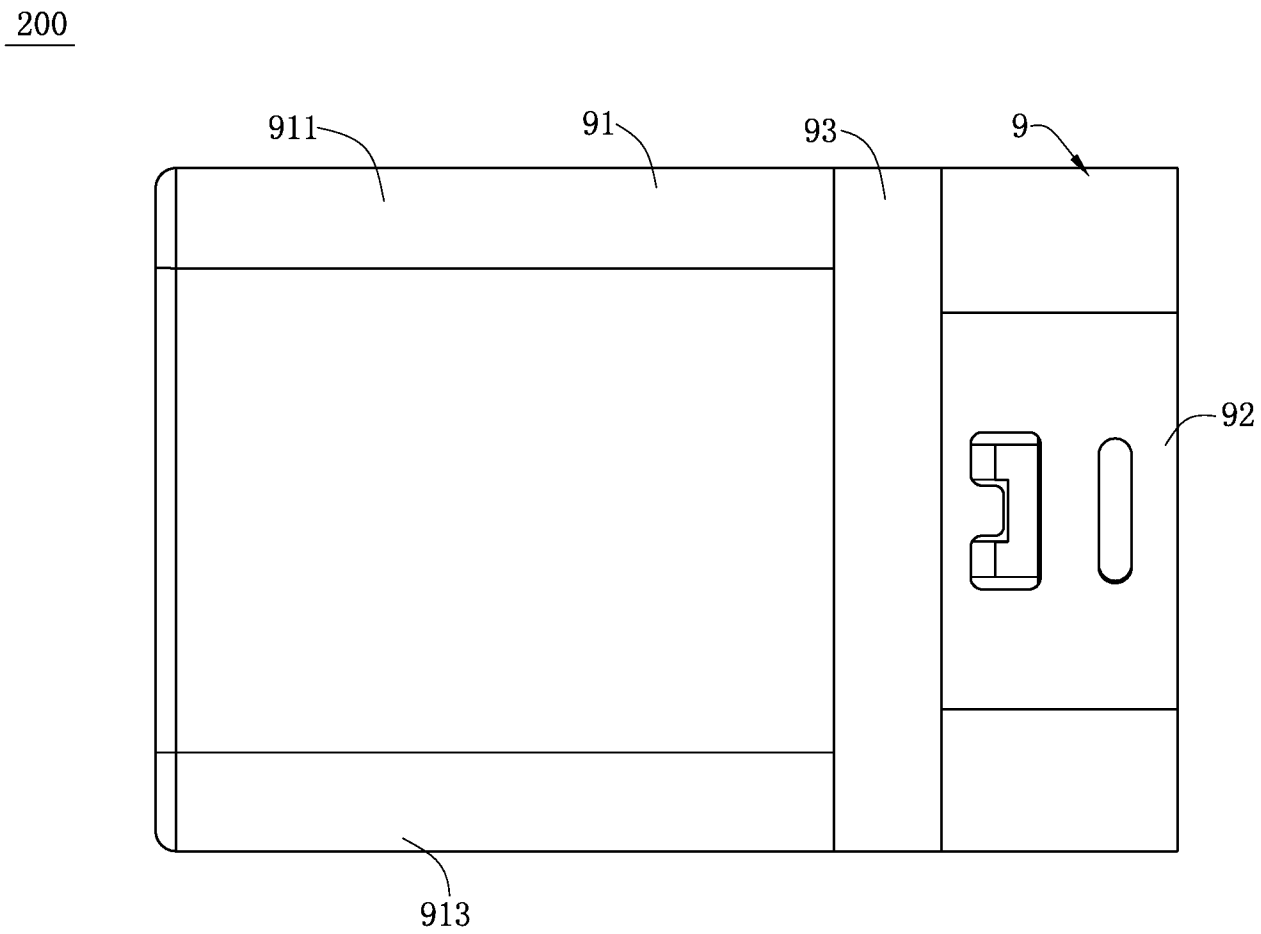
FIG. 14 is a top view of a metal cover of the mating connector according to the second embodiment of the present invention.
Figure 15:
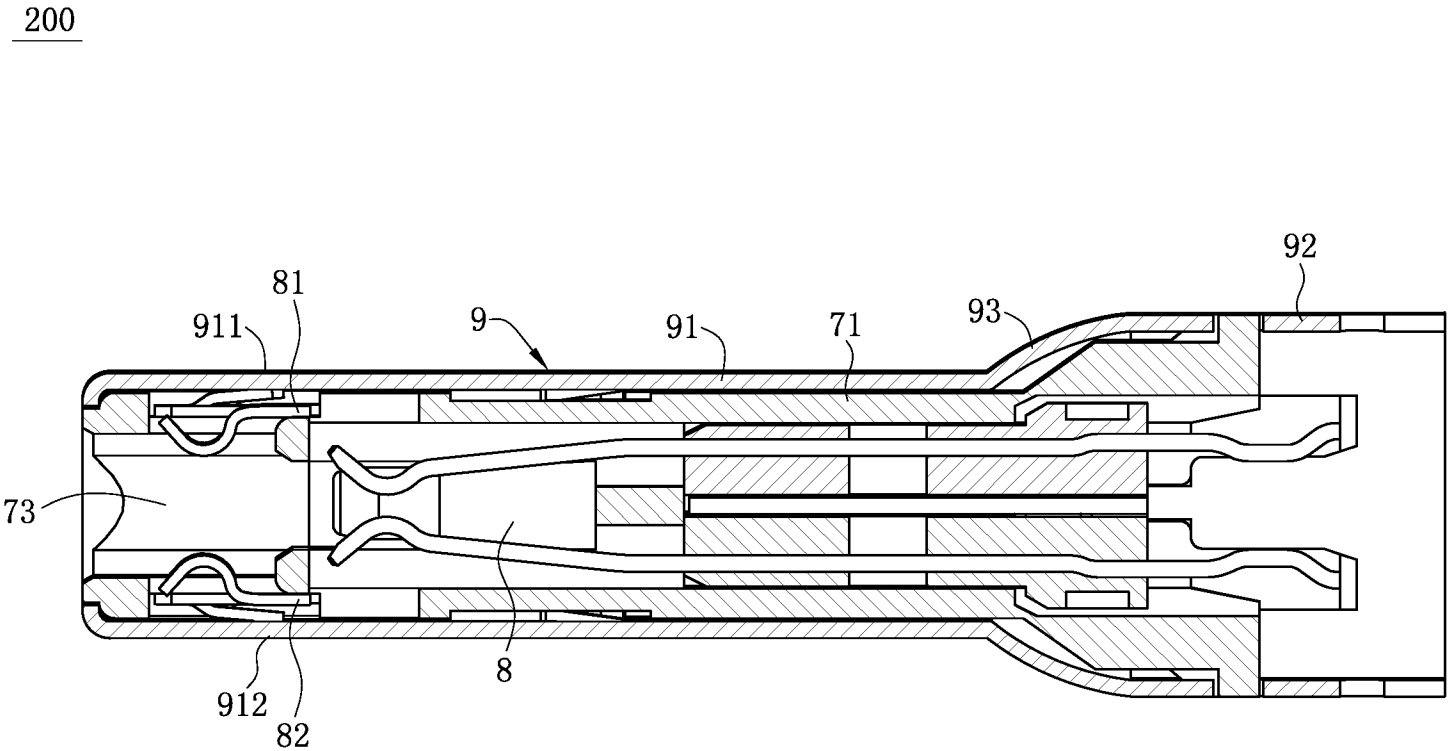
FIG. 15 is a sectional view of the mating connector according to the second embodiment of the present invention.

As shown in FIG. 5 and FIG. 6, the wrapping casing 51 has a first rear wall 512, and the shielding casing 52 has a second rear wall 522. The first rear wall 512 has a first middle portion 513 and first sheltering portions 514 located at two sides of the first middle portion 513. The second rear wall 522 has a second middle portion 523 and a second sheltering portion 524 connected to a lower part of the second middle portion 523. The first middle portion 513 and the second middle portion 523 are approximately superposed front and back. A place of the second rear wall 522 corresponding to the first sheltering portion 514 forms a notch 525, and the second sheltering portion 524 exceeds the first middle portion 513 downward. The electrical connector 100 can be conveniently welded, and a good shielding effect can be ensured, so as to prevent signals from being leaked from the behind, and save materials. Multiple fixing pins (not labeled) extend downward from the second rear wall 522, and are used for cooperating with the first soldering pins 511 and the second soldering pins 521 to stably position the electrical connector 100 onto the circuit board 300.

Figure 48:
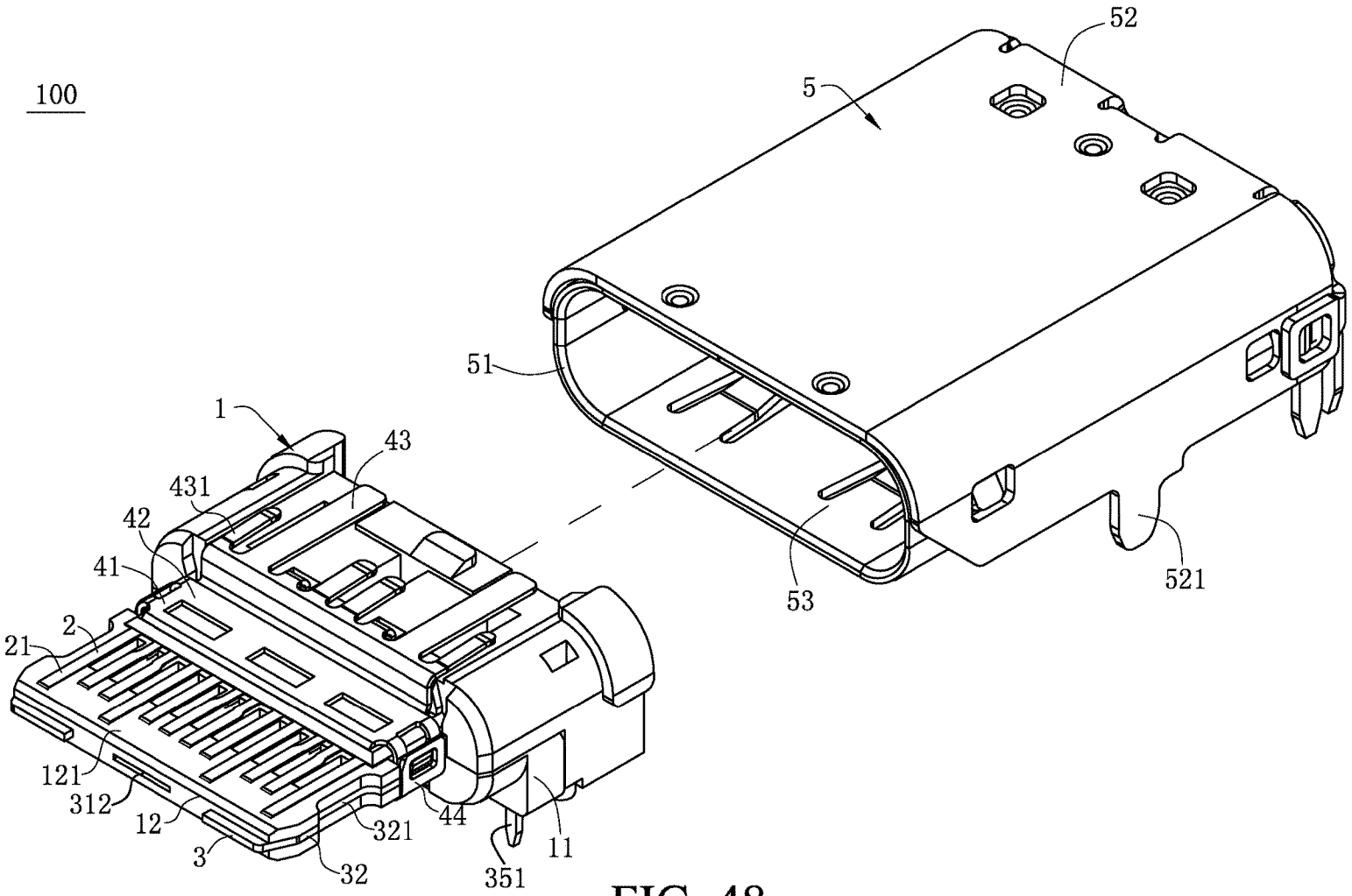
FIG. 48 is a partial three-dimensional exploded view of the electrical connector according to the thirteenth embodiment of the present invention.

As shown in FIG. 48, structures bending forward are further disposed at two sides of the second rear wall 522, to further snap-fit two side walls of the shielding casing 52, so that the shielding casing 52 does not easily loosen, and it may also ensure that the signals in the electrical connector 100 are not easily leaked from behind the rear side.

Figure 21:
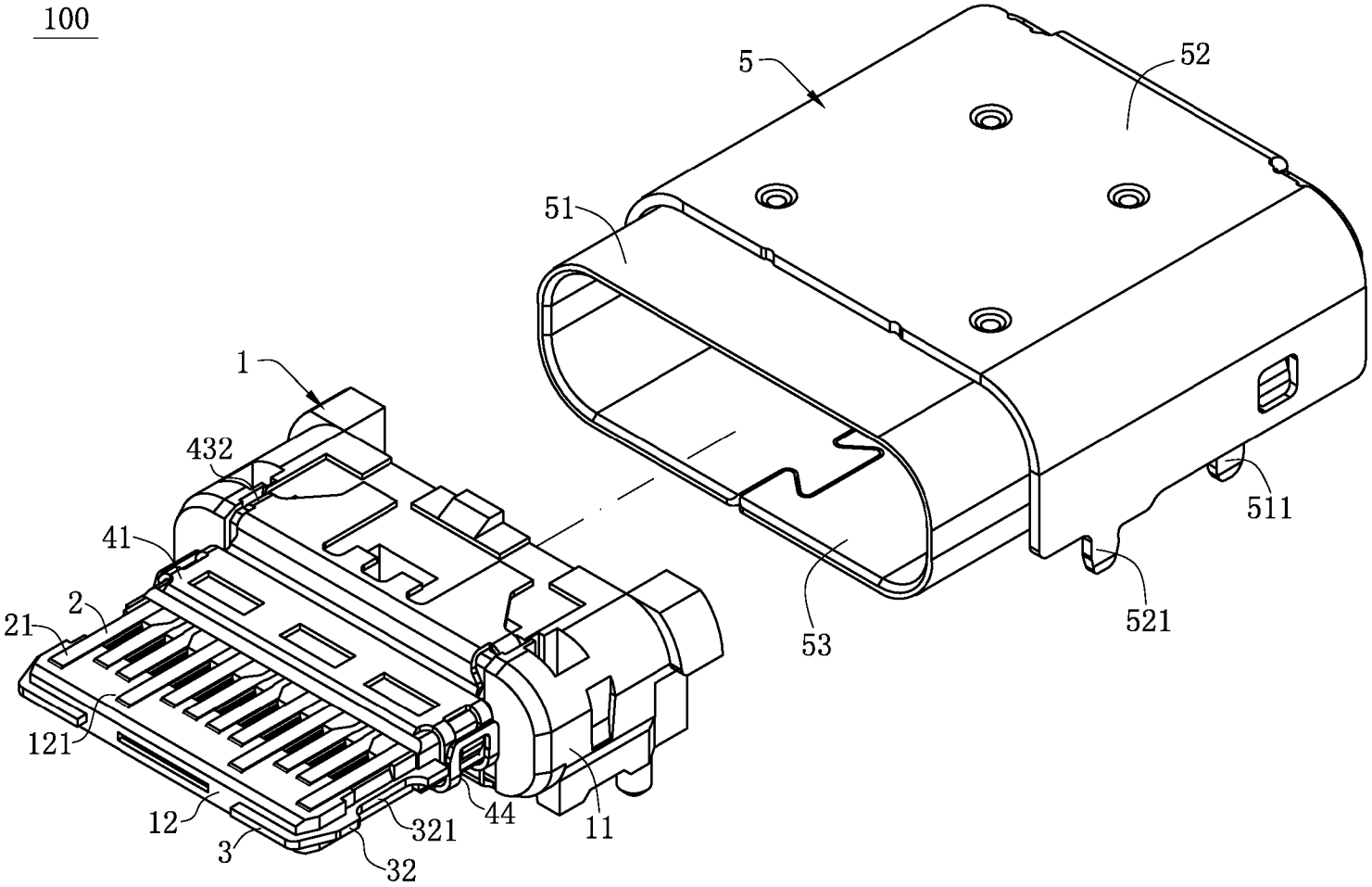
FIG. 21 is a partial three-dimensional exploded view of an electrical connector according to a fifth embodiment of the present invention.
Figure 22:
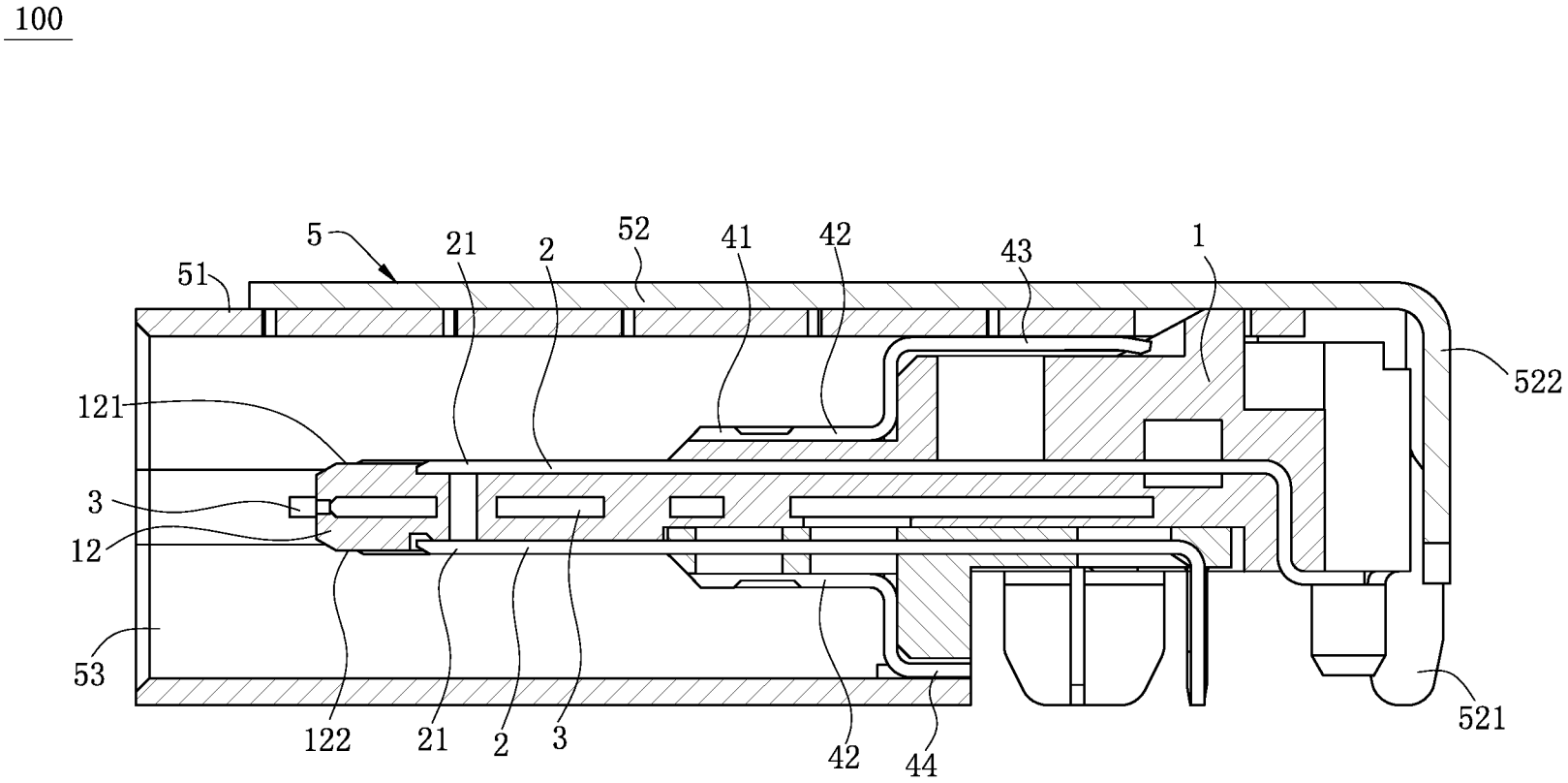
FIG. 22 is a sectional view of the electrical connector according to the fifth embodiment of the present invention.
Figure 23:
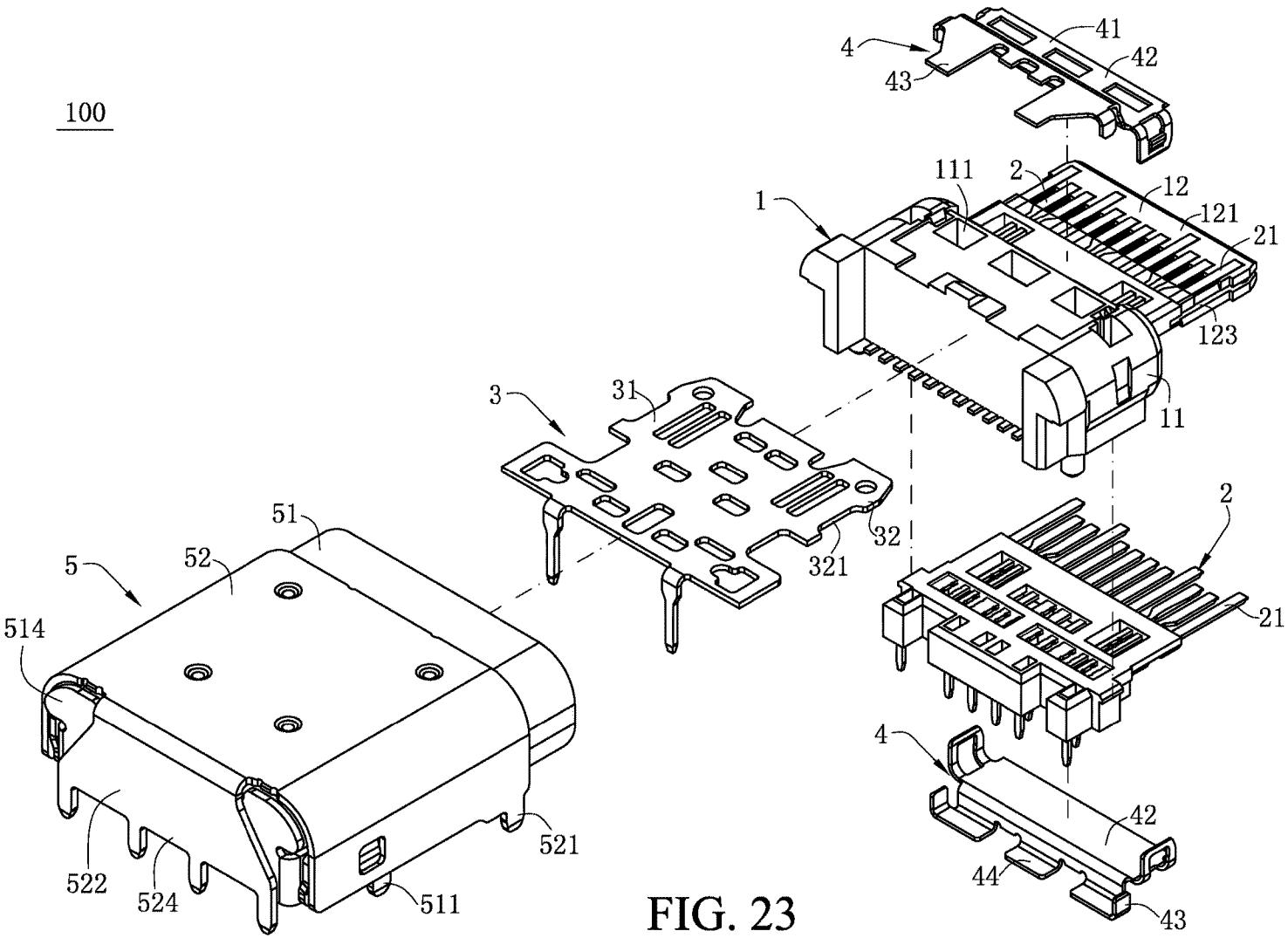
FIG. 23 is a three-dimensional exploded view of an electrical connector according to a sixth embodiment of the present invention.
Figure 24:
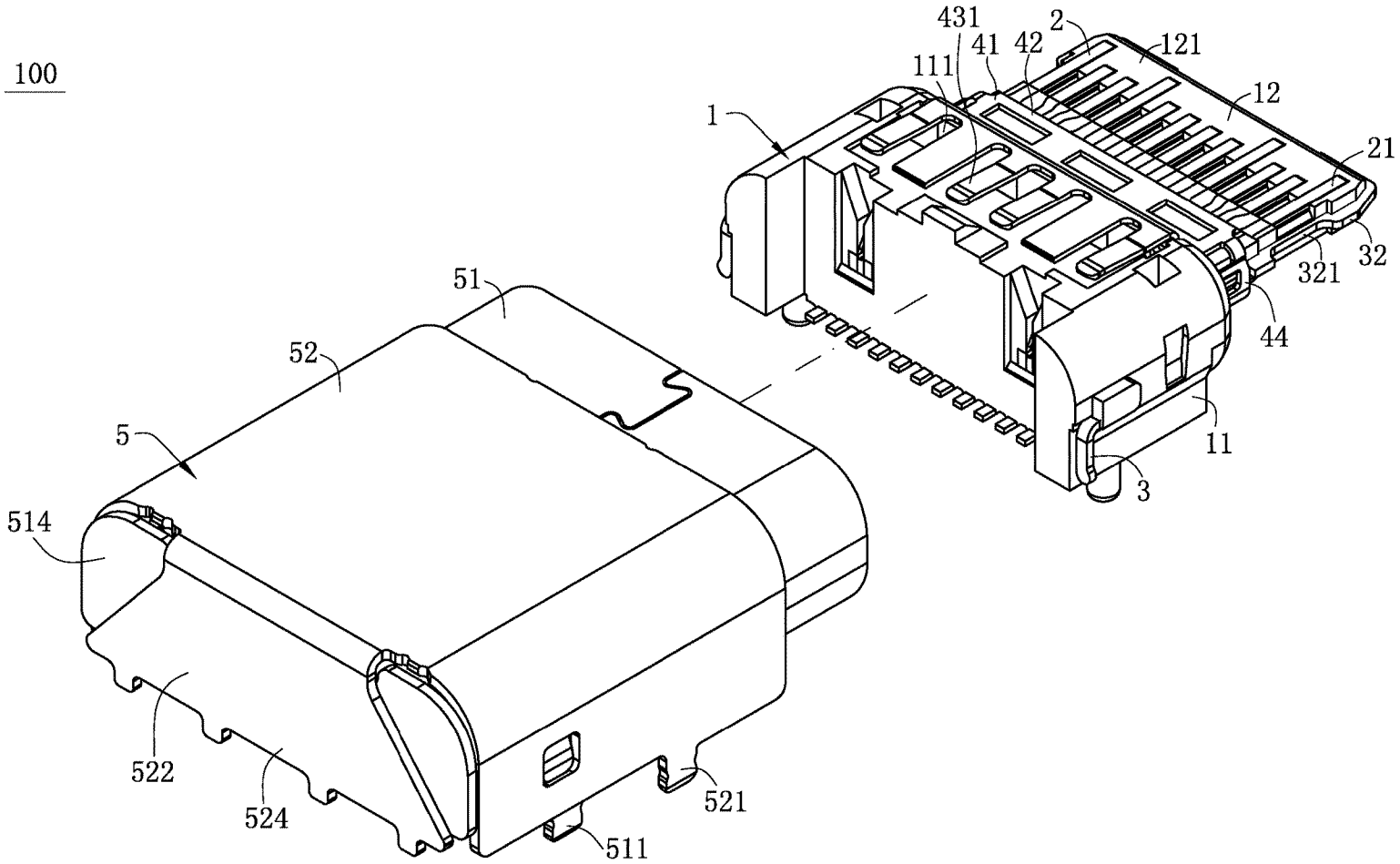
FIG. 24 is a partial three-dimensional exploded view of an electrical connector according to a seventh embodiment of the present invention.
Figure 25:
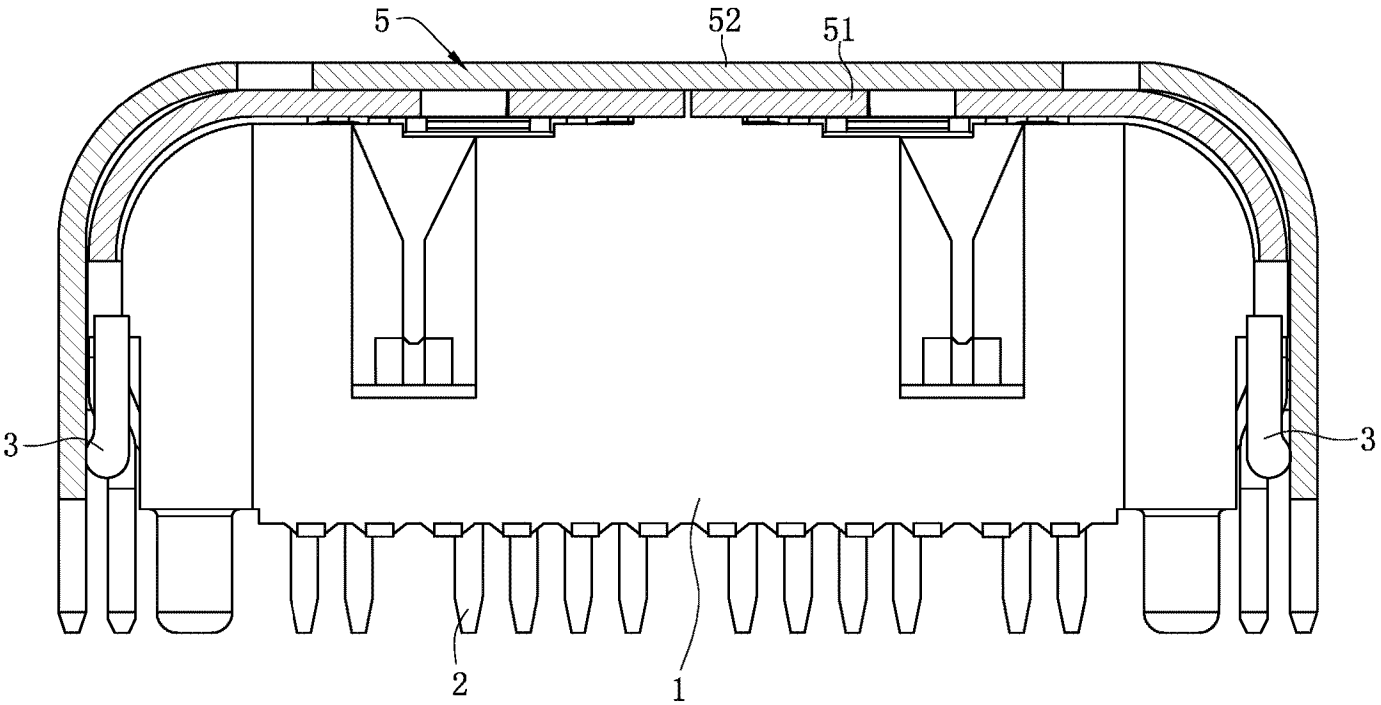
FIG. 25 is a sectional view of the electrical connector according to the seventh embodiment of the present invention.
Figure 26:
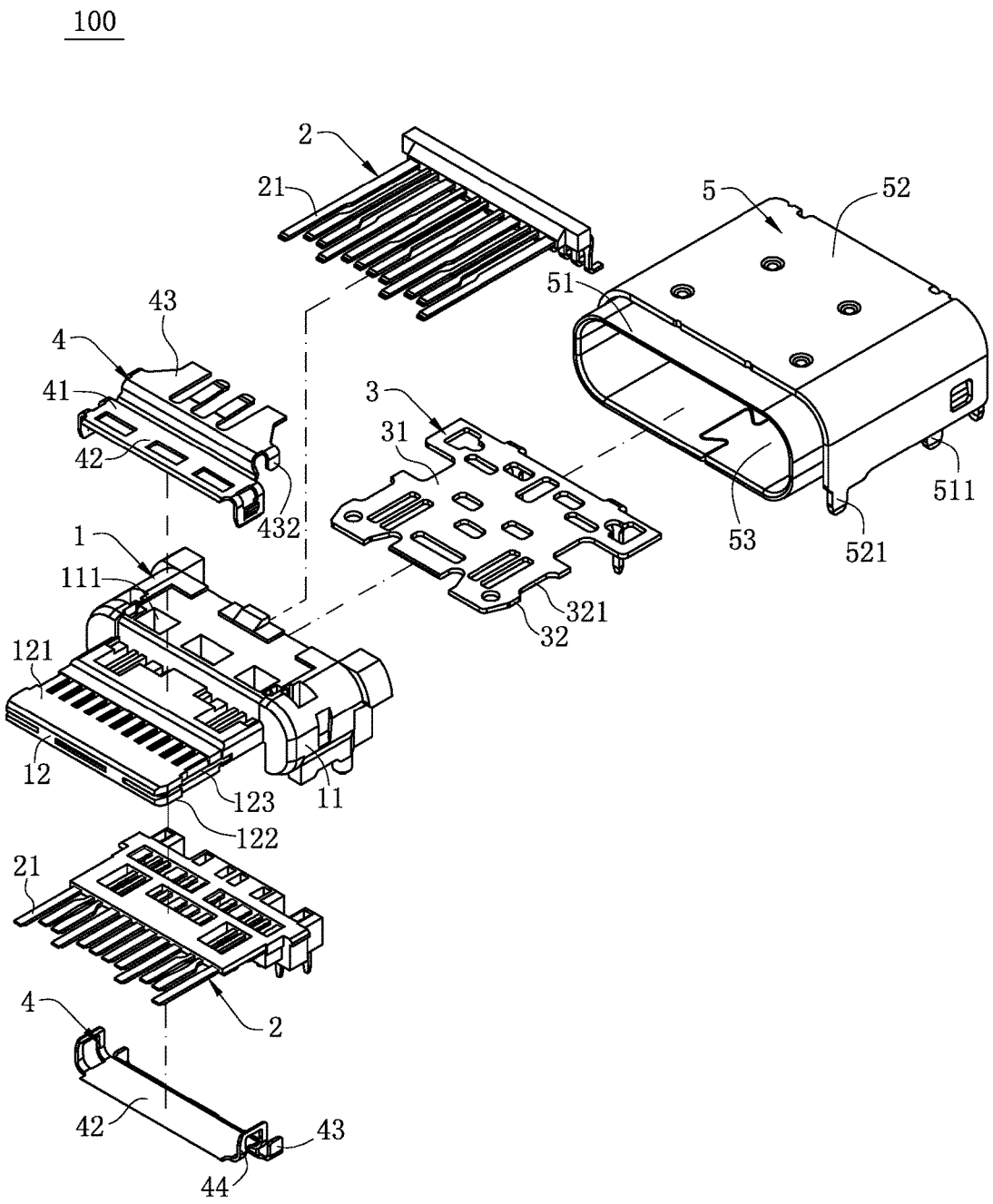
FIG. 26 is a three-dimensional exploded view of an electrical connector according to an eighth embodiment of the present invention.
Figure 27:
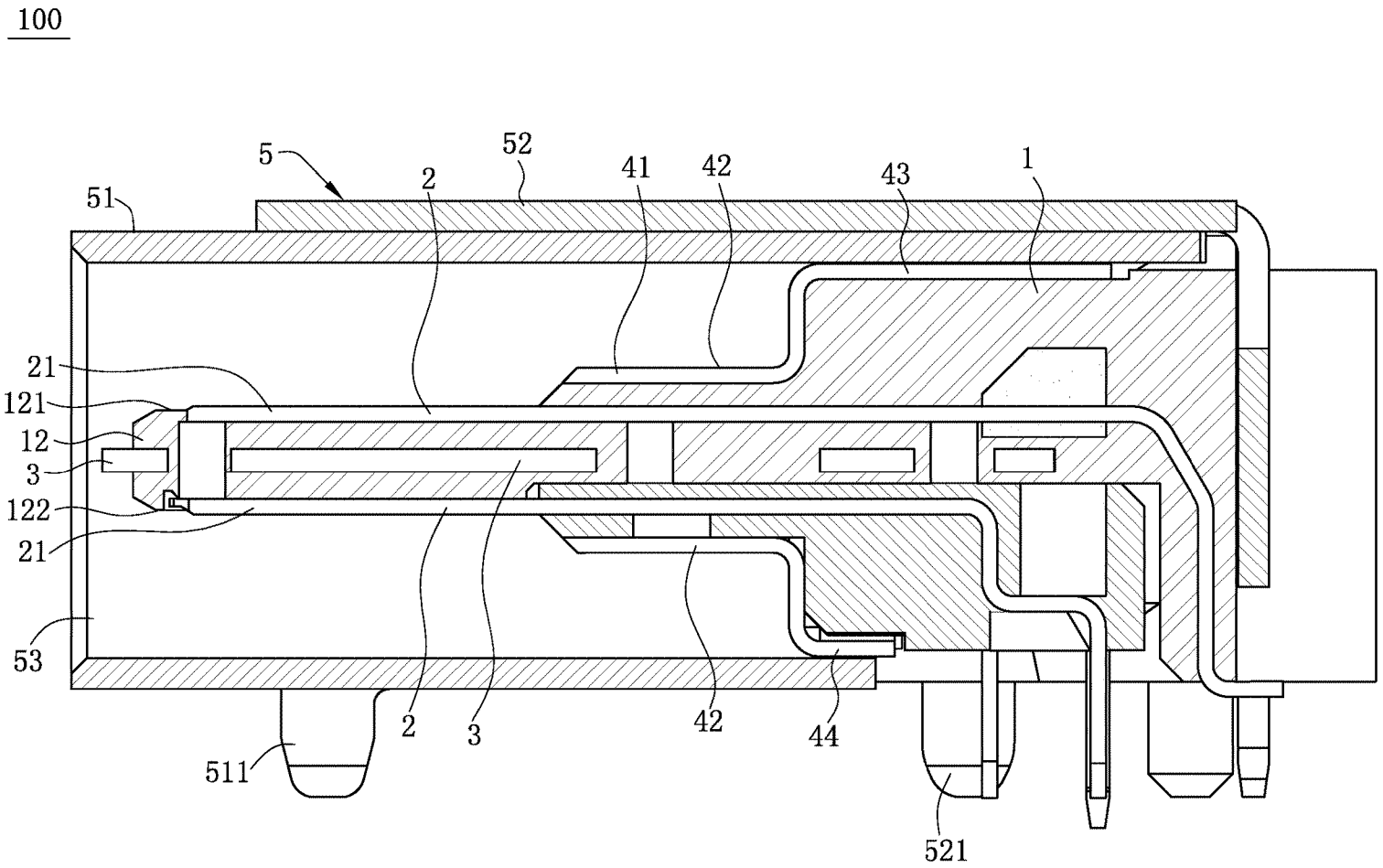
FIG. 27 is a sectional view of the electrical connector according to the eighth embodiment of the present invention.
Figure 28:
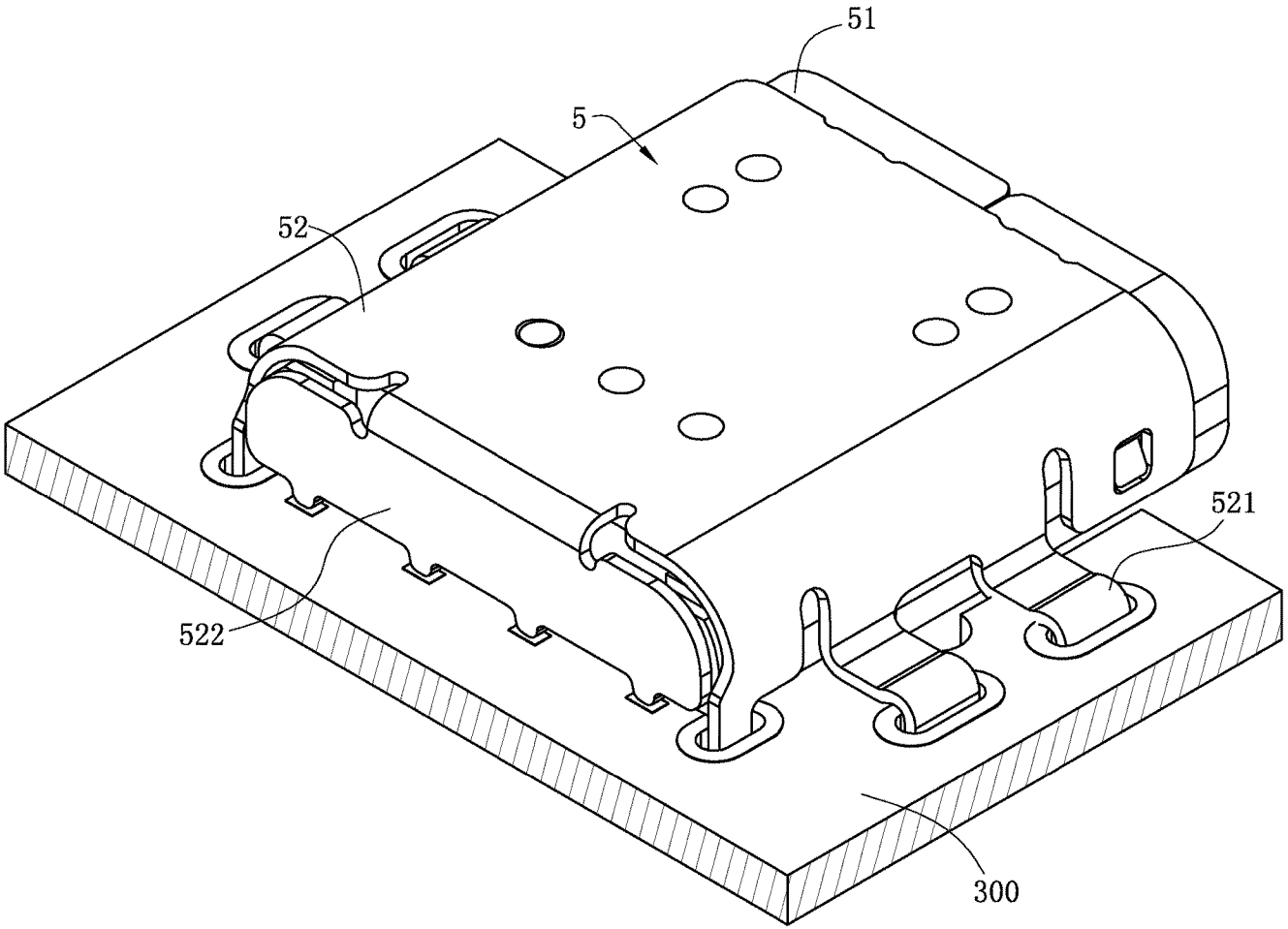
FIG. 28 is a three-dimensional assembly view of an electrical connector mounted on a circuit board according to a ninth embodiment of the present invention.
Figure 29:
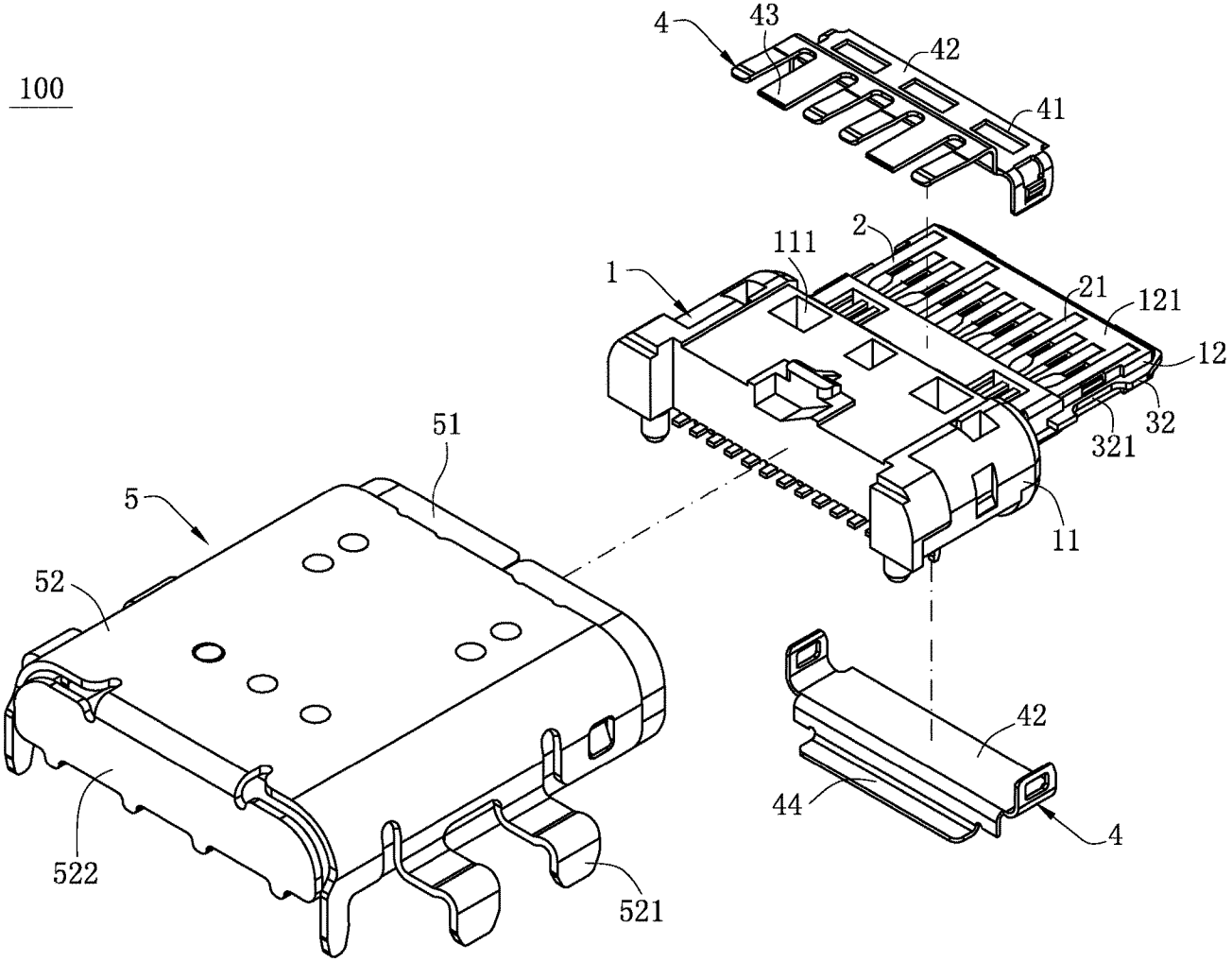
FIG. 29 is a three-dimensional exploded view of the electrical connector according to the ninth embodiment of the present invention.
Figure 30:
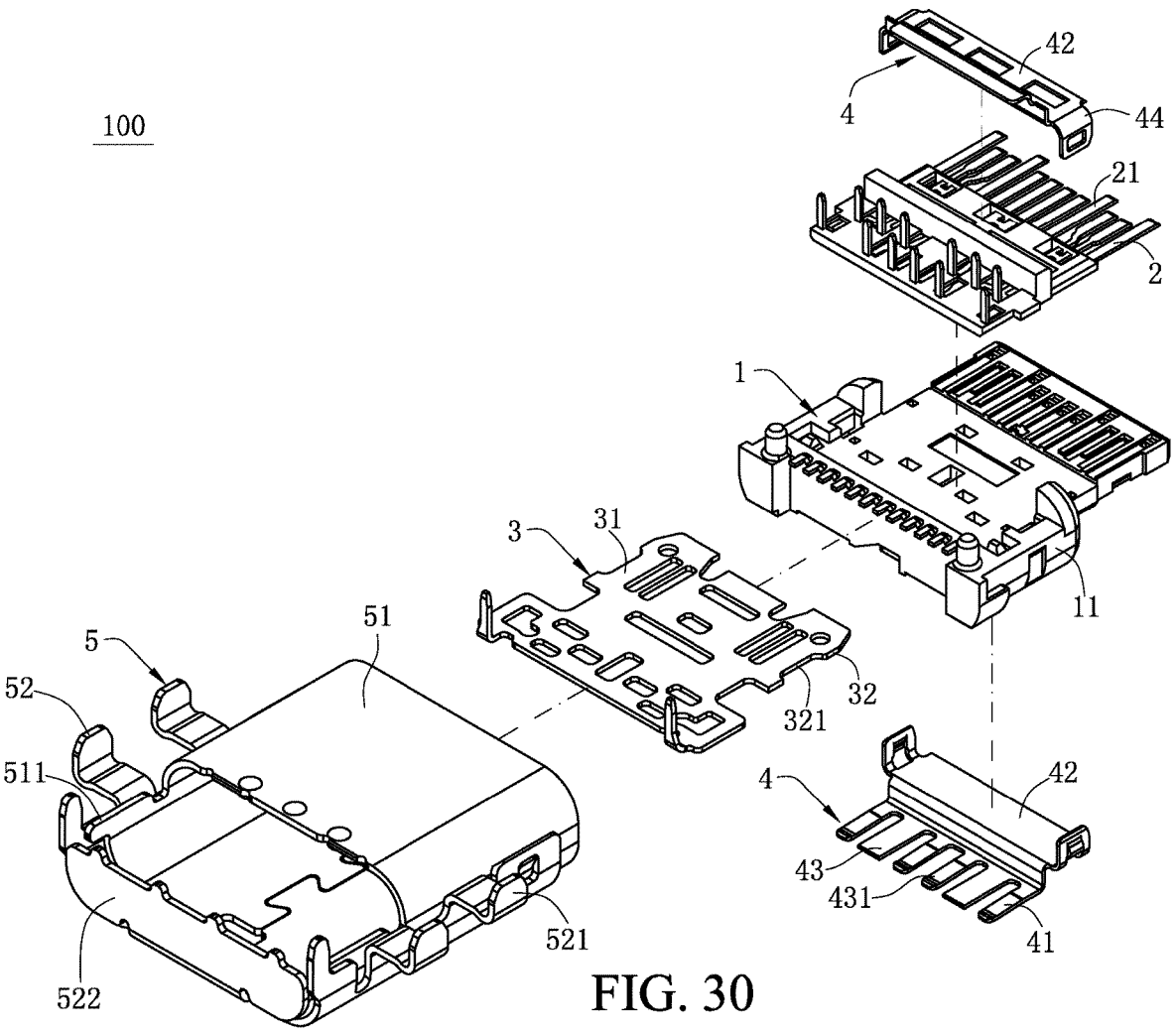
FIG. 30 is a three-dimensional exploded view of the electrical connector viewed from another viewing angle according to the ninth embodiment of the present invention.

As shown in FIG. 21 and FIG. 22, the electrical connector 100 is of a sinking board type, and the tongue 12 and the terminals 2 are all located above the circuit board 300.

Figure 31:
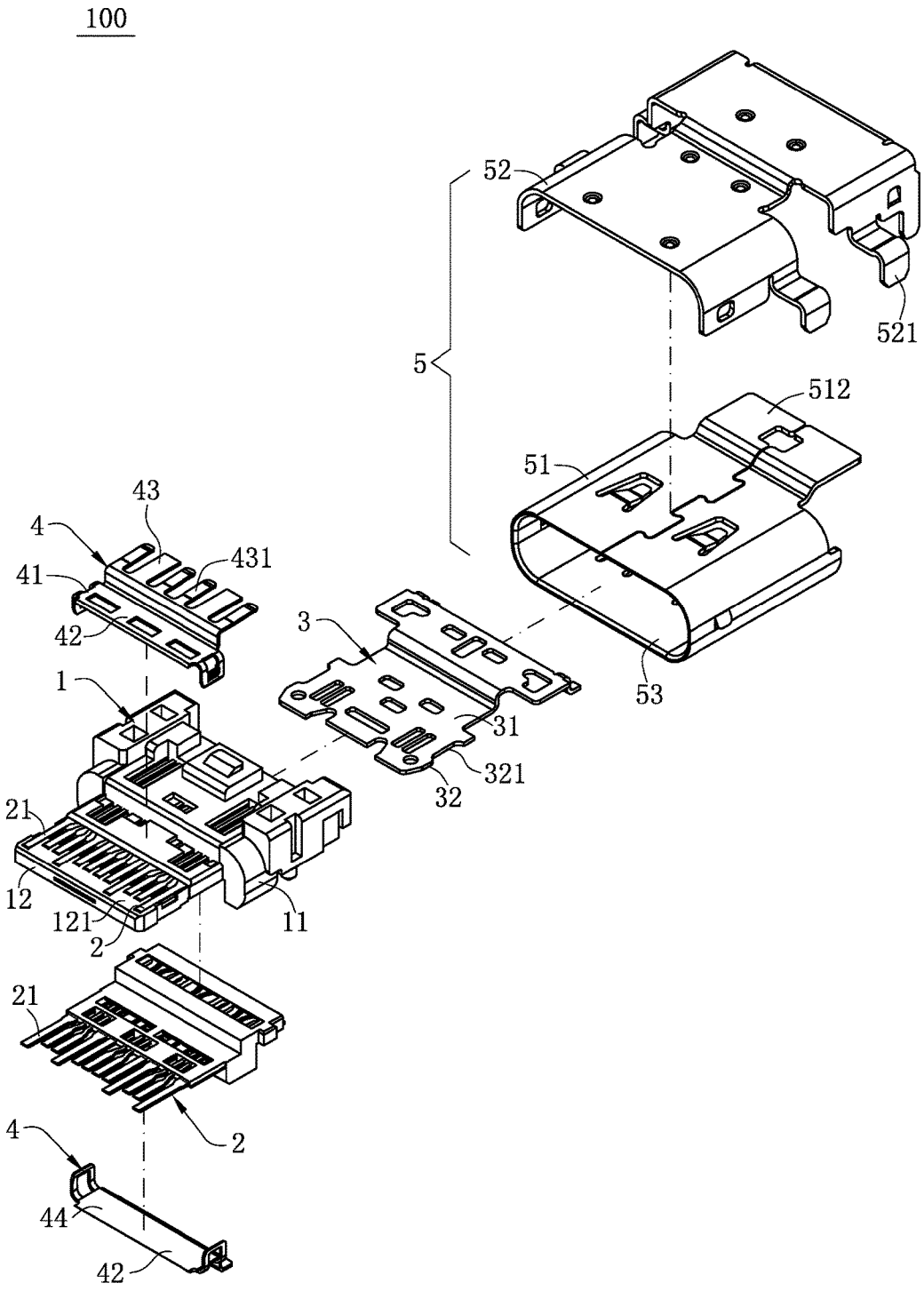
FIG. 31 is a three-dimensional exploded view of an electrical connector according to a tenth embodiment of the present invention.
Figure 32:
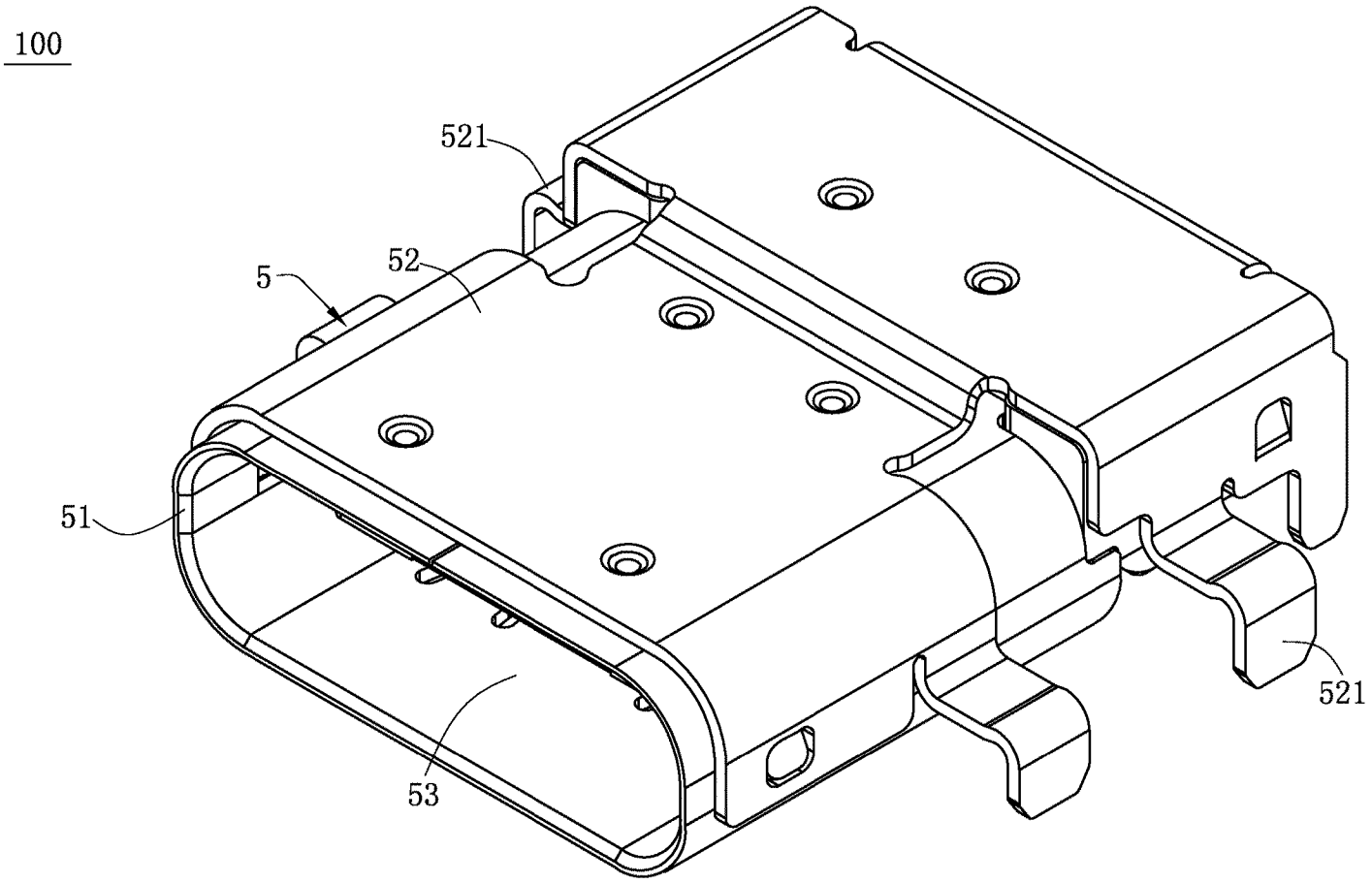
FIG. 32 is a three-dimensional assembly view of the electrical connector according to the tenth embodiment of the present invention.
Figure 33:
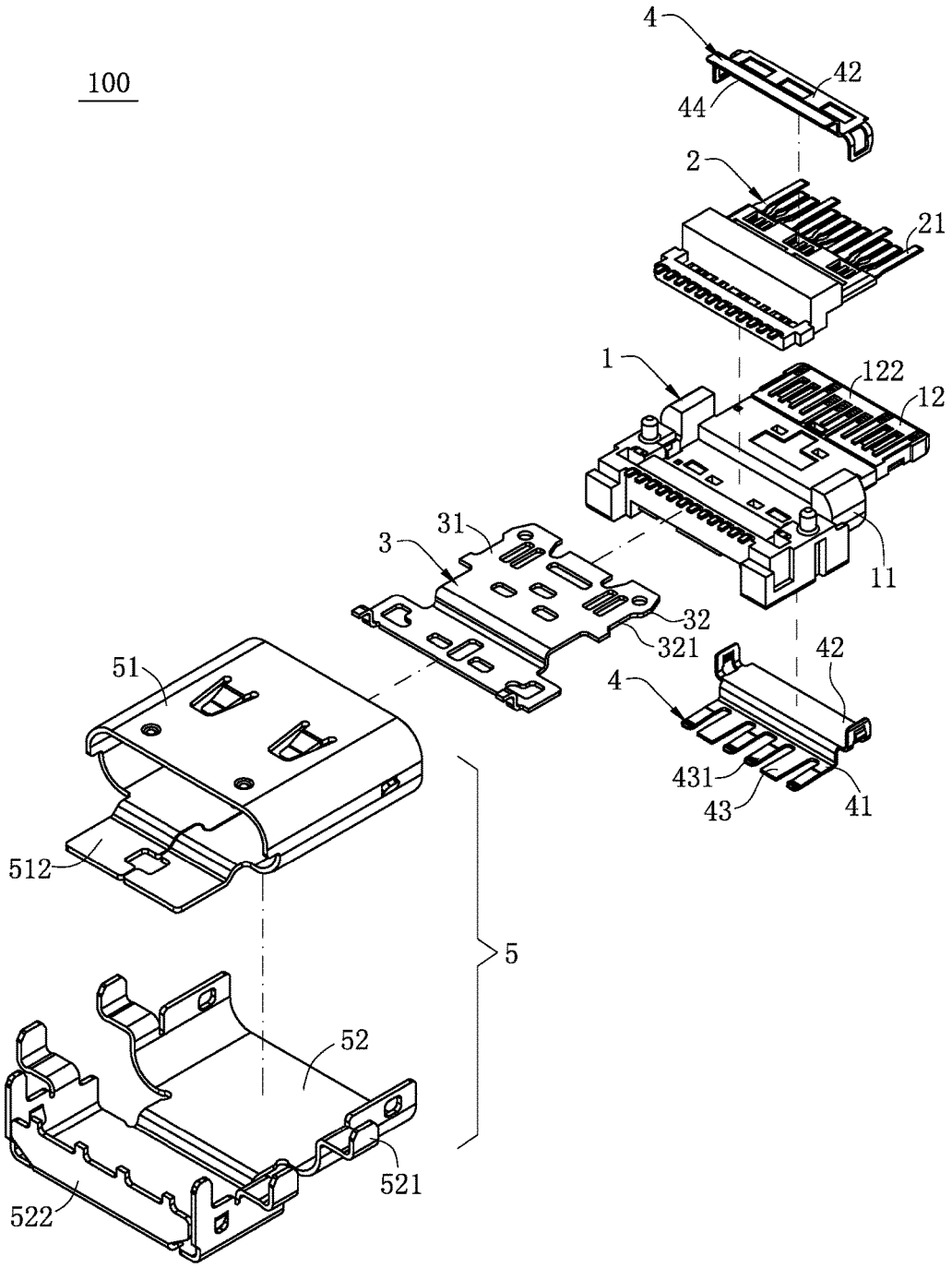
FIG. 33 is a three-dimensional exploded view of the electrical connector viewed from another viewing angle according to the tenth embodiment of the present invention.
Figure 34:
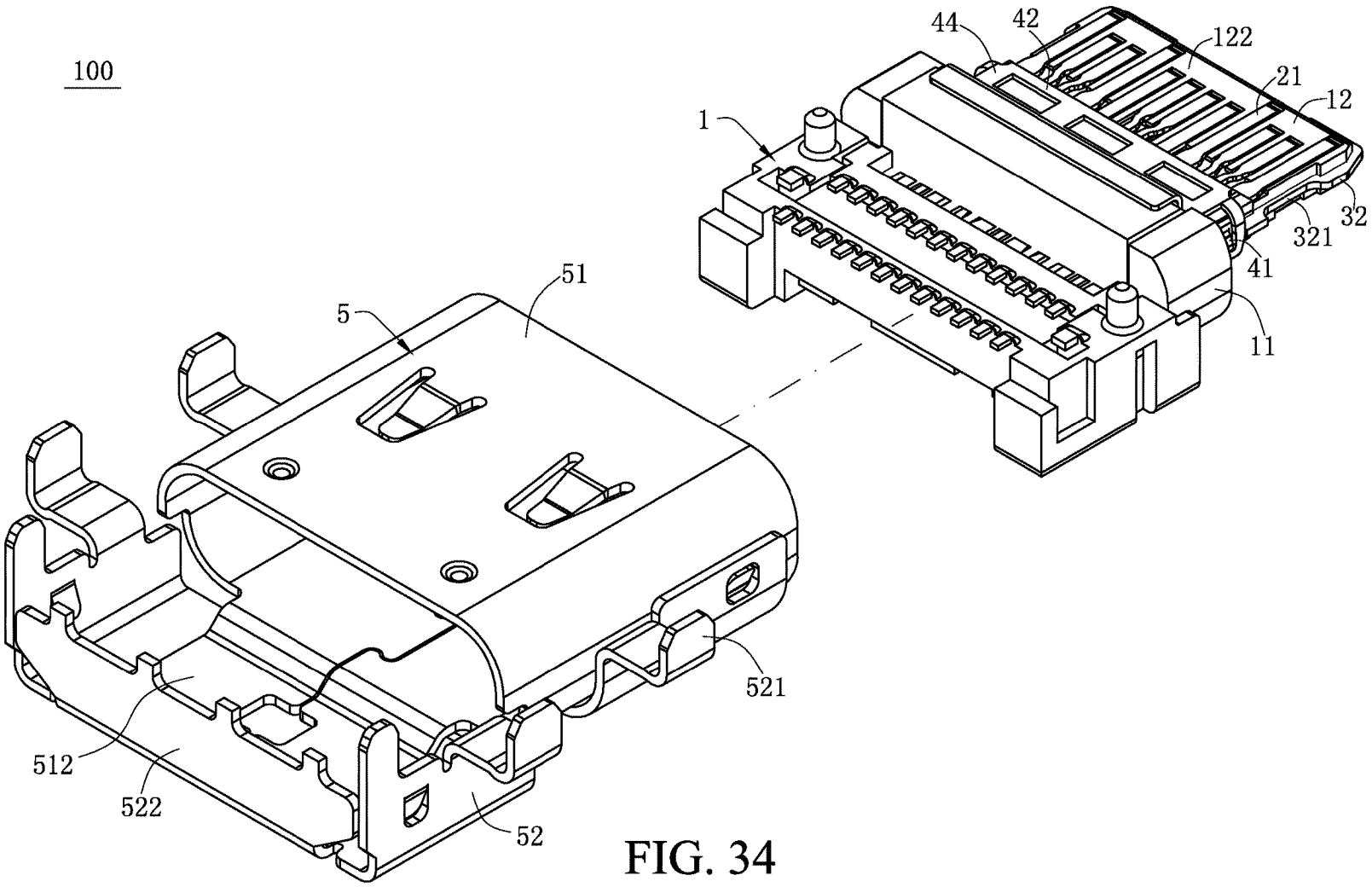
FIG. 34 is a partial three-dimensional exploded view of the electrical connector according to the tenth embodiment of the present invention.
Figure 35:
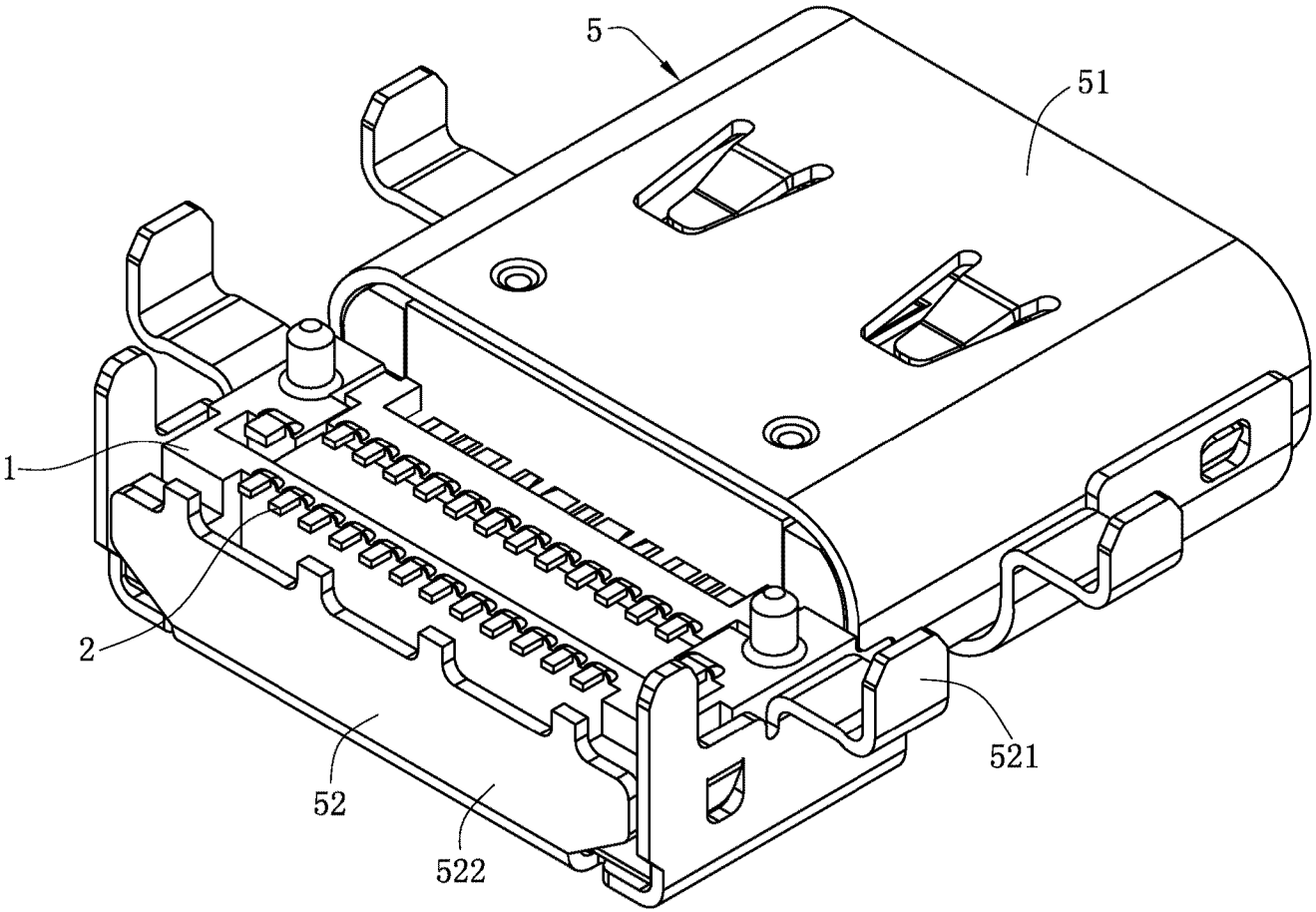
FIG. 35 is a three-dimensional assembly view of the electrical connector viewed from another viewing angle according to the tenth embodiment of the present invention.
Figure 36:
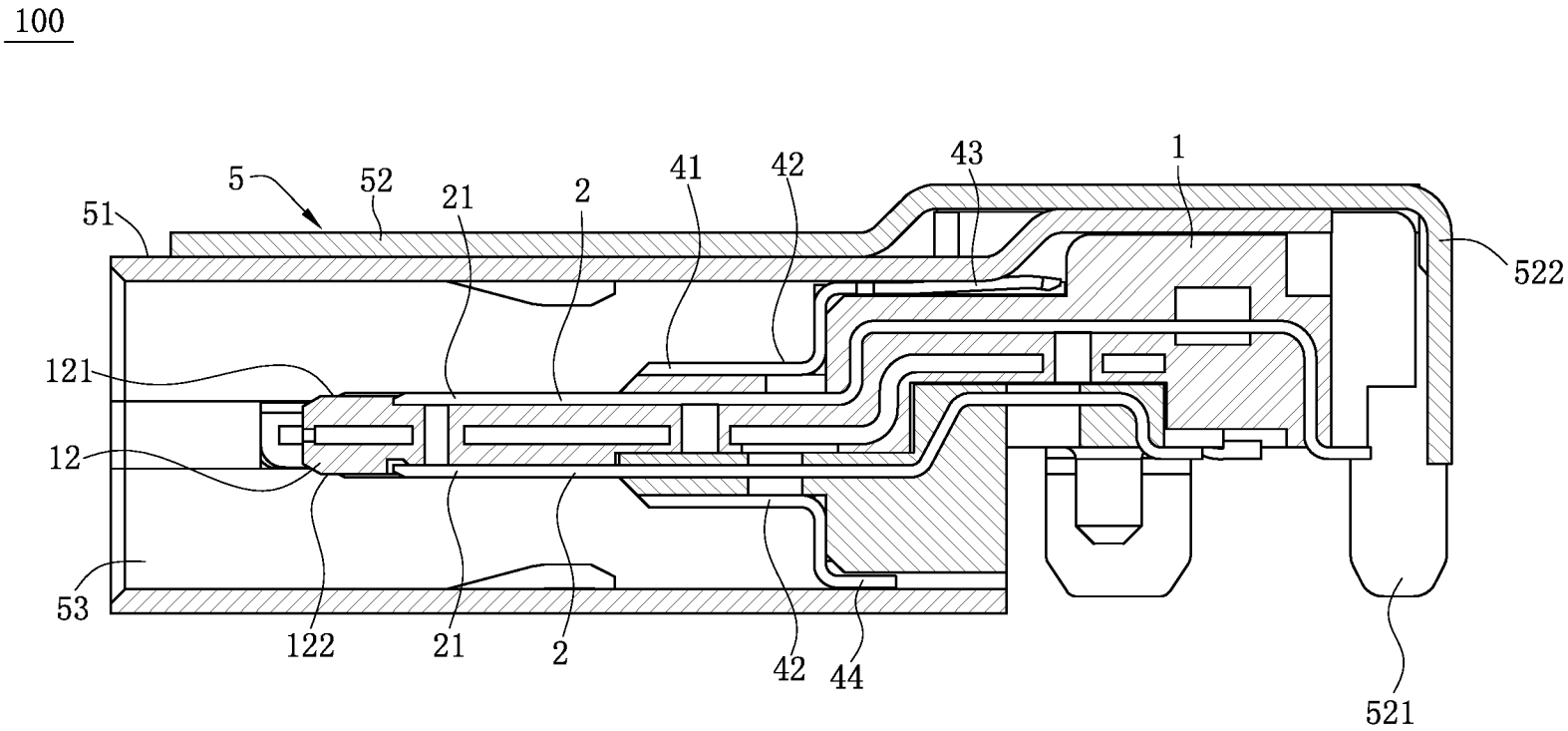
FIG. 36 is a sectional view of the electrical connector according to the tenth embodiment of the present invention.
Figure 37:
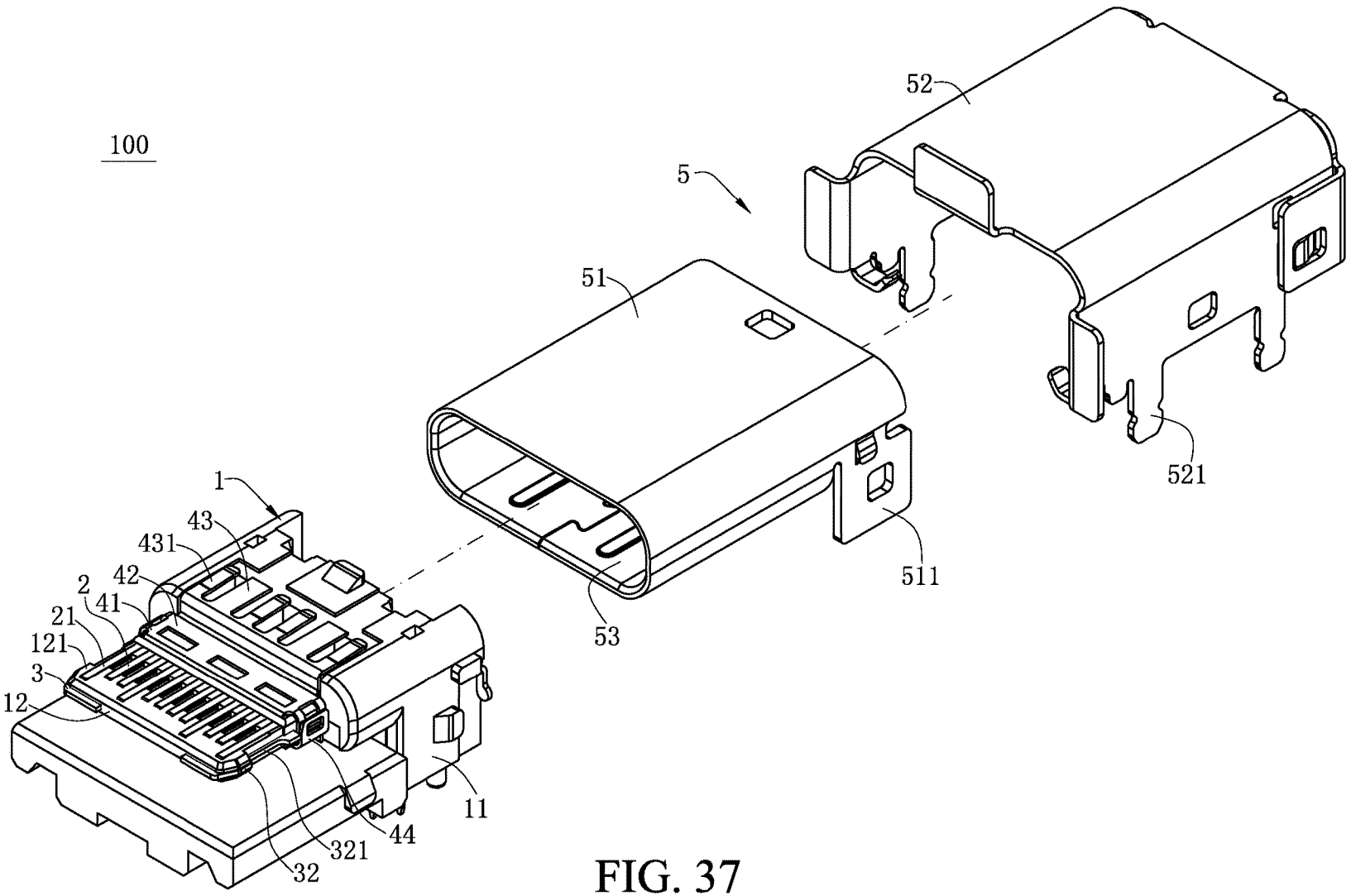
FIG. 37 is a partial three-dimensional exploded view of an electrical connector according to an eleventh embodiment of the present invention.
Figure 38:
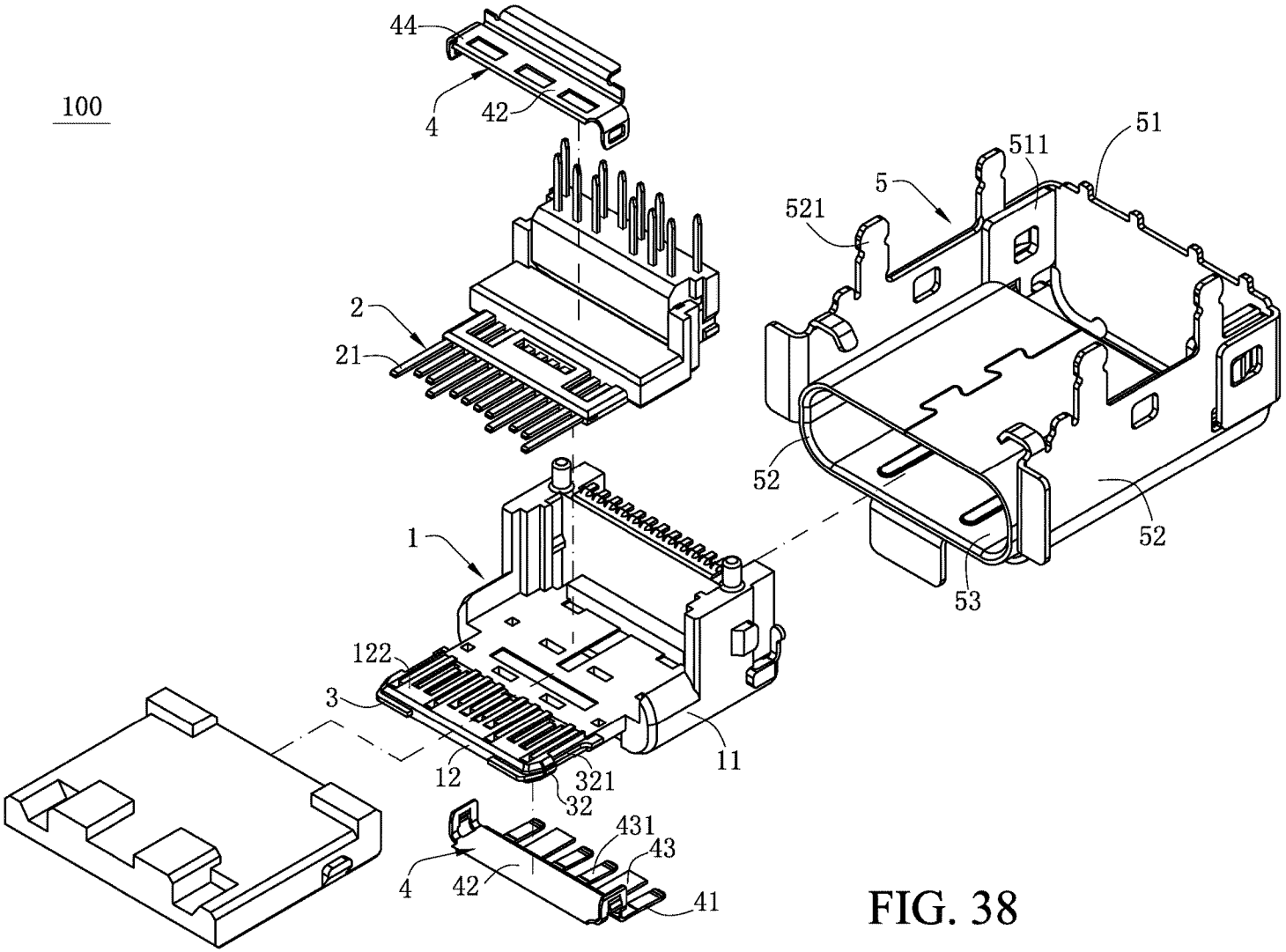
FIG. 38 is a three-dimensional exploded view of the electrical connector according to the eleventh embodiment of the present invention.
Figure 39:
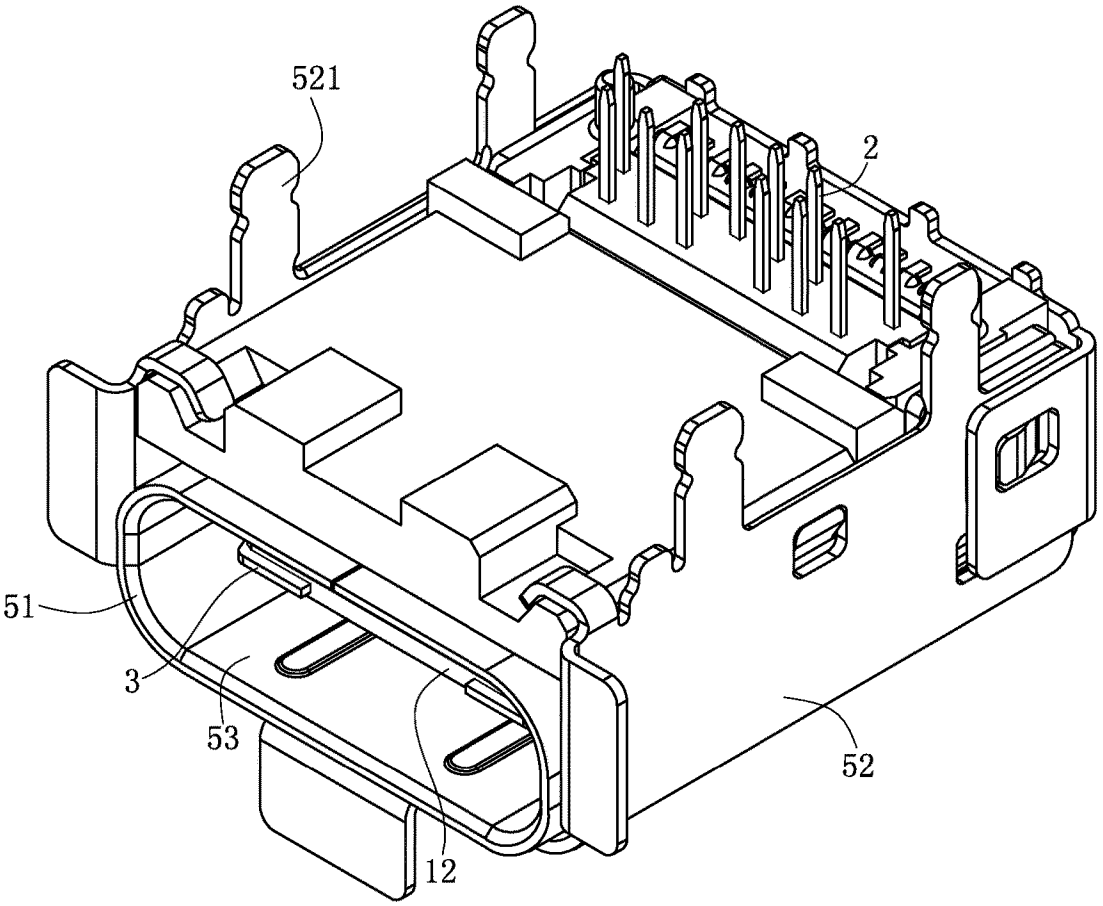
FIG. 39 is a three-dimensional assembly view of the electrical connector according to the eleventh embodiment of the present invention.
Figure 40:
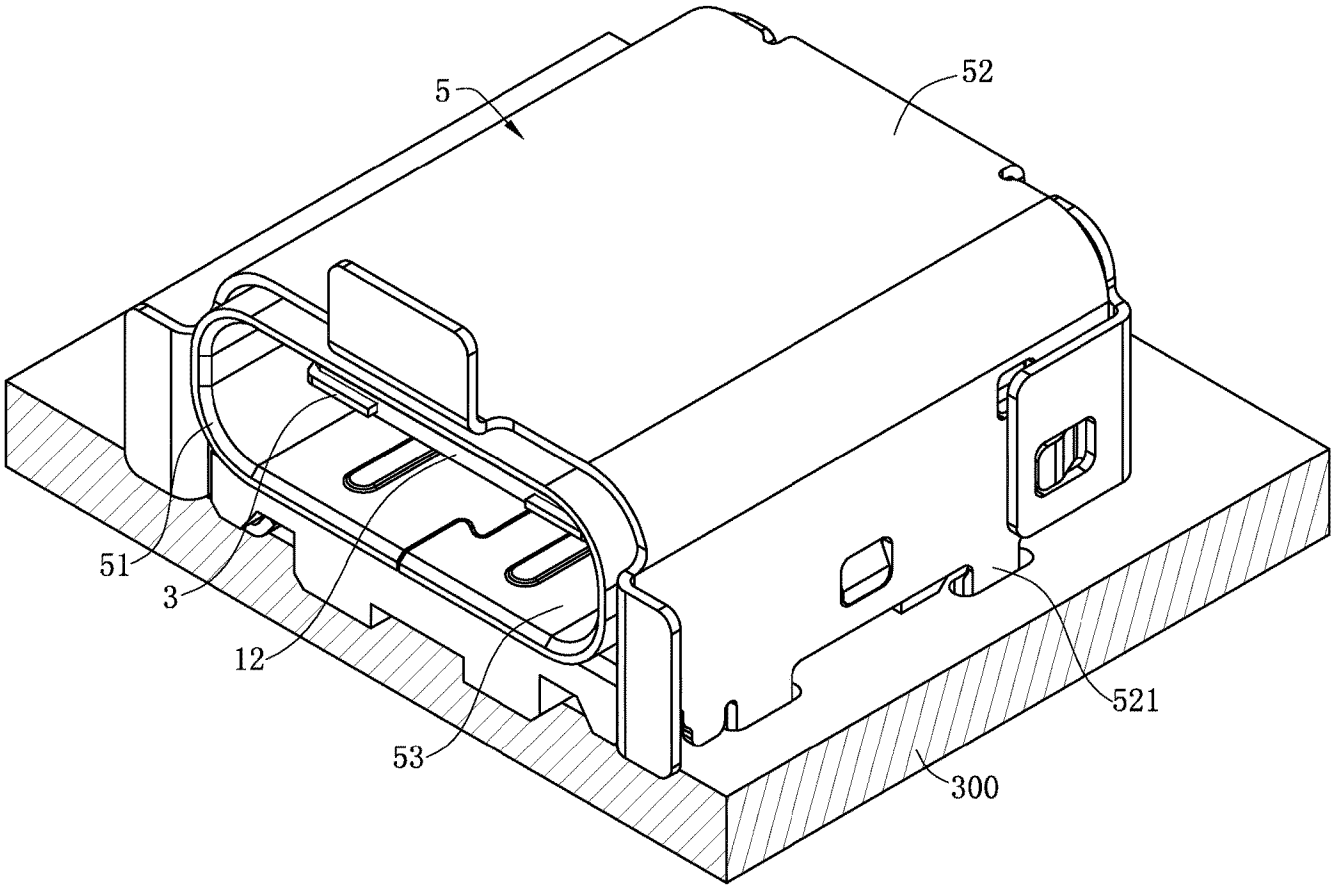
FIG. 40 is a three-dimensional assembly view of the electrical connector mounted on a circuit board according to the eleventh embodiment of the present invention.
Figure 41:
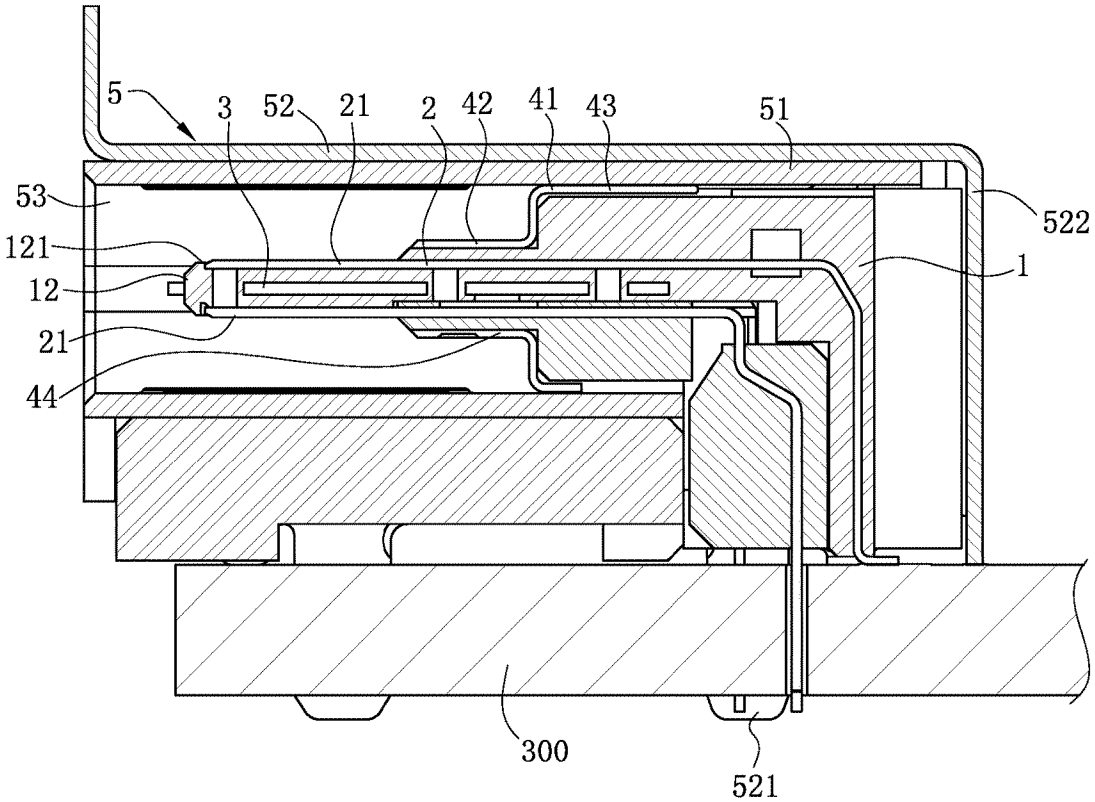
FIG. 41 is a sectional view of the electrical connector mounted on the circuit board according to the eleventh embodiment of the present invention.
Figure 42:
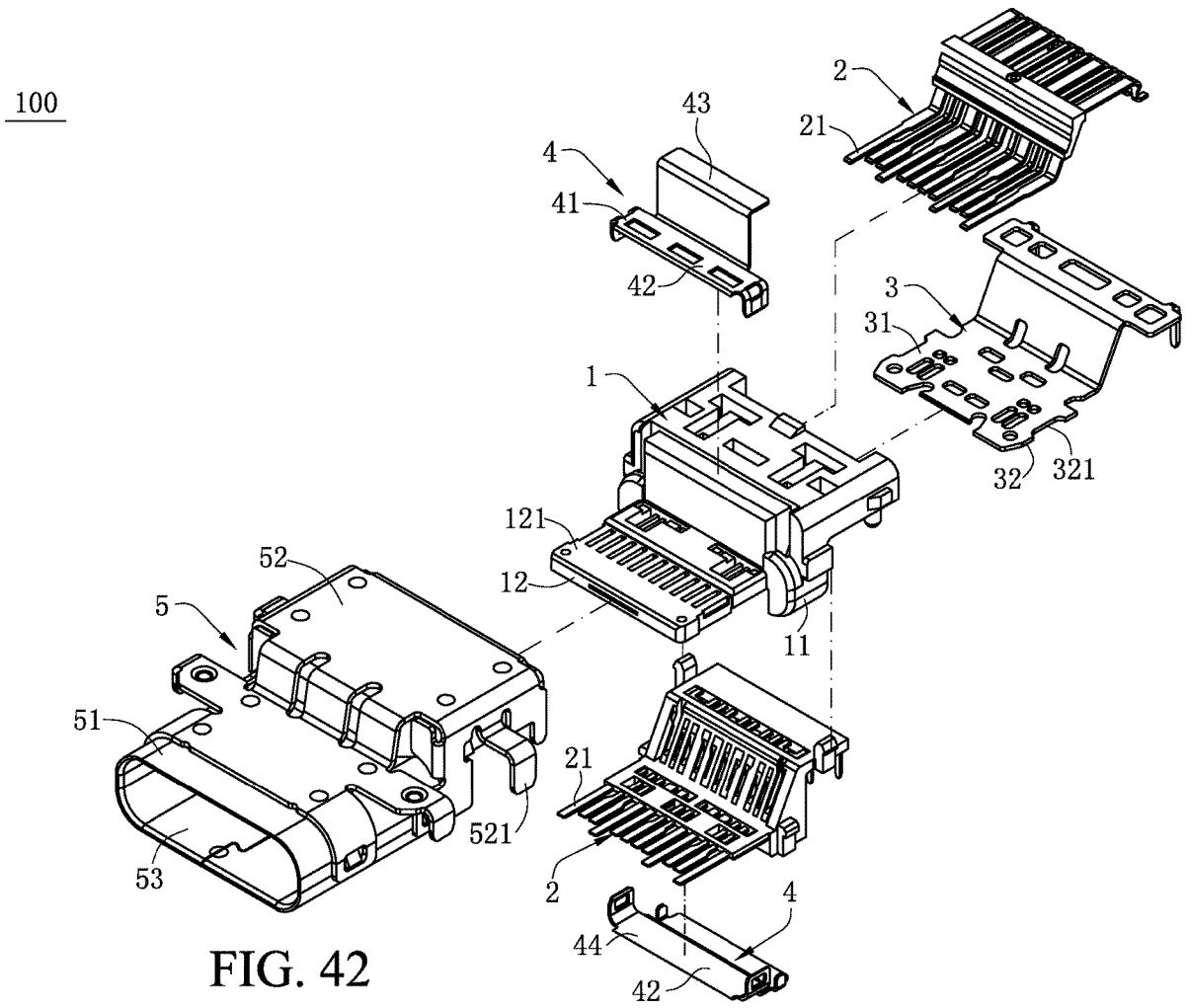
FIG. 42 is a three-dimensional exploded view of an electrical connector according to a twelfth embodiment of the present invention.
Figure 43:
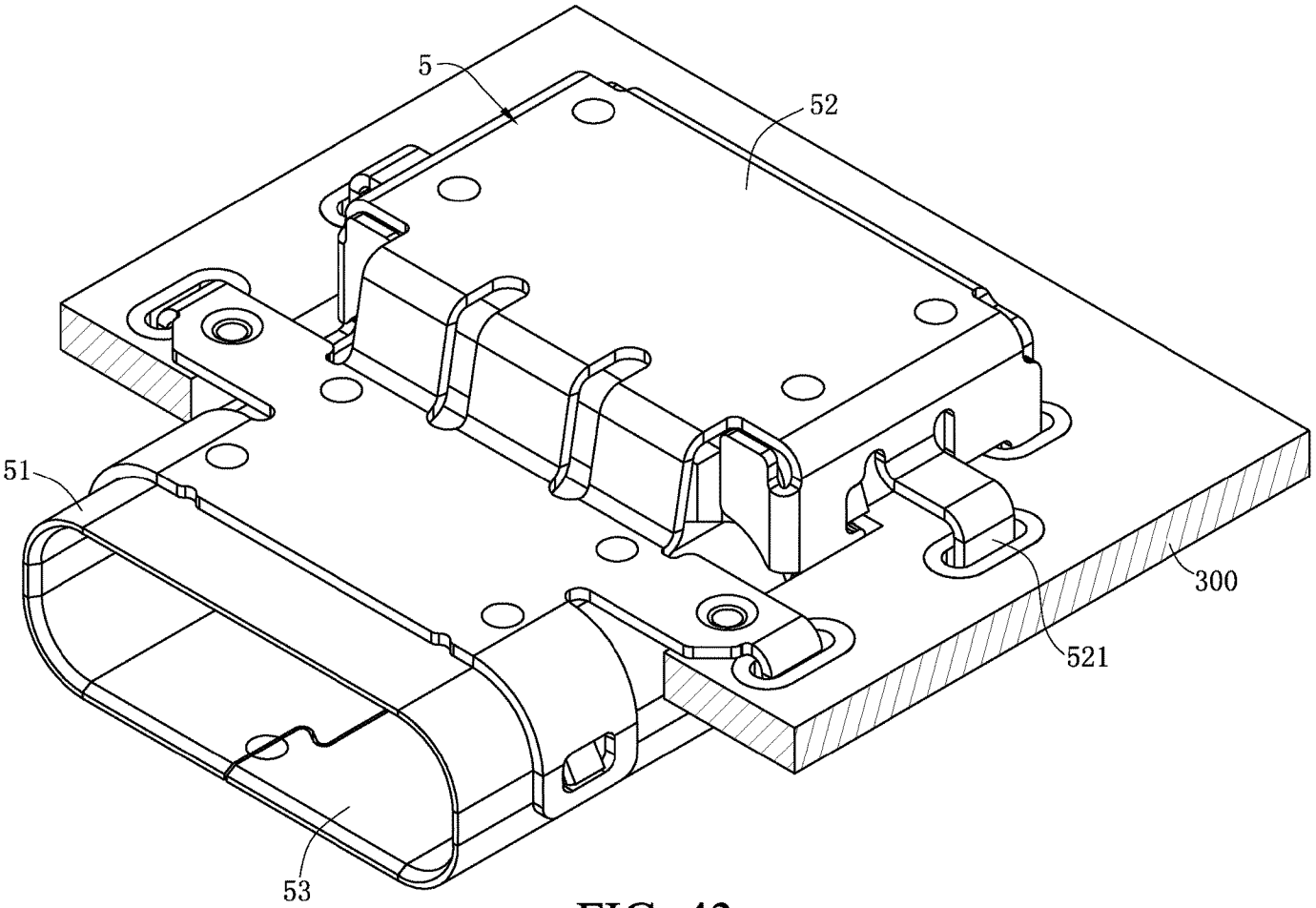
FIG. 43 is a three-dimensional assembly view of the electrical connector mounted on a circuit board according to the twelfth embodiment of the present invention.
Figure 44:
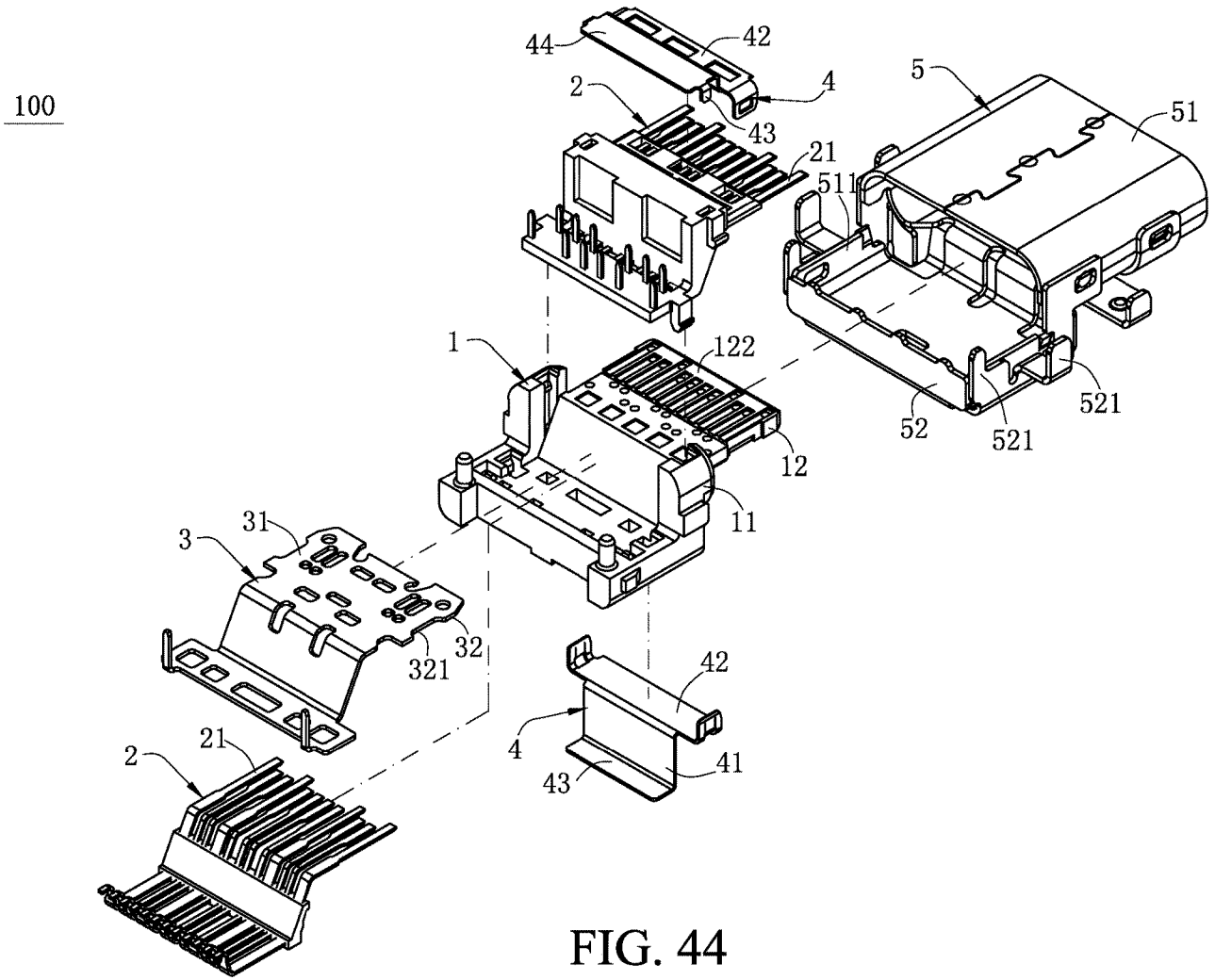
FIG. 44 is a three-dimensional exploded view of the electrical connector viewed from another viewing angle according to the twelfth embodiment of the present invention.
Figure 45:
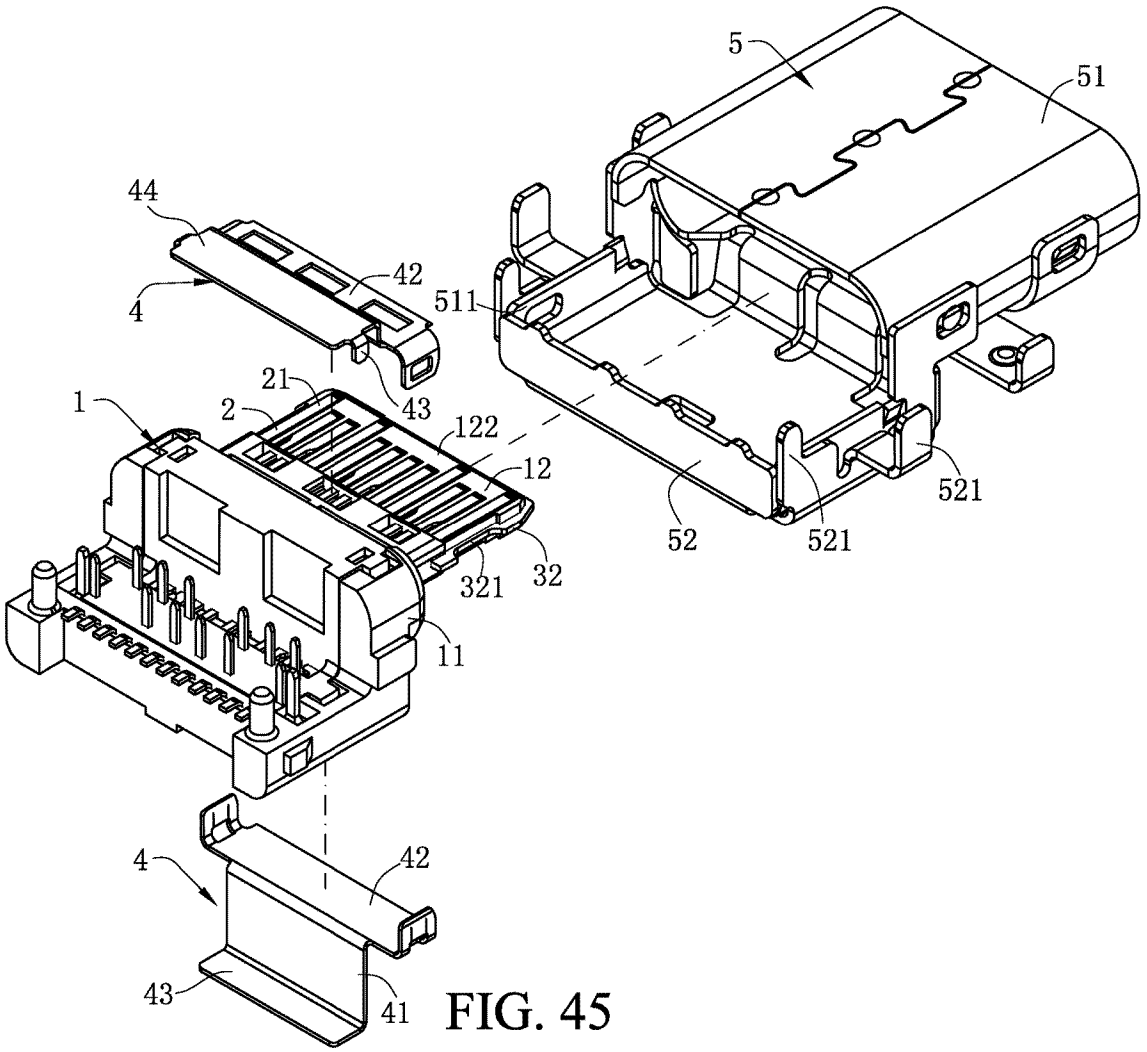
FIG. 45 is a partial three-dimensional exploded view of the electrical connector viewed from another viewing angle according to the twelfth embodiment of the present invention.
Figure 46:
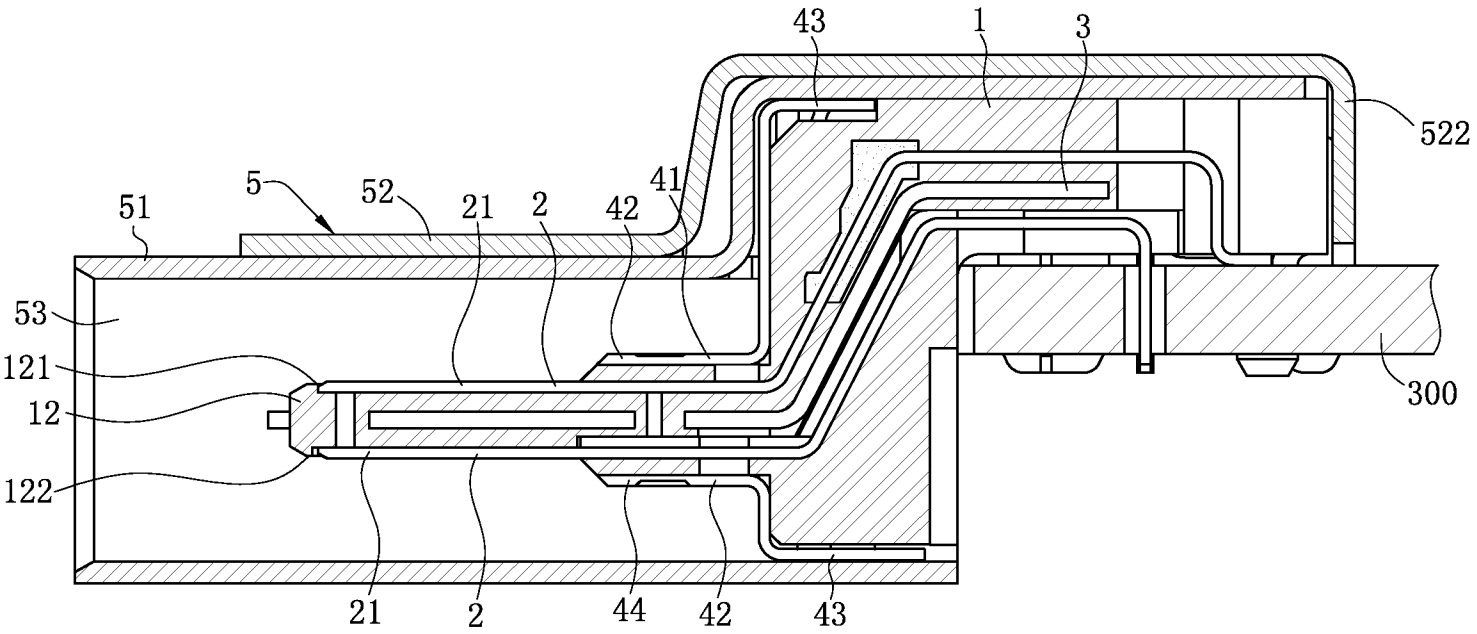
FIG. 46 is a sectional view of the electrical connector according to the twelfth embodiment of the present invention.

As shown in FIG. 31 and FIG. 36, the electrical connector 100 is also of a sinking board type, and a part of the tongue 12 and the lower row of terminals 2 are lower than the circuit board 300. A height difference is formed between the front segment and the rear segment of the shielding casing 52, the second soldering pins 521 are four in number, and are respectively disposed at two sides of the shielding casing 52, and each of the front segment and the rear segment of the shielding casing 52 is provided with two second soldering pins. The sinking board is low, and structures of the electrical connector 100 fixed onto the circuit board 300 are less than those in the on-board type. Therefore, in order to improve the strength, welding is performed between the wrapping casing 51 and the shielding casing 52 by means of point welding, so as to further firmly fix the wrapping casing 51 and the shielding casing 52. Disposition of the four second soldering pins 521 also further ensures that the electrical connector 100 is stably welded to the circuit board 300.

As shown in FIG. 37 to FIG. 41, the electrical connector 100 is used in a desktop host. Because of disposition of external interfaces, the center of the electrical connector 100 is at a long distance from the upper surface of the circuit board 300, and the welding portions of the multiple terminals 2 need to be designed to be very long, and correspondingly, the first soldering pins 511 and the second soldering pins 521 also need to be designed to be very long, so that it can be satisfied that the electrical connector 100 is highly disposed on the upper surface of the circuit board 300. In order that the electrical connector 100 is stably mounted onto the circuit board 300, and the electrical connector 100 is not slanted when the mating connector 200 is inserted into the electrical connector 100, a heightening block is added between the electrical connector 100 and the circuit board 300, and the heightening block is used for supporting the electrical connector 100.

As shown in FIG. 42 to FIG. 46, the electrical connector 100 is also of a sinking board type, and the tongue 12 and the terminals 2 are all located below the circuit board 300.

Figure 47:
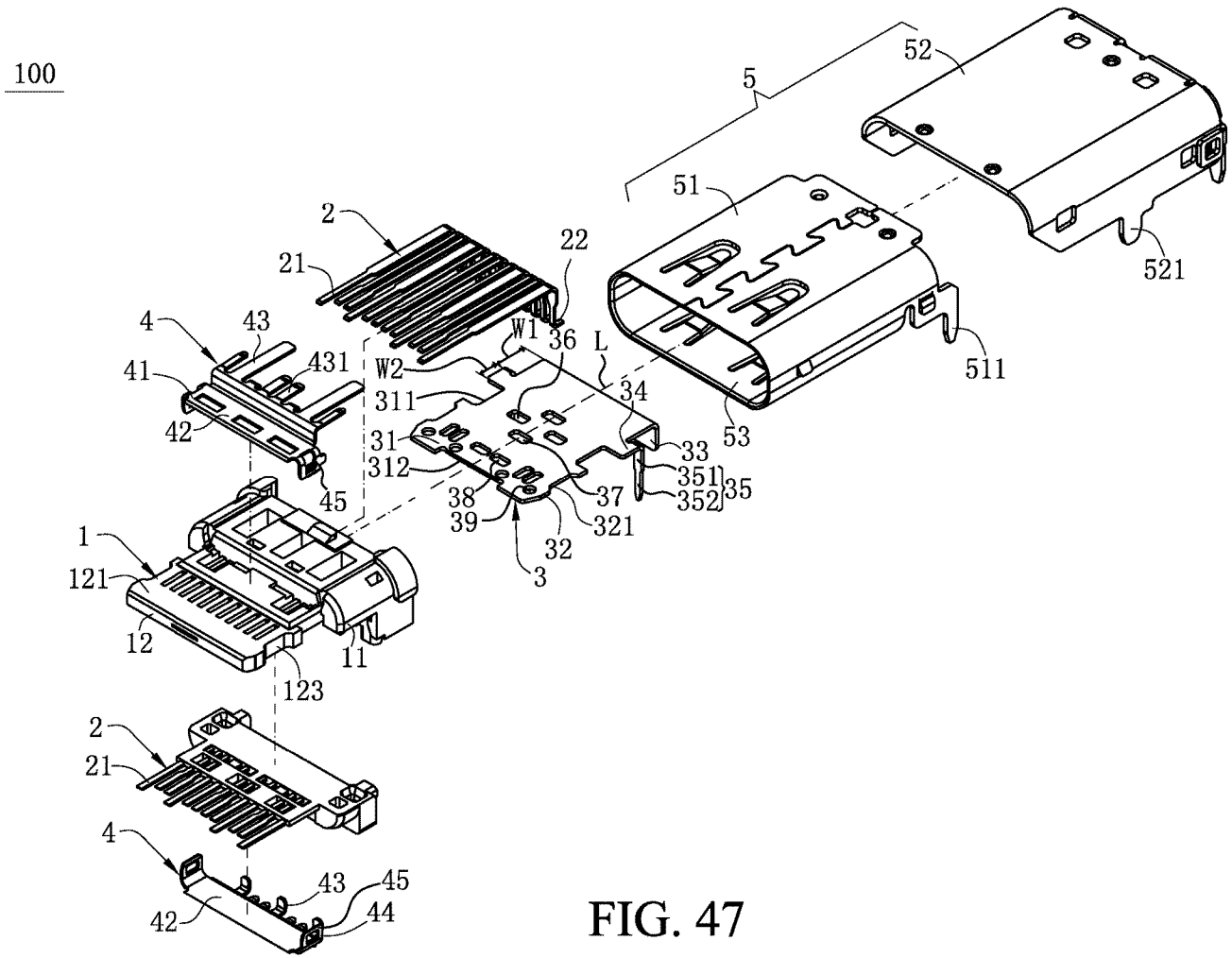
FIG. 47 is a three-dimensional exploded view of an electrical connector according to a thirteenth embodiment of the present invention.
Figure 49:
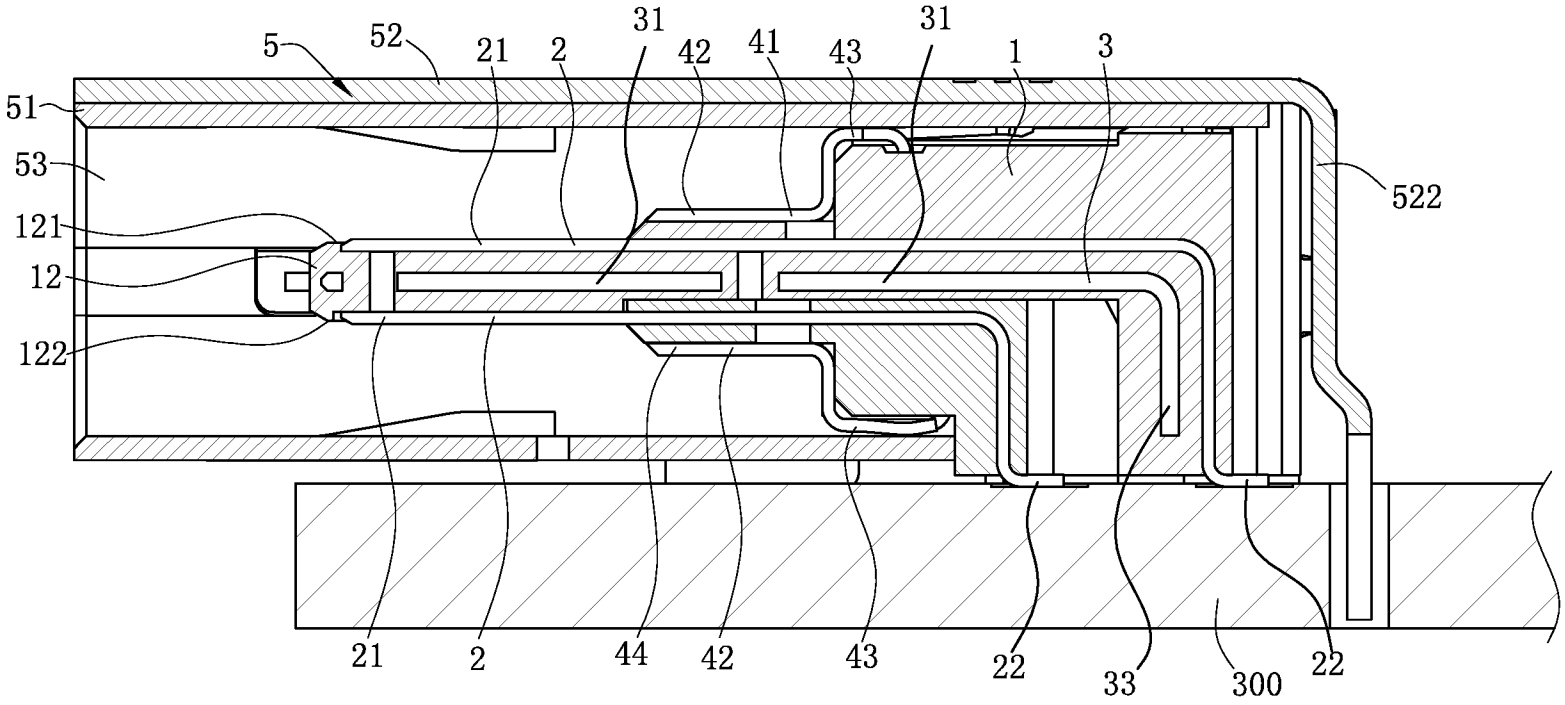
FIG. 49 is a sectional view of the electrical connector according to the thirteenth embodiment of the present invention.
Figure 50:
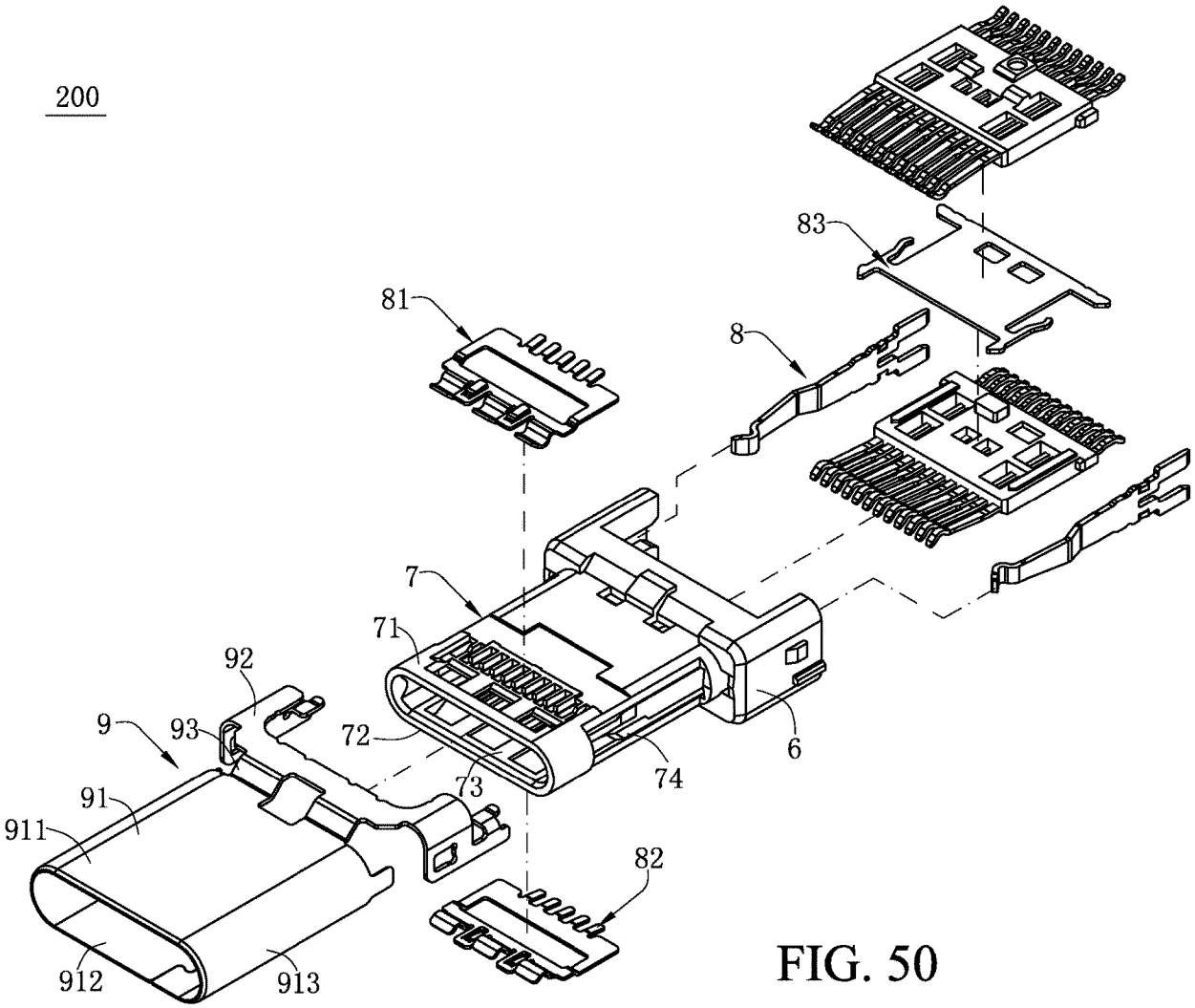
FIG. 50 is a three-dimensional exploded view of a mating connector according to a fourteenth embodiment of the present invention.
Figure 51:
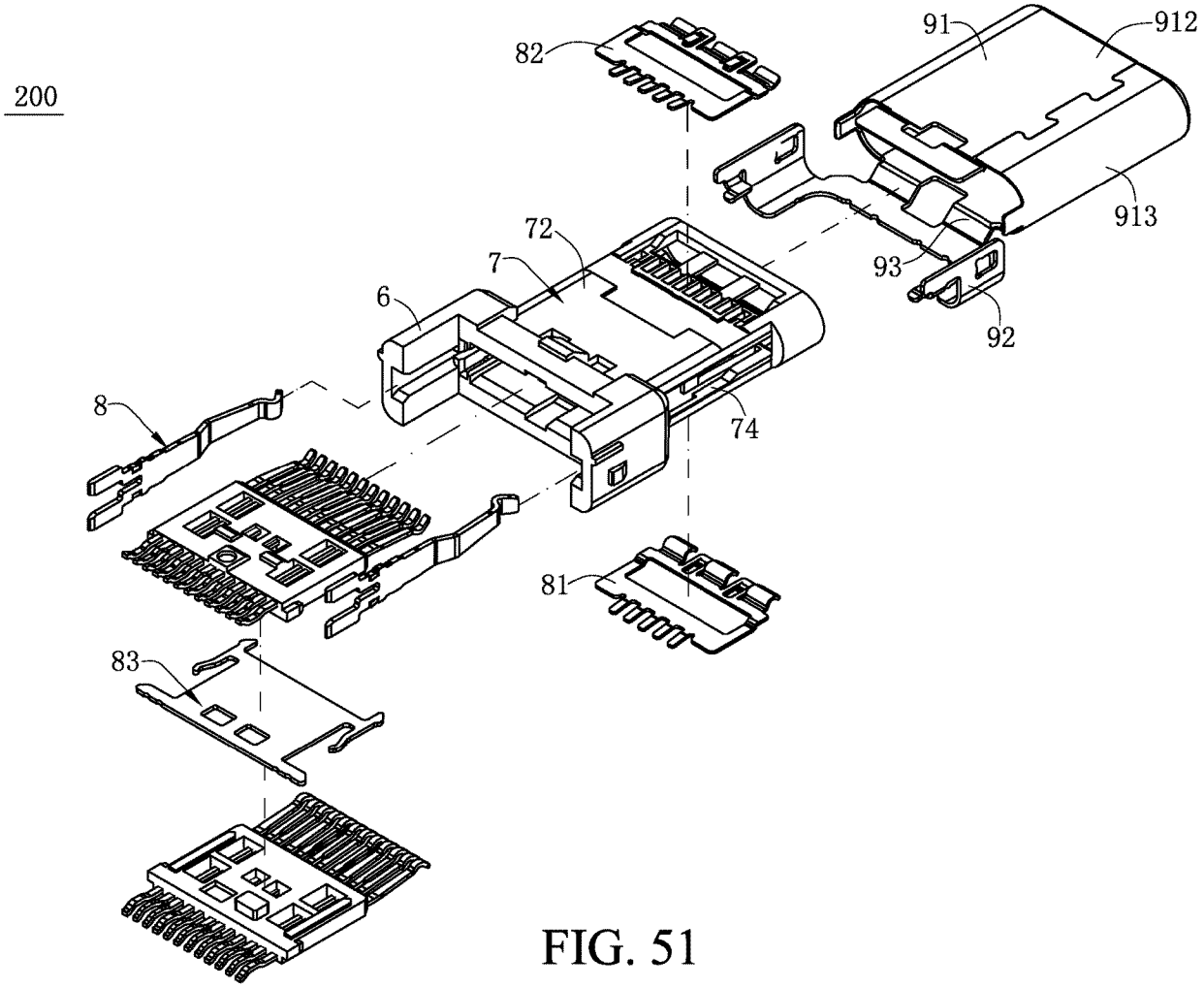
FIG. 51 is a three-dimensional exploded view of the mating connector viewed from another viewing angle according to the fourteenth embodiment of the present invention.
Figure 52:
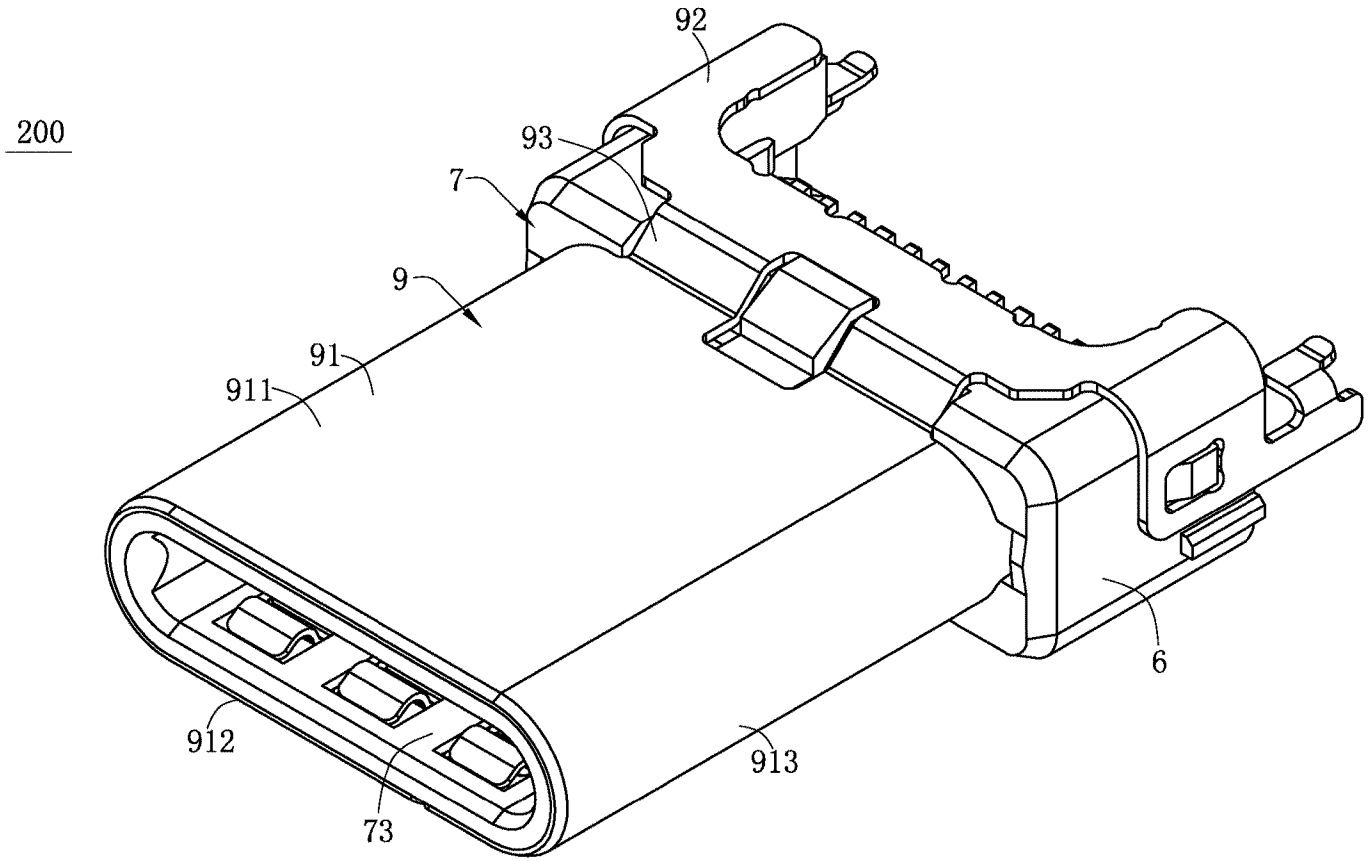
FIG. 52 is a three-dimensional assembly view of the mating connector according to the fourteenth embodiment of the present invention.
Figure 53:
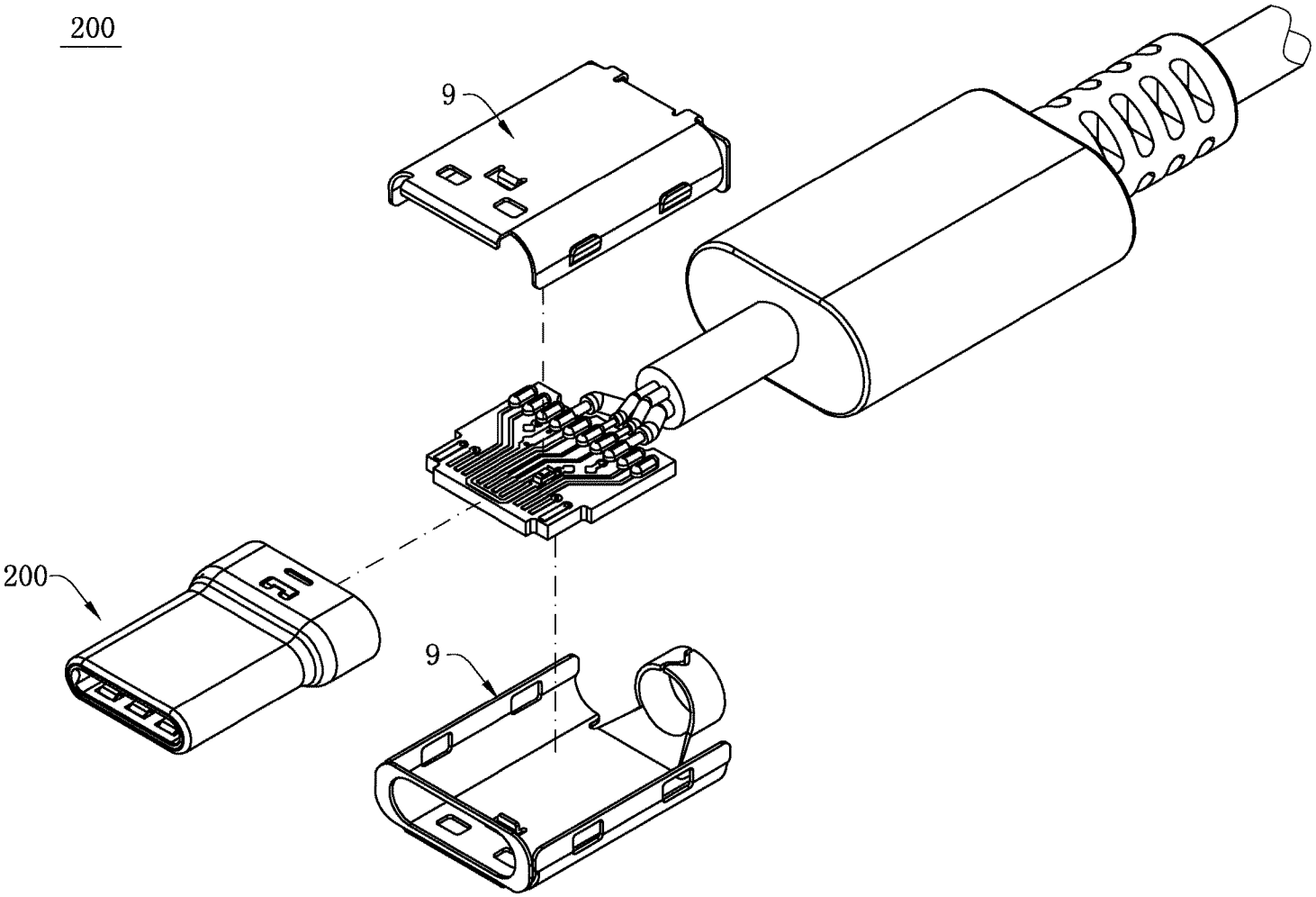
FIG. 53 is a three-dimensional exploded view of a mating connector according to a fifteenth embodiment of the present invention.
Figure 54:
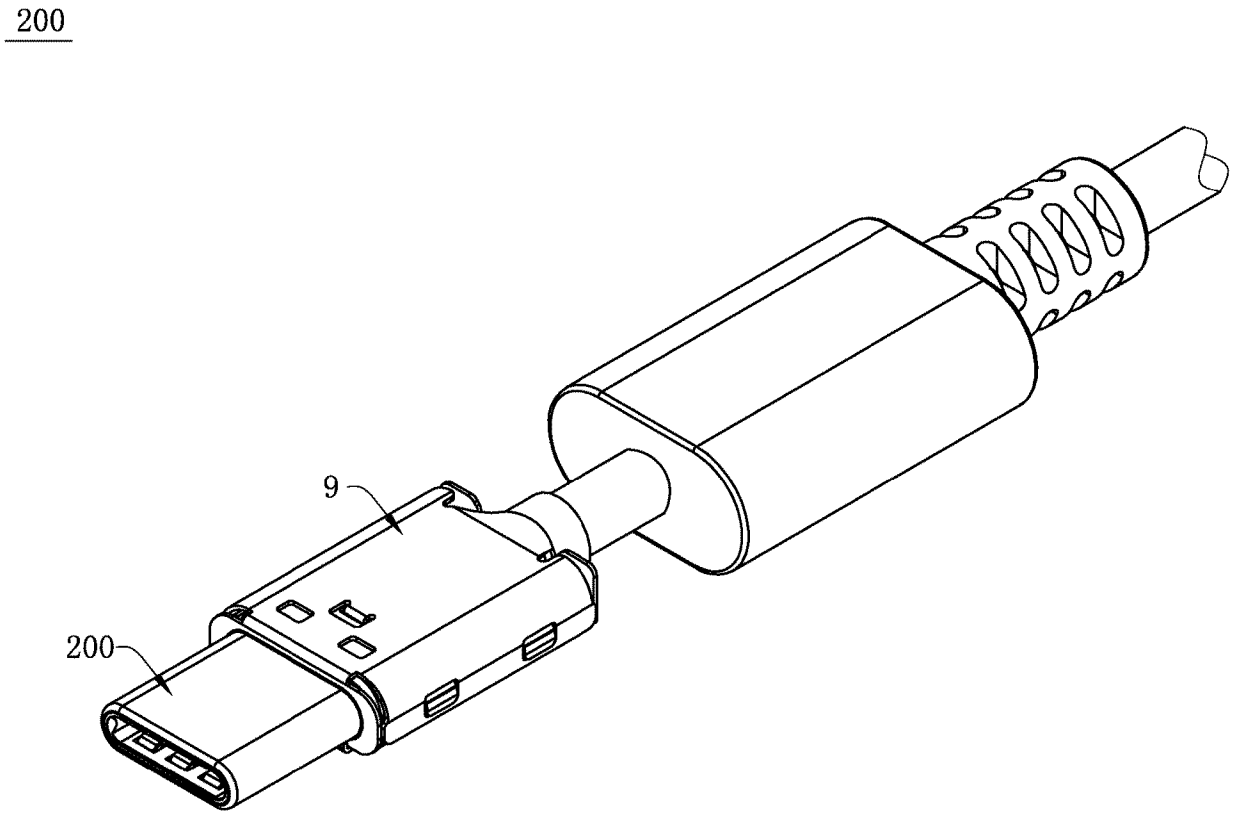
FIG. 54 is a three-dimensional assembly view of the mating connector according to the fifteenth embodiment of the present invention.

As shown in FIG. 47 to FIG. 49, the electrical connector 100 according to a thirteenth embodiment of the present invention is provided. In the present embodiment, each of the upper shielding sheet 41 and the lower shielding sheet 44 is provided with a side plate 45, and the inner metal casing 4 is fixed to the insulation body 1 by the side plate 45 of the upper shielding sheet 41 and the side plate 45 of the lower shielding sheet 44 fastening to each other. Each terminal 2 has a soldering portion 22. The soldering portions 22 are soldered onto the circuit board 300 in an SMT (Surface Mount Technology) manner. The soldering portions 22 of the terminals 2 in the upper row are arranged in a row, the soldering portions 22 of the terminals 2 in the lower row are arranged in a row, and the soldering portions 22 of the terminals 2 in the upper row are located right behind the soldering portions 22 of the terminals 2 in the lower row.

The plate portion 31 is planar and has a center line L in the front-rear direction. A rear end of the plate portion 31 bends downwards vertically to form the baffle 33, which is accommodated in the base portion 11 and located between the soldering portions 22 in the two rows for shielding crosstalk between the soldering portions 22 in the two rows. Further, a distance between the baffle 33 and the soldering portions 22 in the back row is smaller than a distance between the baffle 33 and the soldering portions 22 in the front row. Moreover, a side edge of the baffle 33 is flush with a side edge of the plate portion 31.

Each of two opposite side edges of the plate portion 31 extends horizontally to form a connecting portion 34. The two connecting portions 34 are in front of the rear end of the plate portion 31, and the two connecting portions 34 are symmetrical along the center line L. A rear edge of each connecting portion 34 bends downwards to form a leg 35 which extends out of the insulation body 1, and a side edge of each leg 35 is flush with a side edge of the corresponding connecting portion 34. A distance between the rear end of the plate portion 31 and the rear edge of each connecting portion 34 in the front-rear direction is defined to be W1, and a width of each of the connecting portions 34 in the front-rear direction is defined to be W2, where W1 is greater than W2. The connecting portions 34 and the baffle 33 are accommodated in the base portion 11, and due to the limitation of the size of the electrical connector 100, a length of the base portion 11 in the front-rear direction is limited. Thus, the sum of W1 and W2 cannot be significantly increased. As a result, under the condition that the sum of W1 and W2 remains unchanged, making W1 to be greater than W2 would result in a reduction of W2 and an increase of W1, thereby increasing the distance between the legs 35 and the baffle 33, and satisfying the requirement for the electrical connector 100 to achieve high-frequency signal transmission. Furthermore, by increasing the length of W1, the difficulty of the bending formation of the baffle 33 can be reduced. Further, the legs 35 are located in front of the baffle 33. A gap exists between each leg 35 and the plate portion 31, thereby increasing the elasticity of each leg 35. Preferably, in the embodiment, the gap between the legs 35 and the plate portion 31 is smaller than the width of each of the connecting portions 34 in the front-rear direction. Each leg 35 has a first section 351 which is accommodated in the insulation body 1 and parallel to the baffle 33, where the first section 351 is in front of the baffle 33, and the first section 351 and the baffle 33 are arranged in a staggered way in the front-rear direction; and a second section 352 which is connected to the first section 351 and exposed from the insulation body 1. A length of the first section 351 is greater than a width of the baffle 33 in the vertical direction.

Two first through holes 36 arranged in a row and a second through hole 37 located in front of the first through holes 36 are formed by passing through an upper surface and a lower surface of the plate portion 31. The two first through holes 36 are located on two opposite sides of the center line L and are symmetrically arranged. In the front-rear direction, the connecting portions 34 are located closer to the first through holes 36 than a front end of the plate portion 31, and the center line L passes through the second through hole 37. Each of the two opposite side edges of the plate portion 31 is further provided with a slot 311 in front of a corresponding connecting portion 34, and the two slots 311 and the first through holes 36 are arranged in a same row. The side plates 45 are accommodated in the slots 311. In the embodiment, preferably, a front edge of each slot 311 is located behind a front edge of the second through hole 37, and a width of each slot 311 in the front-rear direction is greater than the distance between the rear end of the plate portion 31 and the rear edge of the connecting portions 34 in the front-rear direction. In other embodiments, the size and position of the slots 311 are not limited thereto, as long as the slots 311 can accommodate the side plates 45.

Further, the plate portion 31 is further provided with two third through holes 38 penetrating therethrough and located in front of the second through hole 37. The two third through holes 38 are located on the two sides of the center line L, and are symmetrical to the center line L. A distance between the first through holes 36 and the second through hole 37 is different from a distance between the second through hole 37 and the third through holes 38. In the embodiment, the distance between the first through holes 36 and the second through hole 37 is smaller than the distance between the second through hole 37 and the third through holes 38. A recess 312 is concavely formed backward on a front end of the plate portion 31. The recess 312 is located right in front of the third through holes 38, and a distance between the recess 312 and the third through holes 38 is smaller than a distance between the third through holes 38 and the connecting portions 34 in a row. The first through holes 36, the second through hole 37 and the third through holes 38 are all located between backward extending lines of a left edge and a right edge of the recess 312. The plate portion 31 is provided with two round holes 39 symmetrically formed at two opposite sides of the recess 312, respectively. An extending line of a side edge of the plate portion 31 connecting the baffle 33 passes through the two round holes 39, and a forward extending line of a side edge of each slot 311 also passes through a corresponding one of the round holes 39. Preferably, the two protruding portions 32 and the two round holes 39 are arranged in a same row, and a backward extending line of an outer side edge of each protruding portion 32 passes through a corresponding connecting portion 34. A connecting line of rear ends of the two protruding portions 32 passes through the third through holes 38.

In summary, the electrical connector 100 and the electrical connector assembly of the present invention have the following beneficial effects:

(1) The upper shielding sheet 41 has the extending portion 43 covering the base portion 11, so as to increase the coverage range of the inner metal casing 4, and can, when the electrical connector 100 performs high-speed signal transmission, more effectively prevent the electromagnetic radiation in the insertion space 53 from being leaked backward which interferes with the tail of the terminals 2 to cause crosstalk, thereby improving the signal transmission quality of the electrical connector 100.

(2) The middle shielding sheet 3 has the two protruding portions 32 exposed from the two sides of the tongue 12, and the groove 321 is disposed at the protruding portion 32. Because both the middle shielding sheet 3 and the metal elastic sheet 8 are made of a metal material, when the mating connector 200 enters the insertion space 53, the metal elastic sheet 8 and the groove 321 are snap-fit and fixed, which not only can implement stable buckling of the mating connector 200 and the electrical connector 100, but also can prevent the abrasion problem.

(3) Under the condition that the sum of W1 and W2 remains unchanged, making W1 to be greater than W2 would result in a reduction of W2 and an increase of W1, thereby increasing the distance between the pins 35 and the baffle 33, and satisfying the requirement for the electrical connector 100 to achieve high-frequency signal transmission.

Additionally, the protruding portion 32 and the groove 321 extend out of the two sides of the tongue 12 and are located in the insertion space 53, which helps the mating connector 200 enter the insertion space 53 to snap-fit the groove 321, the snap-fit strength is large, and the mating connector 200 is not easily disengaged.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulation body;

a plurality of terminals, fixedly disposed on the insulation body in an upper row and a lower row, wherein each of the terminals has a soldering portion, and the soldering portions are arranged in two rows in a front-rear direction; and a middle shielding sheet, fixedly disposed on the insulation body, wherein the middle shielding sheet has a planar plate portion located between the terminals in the upper row and the lower row, a baffle extends downward from a rear end of the plate portion and is located between the soldering portions in the two rows, the plate portion extends horizontally in a lateral direction to form a connecting portion, the connecting portion is in front of the rear end of the plate portion, and a leg extends and bends downward from a rear edge of the connecting portion;

wherein a distance between the rear end of the plate portion and the rear edge of the connecting portion in the front-rear direction is greater than a width of the connecting portion in the front-rear direction.

2. The electrical connector according to claim 1, wherein a side edge of the leg is flush with a side edge of the connecting portion.

3. The electrical connector according to claim 1, wherein a distance between the baffle and the soldering portions in a back row is smaller than a distance between the baffle and the soldering portions in a front row.

4. The electrical connector according to claim 1, wherein the leg is located in front of the baffle.

5. The electrical connector according to claim 1, wherein a gap between the leg and the plate portion is smaller than the width of the connecting portion in the front-rear direction.

6. The electrical connector according to claim 1, wherein the leg has:

a first section accommodated in the insulation body and parallel to the baffle, wherein the first section is in front of the baffle, and the first section and the baffle are arranged in a staggered way in the front-rear direction; and a second section connected to the first section and exposed to the insulation body.

7. The electrical connector according to claim 6, wherein a length of the first section is greater than a width of the baffle in a vertical direction.

8. The electrical connector according to claim 1, wherein a side edge of the baffle is flush with a side edge of the plate portion.

9. The electrical connector according to claim 1, wherein:

two connecting portions are symmetrically arranged and formed by extending from two opposite side edges of the plate portion, respectively;

at least two first through holes arranged in a row and a second through hole located in front of the first through holes are formed by passing through an upper surface and a lower surface of the plate portion;

the connecting portions are located closer to the first through holes than a front end of the plate portion in the front-rear direction; and the plate portion has a center line in the front-rear direction, and the center line passes through the second through hole.

10. The electrical connector according to claim 9, wherein two slots are respectively provided at the two opposite side edges of the plate portion in front of the connecting portions, and the two slots and the first through holes are arranged in a row.

11. The electrical connector according to claim 10, wherein a front edge of each of the slots is located behind a front edge of the second through hole.

12. The electrical connector according to claim 10, wherein a width of each of the slots in the front-rear direction is greater than the distance between the rear end of the plate portion and the rear edge of the connecting portion in the front-rear direction.

13. The electrical connector according to claim 10, wherein an upper shielding sheet covers an upper surface of the insulation body, a lower shielding sheet covers a lower surface of the insulation body, each of the upper shielding sheet and the lower shielding sheet is provided with a side plate accommodated in each of the slots.

14. The electrical connector according to claim 9, wherein the plate portion is provided with two third through holes penetrating therethrough in front of the second through hole, the two third through holes are located on two sides of the center line and are symmetrical to the center line, and a distance between the first through holes and the second through hole is different from a distance between the second through hole and the third through holes.

15. The electrical connector according to claim 14, wherein a recess is concavely formed backward on a front end of the plate portion, the recess is located right in front of the third through holes, and a distance between the recess and the third through holes is smaller than a distance between the third through holes and the connecting portions in a row.

16. The electrical connector according to claim 15, wherein the first through holes, the second through hole and the third through holes are all located between backward extending lines of a left edge and a right edge of the recess.

17. The electrical connector according to claim 15, wherein the plate portion is provided with two round holes symmetrically formed at two opposite sides of the recess, respectively, and an extending line of a side edge of the plate portion connecting the baffle passes through one of the two round holes.

18. The electrical connector according to claim 17, wherein two slots are respectively at the two opposite side edges of the plate portion in front of the connecting portions, and a forward extending line of a side edge of each of the slots passes through a corresponding one of the round holes.

19. The electrical connector according to claim 17, wherein the two opposite side edges of the plate portion respectively extend to form two protruding portions exposed from the insulation body, the two protruding portions and the two round holes are arranged in a same row, and a backward extending line of an outer side edge of each of the two protruding portions passes through a corresponding one of the connecting portions.

20. The electrical connector according to claim 19, wherein a connecting line of rear ends of the two protruding portions passes through the third through holes.

* * * * *